US007659044B2

(12) United States Patent
Li et al.

(10) Patent No.: US 7,659,044 B2
(45) Date of Patent: Feb. 9, 2010

(54) PHOTOCONDUCTOR, PRODUCING METHOD THEREOF, IMAGE FORMING PROCESS AND IMAGE FORMING APPARATUS USING PHOTOCONDUCTOR, AND PROCESS CARTRIDGE

(75) Inventors: Hongguo Li, Numazu (JP); Kazukiyo Nagai, Numazu (JP); Tetsuro Suzuki, Fuji (JP); Yasuo Suzuki, Fuji (JP); Harukazu Okuda, Takefu (JP); Masahide Hatanaka, Takefu (JP)

(73) Assignees: Ricoh Company, Ltd., Tokyo (JP); Nissin Chemical Industry Co., Ltd., Takefu-shi (JP)

( * ) Notice: Subject to any disclaimer, the term of this patent is extended or adjusted under 35 U.S.C. 154(b) by 534 days.

(21) Appl. No.: 11/172,989

(22) Filed: Jul. 5, 2005

(65) Prior Publication Data

US 2006/0014093 A1 Jan. 19, 2006

(30) Foreign Application Priority Data

Jul. 5, 2004 (JP) ..... 2004-198184
Nov. 2, 2004 (JP) ..... 2004-319768

(51) Int. Cl.
*G03G 5/147* (2006.01)

(52) U.S. Cl. ..... 430/66; 430/67; 430/123.42; 399/159

(58) Field of Classification Search ..... 430/58.2, 430/58.7, 66, 67, 56, 132, 133, 123.4, 123.42; 399/116, 159
See application file for complete search history.

(56) References Cited

U.S. PATENT DOCUMENTS 5,286,588 A 2/1994 Suzuki
5,492,784 A 2/1996 Yoshikawa et al.
5,561,016 A 10/1996 Suzuki et al.
5,578,405 A 11/1996 Ikegami et al.
5,665,500 A 9/1997 Suzuki
5,677,096 A 10/1997 Suzuki
5,723,243 A 3/1998 Sasaki et al.
5,747,204 A 5/1998 Anzai et al.
5,789,128 A 8/1998 Adachi et al.
5,830,980 A 11/1998 Anzai et al.
5,840,454 A 11/1998 Nagai et al.
5,846,680 A 12/1998 Adachi et al.
5,853,935 A 12/1998 Suzuki et al.
5,871,876 A 2/1999 Ikuno et al.
5,910,561 A 6/1999 Adachi et al.
5,928,828 A 7/1999 Suzuki
5,942,363 A 8/1999 Tanaka et al.
5,976,746 A 11/1999 Tanaka et al.
5,998,072 A 12/1999 Mochizuki et al.
6,018,014 A 1/2000 Nagai et al.
6,026,262 A 2/2000 Kinoshita et al.
6,027,846 A 2/2000 Shimada et al.
6,030,733 A 2/2000 Kami et al.
6,030,736 A 2/2000 Ikegami et al.
6,045,959 A 4/2000 Katayama et al.
6,066,428 A 5/2000 Katayama et al.
6,069,224 A 5/2000 Adachi et al.
6,130,310 A 10/2000 Katayama et al.
6,136,483 A 10/2000 Suzuki et al.
6,151,468 A 11/2000 Kami et al.
6,172,176 B1 1/2001 Tanaka et al.
6,187,492 B1 2/2001 Ri et al.
6,187,494 B1 2/2001 Kawamura et al.
6,191,249 B1 2/2001 Tanaka et al.
6,194,535 B1 2/2001 Katayama et al.
6,210,848 B1 4/2001 Nagai et al.
6,303,736 B1 10/2001 Kawamura et al.
6,316,577 B1 11/2001 Shimada et al.
6,326,112 B1 12/2001 Tamura et al.
6,416,915 B1 * 7/2002 Kikuchi et al. ..... 430/56
6,444,387 B2 9/2002 Ri et al.
6,486,293 B1 11/2002 Ri et al.
6,492,079 B2 12/2002 Shimada et al.
6,548,216 B2 4/2003 Kawamura et al.
6,576,386 B1 6/2003 Ri et al.
6,596,449 B2 7/2003 Shimada et al.
6,641,964 B2 11/2003 Ikuno et al.
6,664,361 B2 12/2003 Sasaki et al.
6,777,150 B2 8/2004 Suzuki et al.
6,790,571 B2 9/2004 Kawamura et al.
6,790,572 B2 9/2004 Tamoto et al.
6,800,410 B2 10/2004 Yasutomi et al.
6,819,892 B2 11/2004 Nakazato et al.
6,830,858 B2 12/2004 Sugino et al.
6,844,124 B2 1/2005 Ikuno et al.
6,849,367 B2 2/2005 Shoshi et al.
6,858,362 B2 2/2005 Tamoto et al.
6,861,188 B2 3/2005 Ikegami et al.
6,864,027 B2 3/2005 Suzuki
6,899,983 B2 5/2005 Tamoto et al.

(Continued)

FOREIGN PATENT DOCUMENTS

JP 56-48637 5/1981

(Continued)

OTHER PUBLICATIONS

Advanded Industrial Property Network—Japanese Patent Office (AIPN) machine-assisted translation of JP 2005-115353 (pub. Apr. 28, 2005).*

(Continued)

*Primary Examiner*—Janis L Dote
(74) *Attorney, Agent, or Firm*—Oblon, Spivak, McClelland, Maier & Neustadt, L.L.P.

(57) ABSTRACT

A photoconductor comprising a photosensitive layer disposed on a support, wherein the photosensitive layer has a crosslinked layer and the crosslinked layer is produced by curing a dispersion in which at least one of an acryl-modified polyoraganosiloxane having a radical reactivity and an acryl-modified polyoraganosiloxane having an amine structure is dispersed in a radical polymerizable monomer.

18 Claims, 3 Drawing Sheets

U.S. PATENT DOCUMENTS

| | | | | |
|---|---|---|---|---|
| 2003/0059695 | A1 | 3/2003 | Li et al. | |
| 2003/0077531 | A1 | 4/2003 | Suzuki et al. | |
| 2003/0198881 | A1 | 10/2003 | Kawamura et al. | |
| 2004/0002574 | A1 | 1/2004 | Ri et al. | |
| 2004/0013442 | A1 | 1/2004 | Suzuki et al. | |
| 2004/0048177 | A1* | 3/2004 | Tamoto et al. | 430/58.2 |
| 2004/0053152 | A1 | 3/2004 | Nagai et al. | |
| 2004/0057059 | A1 | 3/2004 | Miura et al. | |
| 2004/0126687 | A1 | 7/2004 | Ikegami et al. | |
| 2004/0131960 | A1 | 7/2004 | Kawamura et al. | |
| 2004/0170911 | A1 | 9/2004 | Shimada et al. | |
| 2004/0180280 | A1 | 9/2004 | Ikegami et al. | |
| 2004/0197687 | A1 | 10/2004 | Suzuki et al. | |
| 2004/0197688 | A1 | 10/2004 | Tamoto et al. | |
| 2004/0213600 | A1 | 10/2004 | Watanabe et al. | |
| 2004/0214101 | A1 | 10/2004 | Suzuki | |
| 2004/0248024 | A1 | 12/2004 | Suzuki et al. | |
| 2004/0253527 | A1 | 12/2004 | Suzuki et al. | |
| 2005/0003287 | A1 | 1/2005 | Kawamura et al. | |
| 2005/0008957 | A1 | 1/2005 | Ikegami et al. | |
| 2005/0100803 | A1 | 5/2005 | Suzuki | |
| 2005/0100804 | A1 | 5/2005 | Tamoto et al. | |
| 2005/0266328 | A1* | 12/2005 | Yanagawa et al. | 430/66 |

FOREIGN PATENT DOCUMENTS

| | | |
|---|---|---|
| JP | 60-177349 | 9/1985 |
| JP | 63-65449 | 3/1988 |
| JP | 64-1728 | 1/1989 |
| JP | 2-143257 | 6/1990 |
| JP | 2-144550 | 6/1990 |
| JP | 4-281461 | 10/1992 |
| JP | 5-216249 | 8/1993 |
| JP | 7-128872 | 5/1995 |
| JP | 7-295248 | 11/1995 |
| JP | 7-301936 | 11/1995 |
| JP | 8-82940 | 3/1996 |
| JP | 8-190213 | 7/1996 |
| JP | 8-262779 | 10/1996 |
| JP | 10-254160 | 9/1998 |
| JP | 2000-10322 | 1/2000 |
| JP | 2000-66425 | 3/2000 |
| JP | 2005-99688 | 4/2005 |
| JP | 2005-107490 | 4/2005 |
| JP | 2005-115322 | 4/2005 |
| JP | 2005-115353 | 4/2005 |

OTHER PUBLICATIONS

Diamond, A. S., ed. , Handbook of Imaging Materials, Marcel Dekker, NY (1991), pp. 395-396.*

USPTO English-language translation of JP 2005-115353 (pub. Apr. 28, 2005).*

U.S. Appl. No. 12/000,239, filed Dec. 11, 2007, Fujiwara, et al.

U.S. Appl. No. 11/562,203, filed Nov. 21, 2006, Nagai, et al.

U.S. Appl. No. 11/561,983, filed Nov. 21, 2006, Sugino, et al.

U.S. Appl. No. 11/563,710, filed Nov. 28, 2006, Inaba, et al.

U.S. Appl. No. 11/616,523, filed Dec. 27, 2006, Fujiwara, et al.

U.S. Appl. No. 11/621,805, filed Jan. 10, 2007, Suzuki, et al.

U.S. Appl. No. 11/684,520, filed Mar. 9, 2007, Toshine, et al.

U.S. Appl. No. 11/685,441, filed Mar. 13, 2007, Yanagawa, et al.

U.S. Appl. No. 11/692,682, filed Mar. 28, 2007, Mori, et al.

U.S. Appl. No. 09/679,480, filed Oct. 5, 2000, Yasuo Suzuki, et al.

U.S. Appl. No. 10/974,814, filed Oct. 28, 2004, Nozumu Tamoto, et al.

U.S. Appl. No. 10/944,003, filed Sep. 20, 2004, Yoshiki Yanagawa, et al.

U.S. Appl. No. 11/750,570, filed May 18, 2007, Ikuno, et al.

U.S. Appl. No. 11/763,853, filed Jun. 15, 2007, Nagai, et al.

U.S. Appl. No. 11/480,517, filed Jul. 5, 2006, Yanagawa, et al.

U.S. Appl. No. 11/500,352, filed Aug. 8, 2006, Toshine, et al.

U.S. Appl. No. 12/035,016, filed Feb. 21, 2008, Iwamoto, et al.

U.S. Appl. No. 12/047,011, filed Mar. 12, 2008, Kami, et al.

* cited by examiner

PHOTOCONDUCTOR, PRODUCING METHOD THEREOF, IMAGE FORMING PROCESS AND IMAGE FORMING APPARATUS USING PHOTOCONDUCTOR, AND PROCESS CARTRIDGE

BACKGROUND OF THE INVENTION

1. Field of the Invention

The present invention relates to a photoconductor to which high durability and a high image quality during a long term are imparted by disposing in the photoconductor, a photosensitive layer having excellent cleaning properties, high wear resistance and advantageous electrical properties. The present invention relates also to an image forming process, image forming apparatus and process cartridge for the image forming apparatus using the above-noted photoconductor having long life and high performance.

2. Description of the Related Art

Recently, organic photoconductors (OPC) are widely employed in copiers, facsimiles, laser printers, and composite apparatuses thereof owing to excellent performance and various advantages, in place of conventional inorganic photoconductors. Specific grounds thereof are thought as follows: (i) optical properties such as absorbable wavelength and absorption rate, (ii) electrical properties such as higher sensitivity and stable charging ability, (iii) margins of materials, (iv) productivity, (v) lower cost, (vi) safety, and the like.

On the other hand, photoconductors have been small-sized along with image forming apparatuses being small-sized; in addition, higher processing rate as well as maintenance free are have been required for image forming apparatuses; consequently, photoconductors are demanded for higher durability still more nowadays.

However, organic photoconductors are typically less durable since the hardness of the surface layers is relatively low due to their inherent components of charge transport materials of lower molecular mass and inactive polymers; therefore, the surface layers tend to wear significantly due to mechanical stress caused by developing systems and cleaning systems etc. under repeated usages in electrophotographic processes.

Further, rubber hardness of cleaning blades has been raised and pressure onto photoconductors applied from the cleaning blades has been increased so as to improve cleaning ability in order to enhance image quality by using toner particles with smaller particle sizes, which inevitably leading to higher wear rate of photoconductors. The wear of photoconductors certainly degrades sensitivity, electric properties such as charging ability etc., which resulting in deteriorated images such as lower image density and background smear. Further, flaws due to local wear often bring about streak on images due to insufficient cleaning. Such wear and flaws typically dominate photoconductors in terms of lifetime to be exchanged, currently.

As such, the wear rate should be decreased in order to enhance durability of organic photoconductors, which is one of the most important objects in the art.

Previously, various proposals have been provided in order to enhance wear resistance of photosensitive layers, for example, (1) incorporation of curable binders into the photosensitive layer (e.g. Japanese Patent Application Laid-Open (JP-A) No. 56-48637), (2) employment of polymers for charge transport materials (e.g. JP-A No. 64-1728), (3) dispersing inorganic fillers into surface layers (e.g. JP-A No. 4-281461), and the like.

However, in the (1) incorporation of curable binders described above, residual voltage tends to increase owing to impurities such as polymerization initiators and/or unreacted residual groups due to insufficient compatibility with charge transport materials, thus image density tents to decrease. In the method (2) using a charge transport polymer and the method (3) using an inorganic filler, while the wear resistance of the photoconductor can be improved to some extent, a photoconductor which can fully satisfy the durability required for the organic photoconductor is not yet obtained. Further, in the method (3) using an inorganic filler, the organic photoconductor comprising an inorganic filler has such a tendency that due to a charge trap which is present on the surface of the inorganic filler, the residual electric potential of the surface layer is elevated, so that the image density is easily lowered. As such, based on these proposals (1), (2), and (3), the durability of organic photoconductors is not satisfactory on the whole, including electrical durability and mechanical durability.

Further, photoconductors containing cured product of a multi-functional acrylate monomer are proposed in order to improve the abrasion resistance and scratch resistance such as of (i) (e.g. Japanese Patent No. 3262488). In the patent literature, it is disclosed that cured material of the multi-functional acrylate monomer is included into a protective layer on photosensitive layers. However, there exist no more than simple descriptions that a charge transport material may be contained in the protective layer and there exist no specific examples. Further, when a charge transport material having a low molecular mass is simply added to the surface layer, it may cause problems related with the compatibility to the cured body, thereby crystallization of charge transport material having a lower molecular mass and clouding may occur, resulting in reduction in mechanical properties.

In addition, a photoconductor is produced by way of causing reaction of monomers in a condition that a polymer binder is incorporated; therefore, there will be some problems that the curing cannot sufficiently proceed, and surface nonuniformity is induced due to phase separation at curing caused by insufficient compatibility between the cured material and the binder resin, which resulting in inferior cleaning in image forming apparatuses.

Further, another proposal is disclosed for reducing abrasion wear of photosensitive layers, in which a charge transport layer is provided using a coating liquid that comprises a monomer having a carbon-carbon double bond, a charge transport material having a carbon-carbon double bond, and a binder resin (e.g. Japanese Patent No. 3194392). The binder resin includes a binder reactive with the charge transport material having a carbon-carbon double bond and another binder non-reactive with the charge transport material without having the double bond. The photoconductor allegedly represents higher wear resistance as well as proper electrical properties. However, non-reactive resins as the binder resin tend to yield surface irregularity and thus inferior cleaning, since the non-reactive resins are typically non-compatible with reaction products between the monomer and the charge transport material, thus phase separation is likely to occur. Further, the patent literature discloses monomers having two functionalities as specific examples, which cannot bring about sufficient crosslinking density and satisfactory wear resistance due to the lower functionalities. Provided that reactive resins are employed as the binder resin, the bonding density and the crosslinking density are possibly not sufficiently high due to the lower functionalities of the monomer and the binder resin, thus electrical properties and wear resistance will not be satisfactory.

Further, another proposal is disclosed, in which photosensitive layers comprise reaction products that are produced by curing hole transport compounds having two or more functional groups capable of undergoing chain polymerization in a molecule (e.g. JP-A No. 2000-66425). However, the photosensitive layer tends to cause higher internal stress and thus to yield higher surface roughness and cracks, since the bulky hole transport compound have two or more chain polymerizable functional groups.

Further, even when the wear resistance of the photoconductor is improved, it does not mean the obtaining of the high durability of the photoconductor that a cleaning failure, an abnormal image, such as an image blur and an image degradation are easily caused due to the above-noted improvement of the wear resistance. Particularly with respect to a polymerized toner (or a toner having the form of a sphere) which is frequently used in the industry recently, when the toner is removed by the cleaning from a photoconductor having a high surface energy (or high friction coefficiency), a cleaning failure due to the escape of the toner from the cleaning blade is easily caused.

For lowering the surface energy or the friction coefficiency of the photoconductor surface, a method in which various lubricants are incorporated in the composition of the surface layer of the photoconductor is known. A method in which in the composition of the surface layer of the photoconductor, a lubricant, such as a fluorine-modified silicone oil is incorporated, is disclosed (see JP-A No. 07-295248, 07-301936 and 08-082940). In this method, the effect for the cleaning properties of the photoconductor or the removing of a contaminator from the photoconductor can be confirmed by lowering the surface energy of the photoconductor. However, since a fluorine-modified silicone oil is transferred closely to the surface of the photoconductor during the disposing of the protective layer, due to a slight wear of the surface layer during the repeated using of the photoconductor, the effect of the fluorine-modified silicone oil is lost in an early period of using the photoconductor. Therefore, it has been the actual state that even by using the fluorine-modified silicone oil, a satisfactory effect for enhancing the durability of the photoconductor cannot be obtained.

Further, with respect to the method for incorporating various lubricants in the form of fine particles in the composition of the most outer surface layer of the photoconductor, various attempts have been performed. Examples of the lubricant incorporated in the composition of the most outer surface layer of the photoconductor include fine particles of a silicone resin, fine particles of a resin containing a fluorine atom (see JP-A No. 63-65449) and fine particles of a melamine resin (see JP-A No. 60-177349). Examples of the above-noted method include a method in which polyethylene resin particles are incorporated in the composition of the surface layer (disclosed in JP-A No. 02-143257), a method in which particles of a resin containing a fluorine atom are incorporated in the composition of the surface layer (disclosed in, for example JP-A No. 02-144550), a method in which silicone resin fine particles are incorporated in the composition of the surface layer (disclosed in, for example JP-A Nos. 07-128872 and 10-254160) and a method in which cross linkable resin fine particles are incorporated in the composition of the surface layer (disclosed in, for example JP-A No. 2000-010322 corresponding to U.S. Pat. No. 5,998,072). Further, a method in which methylsiloxane resin fine particles are incorporated in the composition of the surface layer is disclosed in, for example JP-A No. 08-190213. The method in which the above-noted lubricants in the form of the fine particles are dispersed in the surface layer of the photoconductor is effective for enhancing the persistence of the effect as the lubricant and is more effective for enhancing the durability of the photoconductor than the above-noted method in which a silicone oil or the like is incorporated in the composition of the surface layer of the photoconductor. However, with respect to such a photoconductor, since the lubricant is incorporated in the charge transport layer having unsatisfactory wear resistance, while the lubricant has the effect of suppressing the attaching of various substances to the photoconductor in an early using of the photoconductor, the persistence of such suppressing effect for a long term is unsatisfactory.

Thus, it cannot be mentioned nowadays that a photoconductor comprising a crosslinked photosensitive layer which comprises the above-noted conventional lubricants has satisfactory general properties.

SUMMARY OF THE INVENTION

The object of the present invention is to provide a photoconductor which has excellent cleaning properties, high and stable wear resistance, and advantageous electrical properties, by which the persistence of the low surface energy of the photoconductor is remarkable and by which the maintaining of a high image quality for a long term has been obtained, and which can applied particularly to a polymerized toner (or a toner having the from of a sphere); and an image forming process, image forming apparatus and process cartridge for the electrophotography using the above-noted photoconductor having long life and high performance.

The present inventors have made extensive and intensive studies with a view toward attaining the above-noted object. As a result, it has been found that the above-noted object is attained by producing a photoconductor comprising a support and a photosensitive layer disposed on the support, wherein the photosensitive layer comprises a crosslinked layer which is produced by curing a dispersion in which a copolymer comprising mainly an acryl-modified polyorganosiloxane having a radical reactivity, an acryl-modified polyorganosiloxane having an amine structure or an acryl-modified polyorganosiloxane having both a radical reactivity and an amine structure is dispersed in a radical polymerizable monomer, or preferably by curing at least a trifunctional or more functional radical polymerizable monomer having no charge transport units and a radical polymerizable monomer having a charge transport units. Based on this novel finding, the present invention has been achieved. At least a surface part of the photosensitive layer is a crosslinked layer. In other word, either the whole photosensitive layer may comprise a crosslinked layer or the crosslinked layer may be a part of the photosensitive layer and the crosslinked layer may be disposed in the surface of the photosensitive layer which is not contacted with the support.

In other word, by producing a photoconductor which satisfies the following composition requirements, a photoconductor which has excellent cleaning properties, high and stable wear resistance, and advantageous electrical properties, by which the persistence of the low surface energy of the photoconductor is remarkable and by which the maintaining of a high image quality for a long term has been obtained, and which can be applied particularly to a polymerized toner (or a toner having the form of a sphere); and an image forming process, image forming apparatus and process cartridge for the electrophotography using the above-noted photoconductor having long life and high performance can be provided.

Specifically, the present invention provides, in the first aspect, a photoconductor comprising: a support, a photosensitive layer disposed on the support, wherein the photosensitive layer comprises a crosslinked layer and the crosslinked layer is produced by curing a dispersion in which at least one of an acryl-modified polyorganosiloxane having a radical reactivity and an acryl-modified polyorganosiloxane having an amine structure is dispersed in a radical polymerizable monomer.

The second aspect of the present invention is the photoconductor according to the first aspect, wherein the crosslinked layer is the whole photosensitive layer, or is disposed on the surface of the photosensitive layer opposite to the support.

The third aspect of the present invention is the photoconductor according to the first aspect, wherein the crosslinked layer is produced by curing a dispersion in which the acryl-modified polyorganosiloxane having an amine structure and the acryl-modified polyorganosiloxane having a radical reactivity are dispersed in a radical polymerizable monomer.

The fourth aspect of the present invention is the photoconductor according to the first aspect, wherein the acryl-modified polyorganosiloxane having a radical reactivity is a compound produced by grafting an acrylic monomer to a silicone main chain.

The fifth aspect of the present invention is the photoconductor according to the first aspect, wherein the acryl-modified polyorganosiloxane having an amine structure is a compound produced by grafting an acrylic monomer to a silicone main chain.

The sixth aspect of the present invention is the photoconductor according to the first aspect, wherein the amine structure is at least one selected from the group consisting of a secondary amine group and a tertiary amine group.

The seventh aspect of the present invention is the photoconductor according to the first aspect, wherein the amine structure is derived from at least one selected from the group consisting of a monomer having a hexahydrophthalimide structure represented by the following formula; a monomer having any one of the amide structures, such as the N-(1,1-dimethyl-3-oxobutyl) acrylamide structure, the (meth)acryl amide structure and the N,N-dimethylacrylamide structure which are represented by the following formulas; and a monomer having an amine structure of the N,N-dimethylaminoethyl (meth)acrylates represented by the following formulas.

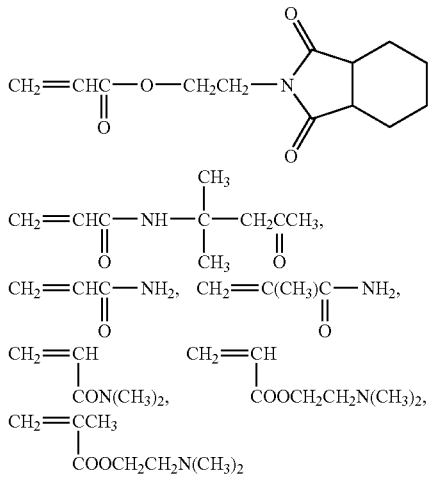

The eighth aspect of the present invention is the photoconductor according to the first aspect, wherein all of or a part of the radical polymerizable monomers are at least a monomer having three or more functionalities and no charge transport units.

The ninth aspect of the present invention is the photoconductor according to the eighth aspect, wherein the ratio of the molecular mass to the number of the functional group (molecular mass/number of functional group) is 250 or less in the radical polymerizable monomer having three or more functionalities and no charge transport units.

The tenth aspect of the present invention is the photoconductor according to the first aspect, wherein a radical polymerizable group in the radical polymerizable monomer is one selected from the group consisting of an acryloyloxy group, a methacryloyloxy group, a vinyl group and a mixture thereof.

The eleventh aspect of the present invention is the photoconductor according to the eighth aspect, wherein a radical polymerizable monomer having a charge transport units is used, in addition to the radical polymerizable monomer.

The twelfth aspect of the present invention is the photoconductor according to the eleventh aspect, wherein the radical polymerizable monomer having a charge transport units has one functionality.

The thirteenth aspect of the present invention is the photoconductor according to the eleventh aspect, wherein the radical polymerizable group in the radical polymerizable monomer having a charge transport units is one selected from the group consisting of an acryloyloxy group, a methacryloyloxy group, a vinyl group and a mixture thereof.

The fourteenth aspect of the present invention is the photoconductor according to the eleventh aspect, wherein the charge transport units in the radical polymerizable monomer having a charge transport units is a triarylamine structure.

The fifteenth aspect of the present invention is the photoconductor according to the eleventh aspect, wherein the radical polymerizable monomer having a charge transport units is at least one selected from the group consisting of the monomers represented by the following formulas (5) and (6):

Formula (5)

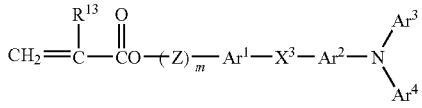

Formula (6)

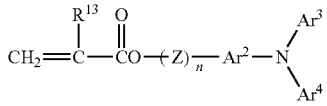

wherein $R^{13}$ represents a hydrogen atom, halogen atom, alkyl group which may be substituted, aralkyl group which may be substituted, aryl group which may be substituted, cyano group, nitro group, alkoxy group, —$COOR^{14}$ ($R^{14}$ represents a hydrogen atom, alkyl group which may be substituted, aralkyl group which may be substituted, or aryl group which may be substituted), halogenated carbonyl group, or $CONR^{15}R^{16}$ ($R^{15}$ and $R^{16}$ each represents a hydrogen atom, halogen atom, alkyl group which may be substituted, aralkyl group which may be substituted, or aryl group which may be substituted, $R^{15}$ and $R^{16}$ may be identical or different); $Ar^1$ and $Ar^2$ each represents a substituted or unsubstituted arylene group which may be identical or different; $Ar^3$ and $Ar^4$ each represents a substituted or unsubstituted aryl group which may be identical or different; X represents a single bond, alkylene group, cycloalkylene group, alkylene ether group, oxygen atom, sulfur atom, or vinylene group; Z represents an alkylene group, alkylene ether group, aralkylene group, or alkyleneoxycarbonyl group; "m" and "n" each represents an integer of 0 to 3.

The sixteenth aspect of the present invention is the photoconductor according to the fifteenth aspect, wherein the radical polymerizable monomer having a charge transport units is at least one selected from the group consisting of the monomers represented by the following formula (7):

Formula (7)

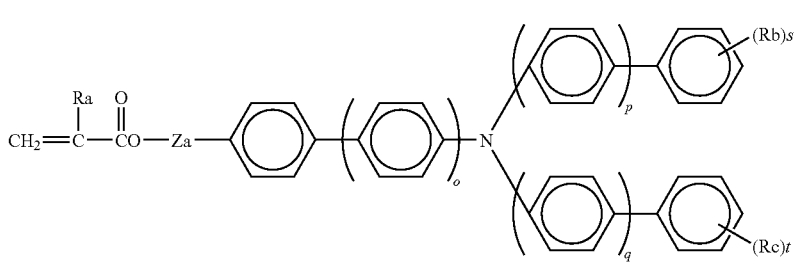

wherein "o", "p", and "q" each represents an integer of 0 or 1, Ra represents a hydrogen atom or methyl group, Rb and Rc each represent a $C_1$ to $C_6$ alkyl group and may be different when they are two or more, "s" and "t" each represents an integer of 0 to 3 and Za represents a single bond, methylene group, ethylene group, or group expressed by the following formulas:

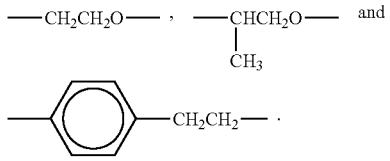

The seventeenth aspect of the present invention is the photoconductor according to the first aspect, wherein the acryl-modified polyorganosiloxane compound is dispersed in the form of particles.

The eighteenth aspect of the present invention is the photoconductor according to the first aspect, wherein the curing the crosslinked layer is performed by one of a heating and a light energy irradiating.

The nineteenth aspect of the present invention is the photoconductor according to the first aspect, wherein the photosensitive layer has a laminated layer structure in which a charge generating layer, a charge transport layer and the crosslinked layer are disposed on the support in this order.

The twentieth aspect of the present invention is an image forming process comprising: charging a photoconductor, exposing the photoconductor charged by the charging for forming an electrostatic latent image, developing the electrostatic latent image using a toner for visualizing the electrostatic latent image and forming a toner image, and transferring the toner image formed by the developing to a transferring medium, wherein the photoconductor is a photoconductor comprising: a photosensitive layer disposed on a support, wherein the photosensitive layer comprises a crosslinked layer and the crosslinked layer is produced by curing a dispersion in which at least one of an acryl-modified polyorganosiloxane having a radical reactivity and an acryl-modified polyorganosiloxane having an amine structure is dispersed in a radical polymerizable monomer.

The twenty-first aspect of the present invention is an image forming apparatus comprising: a photoconductor, a charging unit configured to charge the photoconductor, an exposing unit configured to expose the photoconductor charged by the charging unit for forming an electrostatic latent image, a developing unit configured to develop the electrostatic latent image using a toner for visualizing the electrostatic latent image and forming a toner image, and a transferring unit configured to transfer the toner image formed by the developing unit to a transferring medium, wherein the photoconductor comprising: a photosensitive layer disposed on a support, wherein the photosensitive layer comprises a crosslinked layer and the crosslinked layer is produced by curing a dispersion in which at least one of an acryl-modified polyorganosiloxane having a radical reactivity and an acryl-modified polyorganosiloxane having an amine structure is dispersed in a radical polymerizable monomer.

The twenty-second aspect of the present invention is a process cartridge comprising: a photoconductor, and at least one selected from the group consisting of a charging unit configured to charge the photoconductor, a developing unit configured to develop an electrostatic latent image using a toner for visualizing the electrostatic latent image and forming a toner image, a transferring unit configured to transfer the toner image formed by the developing unit to a transferring medium, a cleaning unit configured to clean the toner remained on the photoconductor after transferring the toner image by the transferring unit, and a destaticizing unit configured to remove the electrostatic latent image on the photoconductor after transferring the toner image by the transferring unit, wherein the process cartridge is an integrated unit of the photoconductor and at least one selected from the group consisting of the charging unit, the developing unit, the transferring unit, the cleaning unit and the destaticizing unit and is attached to an image forming apparatus in an attachable and detachable manner; and the photoconductor is a photoconductor comprising: a photosensitive layer disposed on a support, wherein the photosensitive layer comprises a crosslinked layer and the crosslinked layer is produced by curing a dispersion in which at least one of an acryl-modified polyoraganosiloxane having a radical reactivity and an acryl-modified polyoraganosiloxane having an amine structure is dispersed in a radical polymerizable monomer.

With respect to the first and second aspects above for the photoconductor, as noted above in the section of Description of the Related Art, when a conventional acryl-modified polyorganosiloxane is incorporated as a lubricant in an acrylic curable resin of the composition of the surface layer of the photoconductor, the crosslinking reaction itself is not progressed and such a lubricant was not usable. Thus, it was considered another acryl-modified polyorganosiloxane having a new radical reactivity to prevent the suppressing effect of the crosslinking reaction by imparting a radical reactivity to the acryl-modified polyorganosiloxane, and to compatibilize the high wear resistance of the photoconductor and the persistence of the low surface energy of the photoconductor by integrating the acryl-modified polysiloxane with a cross linkable resin through a chemical bond. As a result of the study, it was found that according to the first aspect above for the photoconductor, a photoconductor in which the crosslinked layer can be disposed without the hinderance of the crosslinking reaction during the production of the photoconductor, and the low surface energy and the wear resistance can be compatibilized can be obtained.

Among the first to third aspects above, with respect to an aspect in which an acryl-modified polyorganosiloxane having an amine structure is incorporated in the composition of the crosslinked layer, as noted above in the section of Description of the Related Art, when the acryl-modified polyorganosiloxane is incorporated as a lubricant in the composition of the surface layer of the photoconductor, since the acryl-modified polyorganosiloxane has compatibility with a binder resin, it can be uniformly dispersed in the surface layer and the persistence of the low surface energy of the photoconductor can be obtained, however, the acryl-modified polyorganosiloxane has no structure accelerating the crosslinking reaction, the strength of the surface layer is lowered, so that the photoconductor is easily weared. By incorporating the acryl-modified polyorganosiloxane having an amine structure or acryl-modified polyorganosiloxane having a radical reactivity according to the present invention in the composition of the crosslinked layer, the reducing of an oxygen consuming the radical functions in the crosslinking reaction and accordingly, the crosslinking rate can be elevated, so that before the phase separation between the acryl-modified polyorganosiloxane and the binder resin is caused, a solid crosslinked film in which the acryl-modified polyorganosiloxane is dispersed uniformly in the size of the primary particles can be formed. The thus obtained crosslinked layer has persistence of the low surface energy and the wear resistance of the obtained crosslinked layer is not lowered. In other word, a photoconductor in which the low surface energy and the wear resistance can be compatibilized can be obtained.

According to the fourth and fifth aspects above for the photoconductor, since the acryl-modified polyorganosiloxane according to the present invention not only exhibits sliding properties and the function of lowering the surface energy by the siloxane linkage, but also has the compatibility with a binder resin by a part of the acryl-modified polyorganosiloxane to which a moiety of an acrylic resin is grafted, the acryl-modified polyorganosiloxane has a small side effect to the electrophotography properties of the photoconductor and a satisfactory amount thereof can be incorporated in the crosslinked film as the crosslinked layer. Thus, the incorporation of the acryl-modified polyorganosiloxane in the composition of the crosslinked layer improves the persistence of the low surface energy of the photoconductor and has an effect for the cleaning properties of the photoconductor.

According to the sixth and seventh aspects above for the photoconductor, the crosslinking reaction can be more effectively accelerated and the acryl-modified polyoragnosiloxane can be uniformly dispersed in the crosslinked film, so that a solid crosslinked layer of the photoconductor can be obtained.

According to the eighth aspect above for the photoconductor, while an acryl-modified polyorganosiloxane having a radical reactivity or acryl-modified polyorganosiloxane having an amine structure according to the present invention has a small mechanical strength, by using, as a monomer for the crosslinking, a monomer having three or more functionalities, the lowering of the wear resistance of the photoconductor can be prevented.

According to the ninth aspect above for the photoconductor, by controlling the molecular weight per one functionality of the monomer having three functionalities to 250 or less, a photoconductor in which a crosslinked layer has a high crosslinkage density and is an uniform film and which is excellent in the surface smoothness can be provided.

According to the tenth aspect above for the photoconductor, for producing an uniform film, a high crosslinking rate is required and the above-noted radical polymerizable group is suitable for this requirement.

According to the eleventh and twelfth aspects above for the photoconductor, by incorporating a radical polymerizable monomer having a charge transport units in the composition of the crosslinked layer, the charge trap in the crosslinked layer becomes smaller, so that the wear resistance and electrical properties of the photoconductor can be compatibilized. Even when the thickness of the crosslinked layer becomes larger, the electrical properties of the photoconductor is not changed, thus there is an allowance for designing the life of the photoconductor depending on the application.

According to the thirteenth aspect above for the photoconductor, for producing an uniform film, a high crosslinking rate is required and the above-noted radical polymerizable group is suitable for this requirement.

According to the fourteenth, fifteenth and sixteenth aspects above for the photoconductor, further advantageous electrical properties (e.g., sensitivity and residual potential) of the photoconductor can be advantageously maintained.

According to the seventeenth aspect above for the photoconductor, the acryl-modified polyorganosiloxane not only exhibits sliding properties and the function of lowering the surface energy by the siloxane linkage, but also has the compatibility with a binder resin by a part of the acryl-modified polyorganosiloxane to which a moiety of an acrylic resin is grafted. However, it is considered that for improving the sliding properties of the photoconductor, a film in which the siloxane linkage is present ununiformly and partially in a high density is more advantageous than a film in which the siloxane linkage is present uniformly in a low density, when the total density of the siloxane linkage in the crosslinked film is constant and examples of the method therefor include a method in which the compatibility between the acryl-modified polyorganosiloxane and the binder resin can be controlled by the composition ratio therebetween, and a method in which the acryl-modified polyorganosiloxane compound can be dispersed in the form of particles by further subjecting the composition of the crosslinked layer to a dispersing treatment. According to the seventeenth aspect above for the photoconductor, by disposing the crosslinked layer as the above-noted dispersion film, even when the amount of the acryl-modified polyorganosiloxane is relatively small, the sliding properties and cleaning properties of the photoconductor can be advantageously obtained.

According to the eighteenth aspect above for the photoconductor, as a curing method of the crosslinked layer, a heating method and a light energy irradiating method are employable.

According to the nineteenth aspect above for the photoconductor, a photosensitive layer is disposed as a photosensitive layer in which two functions of the photosensitive layer are divided into two layers of the photosensitive layer.

The image forming process, image forming apparatus and process cartridge according to the twentieth, twenty-first and twenty-second aspects above respectively can exhibit the above-noted excellent effect of the action according to the present invention by using any one of photoconductors according to the first to nineteenth aspects above.

According to the present invention, by disposing in at least a surface of the photosensitive layer of the photoconductor a crosslinked layer produced by curing a dispersion in which an acryl-modified polyorganosiloxane having a radical reactivity, an amine structure or both of a radical reactivity and an amine structure is dispersed in a radical polymerizable monomer, wherein the radical polymerizable monomer is preferably a radical polymerizable monomer having three or more functionalities and no charge transport units, more preferably a mixture of a radical polymerizable monomer having three or more functionalities and no charge transport units and a radical polymerizable monomer having a charge transport units, a photoconductor having high durability and high performance, which is excellent in cleaning properties and high wear resistance and advantageous electrical properties, and by which the low surface energy of the photoconductor is maintained for a long term, can be obtained. Therefore, by using the above-noted photoconductor, an image forming process, image forming apparatus and process cartridge for the image forming apparatus having high performance and high reliability, which can provide an advantageous image for a long term can be provided.

DESCRIPTION OF THE PREFERRED EMBODIMENTS

Figure 1A:
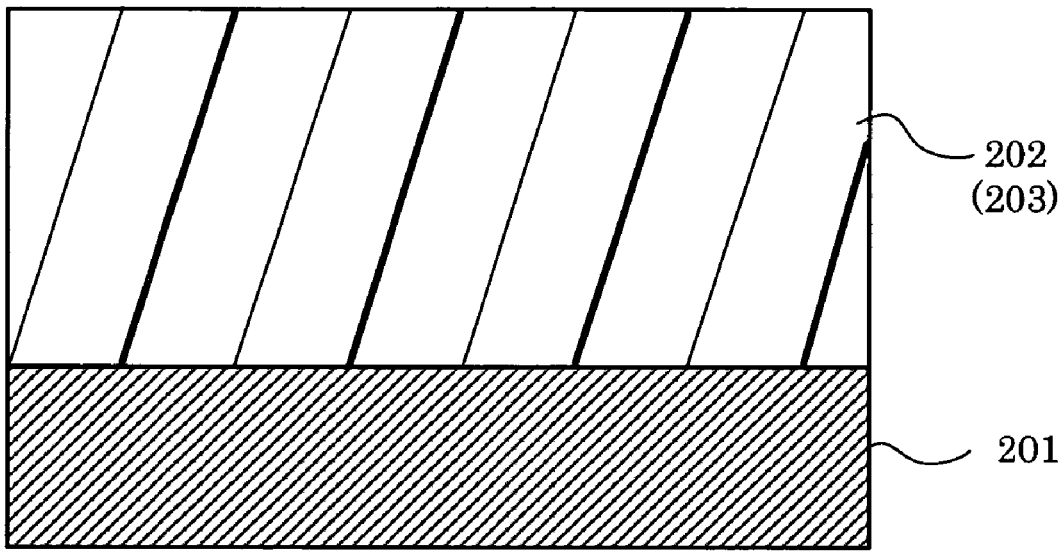
FIG. 1A is a sectional view schematically showing an example of the photoconductor according to the present invention, which comprises the photosensitive layer 202 and the support 201.

Hereinafter, the present invention is described in detail.

According to the present invention, by producing a photoconductor comprising a photosensitive layer disposed on an support, wherein the photosensitive layer comprises at least a crosslinked layer and the crosslinked layer is produced by curing a dispersion in which at least one of an acryl-modified polyorganosiloxane having a radical reactivity and an acryl-modified polyorganosiloxane having an amine structure is dispersed in a radical polymerizable monomer, a photoconductor which is excellent in cleaning properties, is stable and has high wear resistance, and which can maintain an image having high quality for a long term, can be obtained.

The cause of the above-noted advantages is as follows.

By incorporating a copolymer comprising mainly a polyorganosiloxane having a radical reactivity, an amine structure, or both a radical reactivity and an amine structure in the composition of the crosslinked layer, a contaminant, such as a discharge product, a toner external additive and paper particles can be easily removed from the surface of the photoconductor, needless to say because the surface energy of the photoconductor is lowered and the releasing properties of the photoconductor is improved. Further, since the above-noted polyorganosiloxane copolymer has a radical reactivity or an amine structure which is effective for accelerating the crosslinking reaction, the polyorganosiloxane copolymer is subjected to the crosslinking reaction with a radical polymerizable monomer or accelerates the crosslinking reaction of the radical polymerizable monomer, so that not only the cohesion of the polyorganosiloxane copolymer is remarkably lowered in the obtained crosslinked film, but also the dispersion properties and persistence of low friction of the polyorganosiloxane copolymer are largely improved, thereby obtaining the extreme improvement of the surface smoothness of the photoconductor and the compatibility between the wear resistance and low surface energy of the photoconductor. On the other hand, an acryl-modified polyorganosiloxane having neither radical reactivity nor amine structure easily hinders the crosslinking reaction of the radical polymerizable monomer and accompanying with the progression of the crosslinking reaction, the cohesion of the acryl-modified polyorganosiloxane becomes extreme, so that a smooth and solid surface layer cannot be obtained.

Further, the above-noted acryl-modified polyorganosiloxane is produced by graft-copolymerizing a siloxane monomer as a main chain and an acrylic resin monomer as a side chain and by enhancing the compatibility of the acryl-modified polyorganosiloxane with a resin used for the crosslinking, a crosslinked layer having advantageous stability and higher persistence of the low surface energy can be provided.

Further, in the photoconductor according to the present invention, the crosslinked layer is produced using a radical polymerizable monomer and, accordingly, a three-dimensional network is developed in the crosslinked layer and a crosslinked layer having a high hardness in which a degree of the crosslinking is extremely high, so that a photoconductor having high wear resistance can be obtained. The radical polymerizable monomer to be used is not restricted. However, from the viewpoint of producing a solid three-dimensional network, a radical polymerizable monomer having three or more functionalities is preferred. It is preferred that all of or a part of the radical polymerizable monomers are at least a radical polymerizable monomer having three or more functionalities and no charge transport units. The using of a monomer having a charge transport units in the combination with the above-noted radical polymerizable monomer is effective for a high-quality image.

As the result of using a monomer having a charge transport units in the combination with the radical polymerizable monomer, the photoconductor exhibits such an effect that a contaminant attaching to the surface of the photoconductor, such as a discharge product, a toner external additive and paper particles attaches difficultly thereto or can be easily removed when the contaminator has attached thereto and by enhancing largely the stability of the above-noted effect, not only the suppressing of the image blur, but also the improving of the transferring efficiency and cleaning properties of the photoconductor, the suppressing of an abnormal image due to the filming or contaminant attaching and the improving of the wear resistance of the photoconductor can be obtained and the using of a monomer having a charge transport units in the combination with the radical polymerizable monomer has various effects for enhancing the durability and image quality of the photoconductor.

Next, with respect to the composition of the coating liquid used for disposing the crosslinked layer according to the present invention, explanations are given.

First, with respect to the acryl-modified polyorganosiloxane having a radical reactivity, an amine structure or both a radical reactivity and an amine structure, explanations are given.

These acryl-modified polyorganosiloxanes are produced by subjecting, for example a polyorganosiloxane represented by the following Formula (1):

Formula (1)

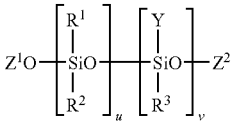

wherein $R^1$, $R^2$ and $R^3$ may be the same as or different from each other, and represent a $C_1$ to $C_{20}$ hydrocarbon group or halogenated hydrocarbon group; Y represents an organic group having a radical reactive group, a SH group, or both a radical reactive group and a SH group; u is a positive integer of 10,000 or less and v is an integer of 1 or more; and $Z^1$ and $Z^2$ may be the same as or different from each other, and represent a hydrogen atom, a lower alkyl group or a triorganosilyl group represented by the following formula:

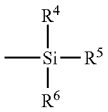

wherein $R^4$ and $R^5$ may be the same as or different from each other, and represent a $C_1$ to $C_{20}$ hydrocarbon group or a halogenated hydrocarbon group; and $R^6$ represents a $C_1$ to $C_{20}$ hydrocarbon group, a halogenated hydrocarbon group or an organic group having a radical reactive group, a SH group, or both a radical reactive group and a SH group, and preferably a (meth) acrylate ester represented by the following Formula (2):

Formula (2)

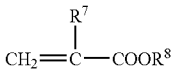

wherein $R^7$ represents a hydrogen atom or a methyl group; and $R^8$ represents an alkyl group, an alkyl group substituted by an alkoxy group, a cycloalkyl group and an aryl group, and optionally a copolymerizable monomer to a graft polymerization according to an emulsion polymerization.

In a polyorganosiloxane represented by Formula (1), $R^1$, $R^2$ and $R^3$ may be the same as or different from each other, and represent individually a $C_1$ to $C_{20}$ hydrocarbon group, such as an alkyl group (e.g., a methyl group, an ethyl group, a propyl group and a butyl group) and an aryl group (e.g., a phenyl group, a tolyl group, a xylyl group and a naphthyl group) or a $C_1$ to $C_{20}$ halogenated hydrocarbon group produced by substituting at least one of hydrogen atoms which are bonded to a carbon atom of the above-noted $C_1$ to $C_{20}$ hydrocarbon group by a halogen atom. Y represents an organic group having a radical reactive group (e.g., a vinyl group, an allyl group, a γ-acryloxypropyl group, a γ-methacryloxypropyl group and γ-mercaptopropyl group), a SH group or both a radical reactive group and a SH group. $Z_1$ and $Z_2$ represent individually a hydrogen atom; a lower alkyl group, such as a methyl group, an ethyl group, a propyl group and a butyl group; or a triorganosilyl group represented by the above-noted formula, and in the triorganosilyl group, $R^4$ and $R^5$ may be the same as or different from each other, and represent a $C_1$ to $C_{20}$ hydrocarbon group or halogenated hydrocarbon group; and $R^6$ represents a $C_1$ to $C_{20}$ hydrocarbon group, a halogenated hydrocarbon group or an organic group having a radical reactive group, a SH group, or both a radical reactive group and a SH group. Examples of a $C_1$ to $C_{20}$ hydrocarbon group or halogenated hydrocarbon group or an organic group having a radical reactive group, a SH group or both a radical reactive group and a SH group include individually the above-exemplified groups. $Z^1$ and $Z^2$ may be the same as or different from each other. Further, u is a positive integer of 10,000 or less, preferably of 500 to 8,000 and v is an integer of 1 or more, preferably of 1 to 500.

A polyorganosiloxane represented by Formula (1) can be produced by subjecting such compounds to a reaction as a cyclic polyorganosiloxane; a liquid polydimethylsiloxane in which the both terminals of the molecular chain are blocked by a hydroxyl group; a liquid polydimethylsiloxane in which the both terminals of the molecular chain are blocked by a hydroxyl group; a liquid polydimethylsiloxane in which the both terminals of the molecular chain are blocked by an alkoxy group; a liquid polydimethylsiloxane in which the both terminals of the molecular chain are blocked by a trimethylsilyl group; silanes or a hydrolysis product of silanes used for introducing a radical reactive group, a SH group or both a radical reactive group and a SH group to the polyorganosiloxane; and if desired a trialkoxysilane having three functionalities or a hydrolysis product thereof in an amount which does not impair the object of the present invention.

Next, with respect to other examples of the producing method of a polyorganosiloxane represented by Formula (1), explanations are given. The first method is a method in which by subjecting as a raw material, a cyclic siloxane having a low molecular weight, such as the above-noted octamethylcyclotetrasiloxane; and a dialkoxysilane compound having a radical reactive group, a SH group or both a radical reactive group and a SH group, or a hydrolysis product thereof to a polymerization reaction in the presence of a strong alkali or strong acid catalyst, a polymeric polyorganosiloxane is obtained. The obtained polymeric polyorganosiloxane is subjected to an emulsion graft copolymerization as the next step, to a treatment of emulsifying-dispersing in an aqueous medium in the presence of a proper emulsifying agent.

Next, the second method is a method in which as a raw material, the above-noted polyorganosiloxane having a low molecular weight and a dialkoxysilane having a radical reactive group, a SH group or both a radical reactive group and a SH group are subjected to an emulsion polymerization in an aqueous medium in the presence of a sulfonic acid surfactant or a sulfurate ester surfactant. Here, as another method for the emulsion polymerization, a method may comprise emulsifying-dispersing a similar raw material to the above-noted raw materials in an aqueous medium in the presence of a cationic surfactant, such as an alkyltrimethylammonium chloride and an alkylbenzylammonium chloride, thereby obtaining a dispersion; and subjecting the above-obtained dispersion to a polymerization in the presence of a proper amount of a strong alkali compound, such as potassium hydroxide and sodium hydroxide.

When the thus obtained polyorganosiloxane represented by Formula (1) has a small molecular weight, the effect of imparting persisting sliding-properties and wear resistance to a molded article produced by molding the resin composition of the acryl-modified polyorganosiloxane is impaired, thus it is preferred that the molecular weight of the polyoragnosiloxane is as large as possible. Therefore, in the first method, it is necessary that a polymeric polyorganosiloxane is produced by the polymerization and the produced polyorganosiloxane is subjected to emulsifying-dispersing in an aqueous medium. In the second method, when the temperature for an aging treatment to which the polyorganosiloxane produced according to the emulsion polymerization is low, the molecular weight of the polyorganosiloxane becomes large, so that it is advantageous that the temperature for the aging treatment is 30° C. or lower, preferably 15° C. or lower.

According to the present invention, examples of a (meth) acrylate ester (wherein "(meth)acrylate ester" means "acrylate ester or methacrylate ester") represented by Formula (2) which is subjected together with a polyorganosiloxane represented by Formula (1) to the graft polymerization include an alkyl (meth)acrylate, such as methyl (meth)acrylate, ethyl (meth)acrylate, propyl (meth)acrylate, butyl (meth)acrylate, isobutyl (meth)acrylate, penthyl (meth)acrylate, hexyl (meth) acrylate, octyl (meth)acrylate, 2-ethylhexyl (meth)acrylate, lauryl (meth)acrylate and stearyl (meth)acrylate; an alkoxyalkyl (meth)acrylate, such as methoxyethyl (meth)acrylate and butoxyethyl (metha)acrylate; cyclohexyl (meth)acrylate; phenyl (meth)acrylate; and benzyl (meth)acrylate. These (meth)acrylate esters may be used individually or in combination.

Examples of the above-noted copolymerizable monomer which is optionally subjected together with the (meth)acrylate ester to the graft polymerization include a multifunctional monomer, an unsaturated monomer having various functional groups and an ethylenic unsaturated monomer. Specific examples of the copolymerizable monomer include a multifunctional monomer having plural unsaturated groups, such as 1,3,5,7-tetramethyl-3,5,7-trivinylcyclotetrasiloxypropylmethacrylate, tris (2-acryloyloxyethyl) isocyanurate, trimethylolpropanetriacrylate, pentaerythritol triacrylate, pentaerythritol tetraacrylate, dipentaerythritol hexaacrylate and ditrimethylolpropane tetraacrylate; an unsaturated monomer having an oxysilane group, such as glycidyl (meth) acrylate and glycidyl allyl ether; an unsaturated monomer having a hydroxyl group, such as 2-hydroxyethyl (meth)acrylate and 2-hydroxypropyl (meth)acrylate; an ethylenic unsaturated monomer having a carboxyl group, such as (meth) acrylic acid, maleic anhydride, crotonic acid and itaconic acid; an unsaturated monomer having a polyalkylene oxide group, such as an ethylene oxide or propylene oxide adduct of (meth)acrylic acid; a complete ester of a polyalcohol and (meth)acrylic acid, such as ethyleneglycol di(meth)acrylate, diethyleneglycol (meth)acrylate and trimethylolpropane tri (meth)acrylate; an ethylenic unsaturated amide or an alkylol or alkoxyalkylated product of an ethylenic unsaturated amide, such as (meth)acrylamide, diacetone (meth)acrylamide, N-(1,1-dimethyl-3-oxobutyl) (meth)acrylamide, N,N-dimethylacryl (meth)acrylamide, N-methylol (meth)acrylamide, N-butoxymethyl (meth)acrylamide and N-methoxymethyl (meth)acrylamide; an amino group, such as N,N-dimethylaminoethyl (meth)acrylate and N,N-diethylaminoethyl (meth)acrylate; and an unsaturated monomer having an imide group, such as (meth)acryloyloxyethylhexahydrophthalimide. These unsaturated monomers may be used individually or in combination. Particularly, the incorporating of the amine is effective for accelerating the curing rate, since when the crosslinked layer is disposed by the curing, the amine has the function of reducing the oxygen which consumes a generated radical. Among them, a secondary or tertiary amine exhibits most remarkably such an effect. Particularly, hexahydrophthalimide is excellent in accelerating the crosslinking reaction. These multifunctional monomers have the effect of imparting flexibility, durability and heat resistance to the crosslinked layer by taking part in the crosslinking reaction of the acryl-modified polyorganosiloxane.

Examples of the ethylenic unsaturated monomer include styrene, α-methylstyrene, vinyltoluene, acrylonitrile, vinyl chloride, vinylidene chloride, vinyl acetate, vinyl propionate and vinyl ester of versatic acid. These monomers may be used individually or in combination. At least one of these ethylenic unsaturated monomers and at least one of the above-noted functional monomers may be used in combination.

The amount of the copolymerizable monomer which is used if desired is preferably 0.1% by mass to 30% by mass, based on the total mass of the copolymerizable monomer and the (meth)acrylate ester represented by Formula (2). When the amount of the copolymerizable monomer is more than 30% by mass, the miscibility between an obtained acryl-modified polyorganosiloxane and a binder resin is lowered. On the other hand, when the amount of the copolymerizable monomer is less than 0.1% by mass, flexibility, durability and heat resistance cannot be imparted to the crosslinked layer.

Further, for imparting excellent sliding properties and wear resistance to the crosslinked layer, a polymerized product of the monomer for the graft copolymerization which is represented by Formula (2) has a glass transition temperature of preferably 20° C. or higher, more preferably 30° C. or higher.

The acryl-modified polyorganosiloxane according to the present invention is produced by subjecting a polyorganosiloxane represented by Formula (1) and a monomer represented by Formula (2) in an amount mass ratio (the mass of the polyorganosiloxane:the mass of the monomer) of 5:95 to 95:5 to a graft copolymerization according to an emulsion polymerization. When the amount of the polyorganosiloxane represented by Formula (1) is less than the above-noted range, an obtained acryl-modified polyorganosiloxane cannot exhibit satisfactorily the effect which the polyorganosiloxane has originally and an adhesion feeling which is a disadvantage of an acrylic polymer is caused. On the other hand, when the amount is more than the above-noted range, the miscibility between the acryl-modified polyorganosiloxane and the resin for the crosslinking is lowered and the acryl-modified polyorganosiloxane is easily blended on the surface of the crosslinked film, so that there is such a tendency that the sliding properties and wear resistance of the crosslinked layer is easily lowered with time.

The emulsion graft copolymerization of a component represented by Formula (1) with a component represented by Formula (2) can be performed using an aqueous emulsion of a polyorganosiloxane as a component represented by Formula (1) and an usual radical polymerization initiator according to a conventional emulsion polymerization.

The acryl-modified polyorganosiloxane can be obtained according either a method comprising separating out the acryl-modified polyorganosiloxane by introducing a salting-out agent into an emulsion obtained according to the emulsion polymerization, washing with water and drying or a method of drying by spraying using a spray drier, and can be obtained as particles having an average particle diameter of 10 μm to 500 μm. In the present invention, these particles are further pulverized by dissolving and/or dispersing the above-noted, so that the particles of the obtained acryl-modified polyorganosiloxane are used as a dispersion in the form of particles having an average particle diameter of preferably 0.01 μm to 5 μm, more preferably 0.05 μm to 0.5 μm.

Further, with respect to the acryl-modified polyorganosiloxane according to the present invention, the remaining of a contaminant, such as an emulsifying agent and a flocculating agent in the produced acryl-modified polyorganosiloxane has the danger of impairing the electrical properties of the photoconductor in which the electrical properties are important, so that it is preferred that the acryl-modified polyorganosiloxane is used optionally after it is purified. Examples of the purifying method include a method of subjecting the acryl-modified polyorganosiloxane to a stirring and washing treatment using an acid, an aqueous solution of an alkali, water and an alcohol; and a solid-liquid extraction method using a Soxhlet extracting apparatus.

The components of the coating liquid for crosslinked layers will be explained in the following that are available for the present invention.

The radical polymerizable monomers having three or more functionalities and no charge transport units refers to monomers that contain no hole transport structure such as triarylamine, hydrazone, pyrazoline, carbazole and contain no electron transport structure such as fused polycyclic quinone, diphenoquinone, or electron pulling aromatic rings having cyano group or nitro group, instead have three or more radical polymerizable functional groups. The radical polymerizable functional group may be one including at least one carbon-carbon double bond and being radically polymerizable. Examples of the radical polymerizable functional group include 1-substituted ethylene functional groups and 1,1-substituted ethylene functional groups.

(1) Examples of the 1-substituted ethylene functional groups include functional groups represented by the following Formula (3):

$$CH_2{=}CH{-}X^1{-} \qquad \text{Formula (3)}$$

wherein $X^1$ represents an arylene group such as phenylene group, naphthylene group and the like, which may be substituted, an alkenylene group which may be substituted, —CO— group, —COO— group, —CON($R^9$)— group ($R^9$ represents a hydrogen atom, alkyl group such as methyl group and ethyl group, aralkyl group such as benzyl group, naphthylmethyl group and phenethyl group, aryl group such as phenyl group and naphthyl group), or —S— group.

Specific examples of the substituents include vinyl group, styryl group, 2-methyl-1,3-butadienyl group, vinyl carbonyl group, acryloyloxy group, acryloylamino group and vinyl thioether group.

(2) Examples of the 1,1-substituted ethylene functional groups include those represented by the following formula:

$$CH_2{=}C(Y^1){-}X^2{-} \qquad \text{Formula (4)}$$

wherein $Y^1$ represents an alkyl group which may be substituted, aralkyl group which may be substituted, aryl group such as phenyl group, naphthyl group which may be substituted, halogen atom, cyano group, nitro group, alkoxy group such as methoxy group and ethoxy group, —$COOR^{10}$ group ($R^{10}$ represents a hydrogen atom, alkyl group such as methyl group and ethyl group which may be substituted, aralkyl group such as benzyl and phenethyl groups which may be substituted, aryl groups such as phenyl group and naphthyl group which may be substituted), or —$CONR^{11}R^{12}$ ($R^{11}$ and $R^{12}$ represent a hydrogen atom, alkyl groups such as methyl group and ethyl group which may be substituted, aralkyl group such as benzyl group, naphthylmethyl group, and phenethyl group which may be substituted, aryl group such as phenyl group and naphthyl group which may be substituted, these may be identical or different), $X^2$ represents a substituent as defined for $X^1$ of Formula (3) and a single bond, an alkylene group, provided that at least any one of $Y^1$ and $X^2$ is an oxycarbonyl group, cyano group, alkenylene group, and aromatic ring).

Specific examples of these substituents include alpha-chloro acryloyloxy group, methacryloyloxy group, alpha-cyanoethylene group, alpha-cyanoacryloyloxy group, alpha-cyanophenylene group, methacryloylamino group.

Examples of the substituent which is additionally substituted to the substituents of $X^1$, $X^2$ and $Y^1$ include a halogen atom; a nitro group; a cyano group; an alkyl group, such as a methyl group and an ethyl group; an alkoxy group, such as a methoxy group and an ethoxy group; an aryloxy group, such as a phenoxy group; an aryl group, such as a phenyl group and a naphthyl group; and an aralkyl group, such as a benzyl group and a phenethyl group.

Among these radical polymerizable functional groups, acryloyloxy group, methacryloyloxy group and vinyl group are particularly useful. Compounds having three or more of acryloyloxy groups may be prepared, for example, by esterification or transesterification of compounds having three or more hydroxy groups in the molecule with acrylic acid or salt, acrylic acid halide, acrylic acid ester. Also, compounds having three or more methacryloyloxy groups may be similarly prepared. The radical polymerizable functional groups in a monomer having three or more functionalities may be identical or different.

Specific examples of radical polymerizable monomers having three or more functionalities and no charge transport units are listed below, but not limited to.

The radical polymerizable monomers, available in the present invention, include trimethylolpropanetriacrylate (TMPTA), trimethylolpropanetrimethacrylate, HPA-modified trimethylolpropanetriacrylate, EO-modified trimethylolpropane triacrylate, PO-modified trimethylolpropane triacrylate, caprolactone-modified trimethylolpropane triacrylate, HPA-modified trimethylolpropane trimethacrylate, pentaerythritol triacrylate, pentaerythritol tetraacrylate (PETTA), glycerol triacrylate, ECH-modified glycerol triacrylate, EO-modified glycerol triacrylate, PO-modified glycerol triacrylate, tris(acryloxyethyl)isocyanurate, dipentaerythritol hexacrylate (DPHA), caprolactone-modified dipentaerythritol hexacrylate, dipentaerythritolhydroxy pentaacrylate, alkyl-modified dipentaerythritol pentaacrylate, alkyl-modified dipentaerythritol tetraacrylate, alkyl-modified dipentaerythritol triacrylate, dimethylolpropane tetraacrylate (DTMPTA), pentaerythritolethoxy tetraacrylate, EO-modified phosphonic acid triacrylate, 2,2,5,5,-tetrahydroxymethylcyclopentanone tetraacrylate and the like. These may be used alone or in combination.

In the radical polymerizable monomer having three or more functionalities and no charge transport units according to the present invention, for forming a dense crosslinkage in the crosslinked layer, a ratio of the molecular mass to the number of the functional group (molecular mass/number of functional group) is preferably 250 or less. When the ratio is more than 250, the crosslinked layer is soft and the wear resistance of the crosslinked layer is a little lowered, so that with respect to a monomer having a modifying group, such as HPA, EO and PO among the above-exemplified monomers, it is not preferred that a monomer having an extremely long modifying group is used individually. Further, the amount of the radical polymerizable monomer having three or more functionalities and no charge transport units which is used for disposing the crosslinked layer is preferably 20% by mass to 80% by mass, more preferably 30% by mass to 70% by mass, based on the total mass of the crosslinked layer. When the amount of the radical polymerizable monomer is less than 20% by mass, the three-dimensional crosslinkage density of the crosslinked layer is low, so that a rapid improvement of the wear resistance of the photoconductor cannot be obtained in comparison with the case where a conventional thermoplastic binder resin is used. On the other hand, when the amount of the radical polymerizable monomer is more than 80% by mass, the amount of the charge transport compound is lowered, so that the electrical properties of the photoconductor is impaired. Since required wear resistance and electrical properties of the photoconductor vary depending on the application of the photoconductor, it cannot be sweepingly mentioned that taking the balance between the above-noted two properties of the photoconductor into the consideration, the amount of the radical polymerizable monomer is most preferably 30% by mass to 70% by mass.

The radical polymerizable monomer having a charge transport units according to the present invention means a compound having not only one of an electron-hole transport structure, such as triarylamine, hydrazone, pyrazoline and carbazole; and an electron transport structure, such as a condensed polycyclic quinone group, a diphenoquinone group and an electron attractive aromatic ring having a cyano group or nitro group, but also one or more radical polymerizable functional group. Examples of the radical polymerizable functional group include groups exemplified in the above section of the radical polymerizable monomer. Among them, particularly an acryloyloxy group, methacryloyloxy group and vinyl group are preferred. As the charge transport units, the triarylamine structure has a high effect of the charge transporting and a compound having one functionality is preferred.

Further, when a compound represented by the following Formula (5) or (6) is used, the electrical properties of the photoconductor, such as sensitivity and residual potential can be particularly advantageously persisted.

Formula (5)

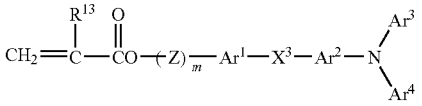

Formula (6)

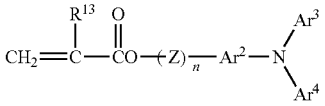

wherein $R^{13}$ represents a hydrogen atom, halogen atom, alkyl group which may be substituted, aralkyl group which may be substituted, aryl group which may be substituted, cyano group, nitro group, alkoxy group, —$COOR^{14}$ ($R^{14}$ represents a hydrogen atom, alkyl group which may be substituted, aralkyl group which may be substituted, or aryl group which may be substituted), halogenated carbonyl group, or $CONR^{15}R^{16}$ ($R^{15}$ and $R^{16}$ each represents a hydrogen atom, halogen atom, alkyl group which may be substituted, aralkyl group which may be substituted, or aryl group which may be substituted, $R^{15}$ and $R^{16}$ may be identical or different); $Ar^1$ and $Ar^2$ each represents a substituted or unsubstituted arylene group which may be identical or different; $Ar^3$ and $Ar^4$ each represents a substituted or unsubstituted aryl group which may be identical or different; X represents a single bond, alkylene group, cycloalkylene group, alkylene ether group, oxygen atom, sulfur atom, or vinylene group; Z represents an alkylene group, alkylene ether group, aralkylene group, or alkyleneoxycarbonyl group; "m" and "n" each represents an integer of 0 to 3.

More specifically, with respect to substituents of $R^{13}$ in the general Formulas (5) and (6), examples of the alkyl group include methyl group, ethyl group, propyl group, butyl group etc., examples of the aralkyl group include benzyl group, phenethyl group, naphthylmethyl group etc., examples of the aryl group include phenyl group, naphthyl group etc., examples of the alkoxy group include methoxy group, ethoxy group, propoxy group etc.; these groups may be substituted further by a halogen atom, nitro group, cyano group, alkyl group such as methyl group, ethyl group etc., alkoxy group such as methoxy group, ethoxy group and the like, aryloxy group such as phenoxy group and the like, aryl group such as phenyl group, naphthyl group and the like, aralkyl group such as benzyl group, phenethyl group and the like.

Particularly preferable substituents of $R^{13}$ are a hydrogen atom and methyl group.

$Ar^3$ and $Ar^4$ are each a substituted or unsubstituted aryl group; examples of the aryl group include fused polycyclic hydrocarbon groups, non-fused cyclic hydrocarbon groups, and heterocyclic groups.

The fused polycyclic hydrocarbon group is preferably one having 18 or less carbon atoms to form a ring, examples thereof include pentanyl group, indenyl group, naphthyl group, azulenyl group, heptaprenyl group, biphenylenyl group, as-indacenyl group, s-indacenyl group, fluorenyl group, acenaphthylenyl group, pleiadene adenyl group, acenaphthenyl group, phenalenyl group, phenanthryl group, anthryl group, fluorandenyl group, acephenanthrylenyl group, aceanthrylenyl group, triphenylenyl group, pyrenyl group, chrysene, and naphthacenyl group.

Examples of the non-fused hydrocarbon group include a monovalent group of monocyclic hydrocarbon compounds such as benzene, diphenyl ether, polyethylene diphenyl ether, diphenyl thioether and diphenyl sulphone, a monovalent group of non-fused polycyclic hydrocarbon compounds such as biphenyl, polyphenyl, diphenylalkane, diphenylalkene, diphenylalkyne, triphenylmethane, distyrylbenzene, 1,1-diphenylcycloalkane, polyphenylalkane and polyphenylalkene, or a monovalent group of cyclic hydrocarbon compounds such as 9,9-diphenylfluorene.

Examples of the heterocyclic group include a monovalent group of carbazole, dibenzofuran, dibenzothiphene, oxadiazole, and thiadiazole.

The aryl group represented by $Ar^3$ and $Ar^4$ may be substituted by the substituents described below.

(1) halogen atom, cyano group, nitro group and the like.

(2) alkyl group, preferably $C_1$ to $C_{12}$, particularly $C_1$ to $C_8$, more preferably $C_1$ to $C_4$ straight-chained or branched alkyl group, wherein the alkyl group may be further substituted by a fluorine atom, hydroxy group, cyano group, $C_1$ to $C_4$ alkoxy group, phenyl group, or phenyl group substituted by a halogen atom, $C_1$ to $C_4$ alkyl group or $C_1$ to $C_4$ alkoxy group. Specific examples thereof include methyl group, ethyl group, n-butyl group, i-propyl group, t-butyl group, s-butyl group, n-propyl group, tri-fluoromethyl group, 2-hydroxyethyl group, 2-ethoxyethyl group, 2-cyanoethyl group, 2-methoxyethyl group, benzyl group, 4-chlorobenzyl group, 4-methylbenzyl group, 4-phenylbenzyl group and the like.

(3) alkoxy group (—$OR^{17}$), wherein $R^{17}$ represents an alkyl group as described in (2). Specific examples thereof include methoxy group, ethoxy group, n-propoxy group, i-propoxy group, t-butoxy group, n-butoxy group, s-butoxy group, i-butoxy group, 2-hydroxyethoxy group, benzyloxy group, tri-fluoromethoxy group and the like.

(4) aryloxy group, wherein the aryl group may be phenyl group and naphthyl group, which may be substituted by $C_1$ to $C_4$ alkoxy group, $C_1$ to $C_4$ alkyl group, or halogen atom. Specific examples thereof include phenoxy group, 1-naphthyloxy group, 2-naphthyloxy group, 4-methoxyphenoxy group, 4-methylphenoxy group and the like.

(5) alkylmercapto group or arylmercapto group. Specific examples thereof include methylthio group, ethylthio group, phenylthio group, p-methylphenylthio group and the like.

(6) an amino group represented by the following formula:

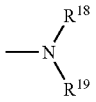

wherein $R^{18}$ and $R^{19}$ each represents independently a hydrogen atom, alkyl group as described in (2), or aryl group. Examples of the aryl group include phenyl group, biphenyl group, or naphthyl group which may be substituted by $C_1$ to $C_4$ alkoxy group, $C_1$ to $C_4$ alkyl group, or halogen atom, or $R^{18}$ and $R^{19}$ may form a ring together with.

Specific examples thereof include amino group, diethylamino group, N-methyl-N-phenylamino group, N,N-diphenylamino group, N,N-di(tryl)amino group, dibenzylamino group, piperidino group, morpholino group, pyrrolidine group, and the like.

(7) alkylenedioxy group or alkylenedithio group such as methylenedioxy group or methylenedithio group.

(8) styryl group, β-phenylstyryl group, diphenylaminophenyl group, ditolylaminophenyl group, and the like.

The arylene groups represented by $Ar^1$ and $Ar^2$ include divalent groups derived from aryl groups represented by $Ar^3$ and $Ar^4$.

X represents a single bond, alkylene group, cycloalkylene group, alkylene ether group, oxygen atom, sulfur atom, or vinylene group.

Examples of the alkylene groups are $C_1$ to $C_{12}$, preferably $C_1$ to $C_8$, more preferably $C_1$ to $C_4$ straight chained or branched alkylene groups, wherein the alkylene groups may be further substituted by a fluorine atom, hydroxy group, cyano group, $C_1$ to $C_4$ alkoxy groups, phenyl group, or phenyl group substituted by a halogen atom, $C_1$ to $C_4$ alkyl group, or $C_1$ to $C_4$ alkoxy group. Specific examples thereof include methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, 4-biphenylethylene group and the like.

Examples of the cycloalkylene groups include $C_5$ to $C_7$ cyclic alkylene groups, wherein the cyclic alkylene groups may be substituted by a fluorine atom, hydroxide group, $C_1$ to $C_4$ alkyl group, or $C_1$ to $C_4$ alkoxy group. Specific examples thereof include cyclohexylidene group, cyclohexylene group, 3,3-dimethylcyclohexylidene group and the like.

Examples of the alkylene ether group include an ethyleneoxy group, propyleneoxy group, ethylene glycol group, propylene glycol group, diethylene glycol group, tetraethylene glycol group, and tripropylene group, wherein the alkylene group may be substituted by a hydroxyl group, methyl group, ethyl group and the like.

The vinylene group may be represented by the following formula.

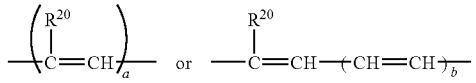

wherein $R^{20}$ represents a hydrogen atom, alkyl group which is the same as described in (2), or aryl group which is the same with the aryl group represented by $Ar^3$ and $Ar^4$; "a" represents an integer of 1 or 2, and "b" represents an integer of 1 to 3.

Z represents an alkylene group, alkylene ether group, aralkylene group, or alkyleneoxycarbonyl group. The substituted or unsubstituted alkylene group includes the alkylene groups as defined for X. The substituted or unsubstituted alkylene ether group includes the alkylene ether groups as defined for X. The aralkylene group includes a group formed by binding the above-noted alkylene group and the arylene group as defined for $Ar^1$ or $Ar^2$. The alkyleneoxycarbonyl group includes caprolactone-modified groups.

The alkyl group, arylene group in the alalkyl group and aryl group as $R^{14}$, $R^{15}$ and $R^{16}$ individually represent the same group as the above-noted group.

More preferable examples of the radical polymerizable compounds having one functionality and a charge transport units include represented by the following Formula (7).

Formula (7)

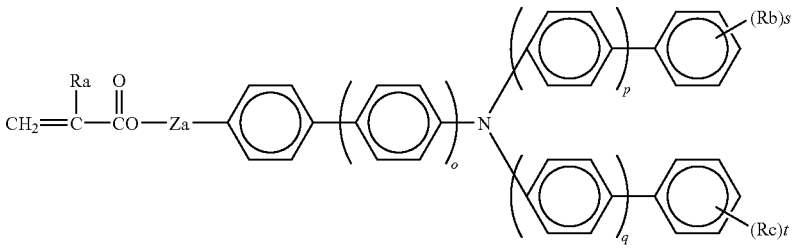

wherein o, p and q are individually an integer of 0 or 1; Ra represents any one of a hydrogen atom and a methyl group; Rb and Rc represent individually a $C_1$ to $C_6$ alkyl group (plural Rbs may be different from each other and plural Rcs may be different from each other); s and t are individually an integer of 0 to 3; and Za represents any one of a single bond, a methylene group, an ethylene group and a group represented by the following formulas:

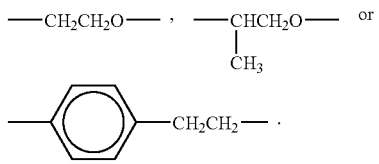

The compounds represented by the above formulas are preferably those in which Rb and Rc are each methyl group or ethyl group.

The radical polymerizable compounds having one functionality and a charge transport units expressed by Formulas (5), (6), and (7), in particular those expressed by Formula (7) typically do not attach to terminal sites of crosslinked structure sine the polymerization is accomplished by opening of the carbon-carbon double bond at both sides, but are possibly incorporated into a continuous polymer chain. The radical polymerizable compound having one functionality exists, within the crosslinked polymer formed with the radical polymerizable monomer having three or more functionalities, at the main chain or the crosslinking chain between main chains. Incidentally, crosslinking chains can be classified into intermolecular crosslinking chains, and intramolecular crosslinking chains that connect certain sites within a molecule. In both cases of existence at the main chain and at the cross linking chain of the radical polymerizable compound having one functionality, the triarylamine structure attached to the chain is bulky due to at least three aryl groups attached radially to the nitrogen atom. However, since the three aryl groups are not directly attached to the chains but are indirectly attached to the chains through carbonyl group or the like, it is believed that the triarylamine structure is fixed flexibly in terms of spatial site, and the triarylamine structure can be disposed at appropriate distances therebetween, therefore, structural stress is not significant in the molecules and the passages for charge transport can be maintained in the molecular structure within the surface layer of photoconductors.

Specific examples of the radical polymerizable compounds having one functionality and a charge transport available in the present invention are listed below, but are not limited to.

No. 1

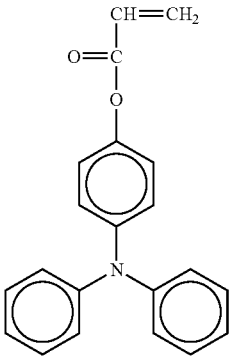

No. 2

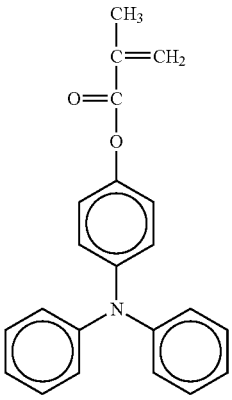

-continued

No. 3

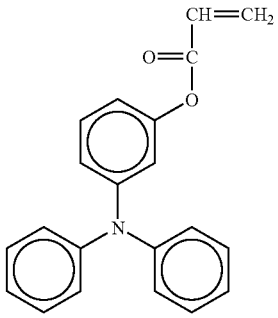

No. 4

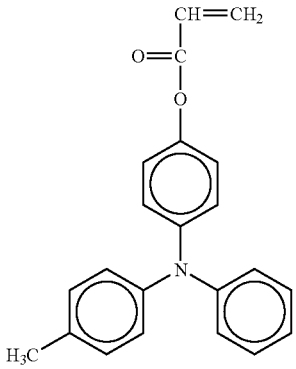

No. 5

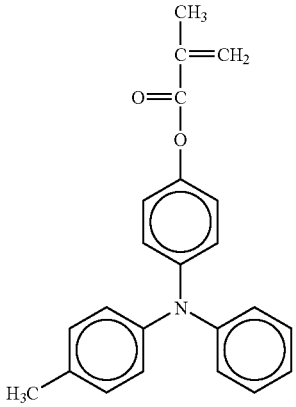

No. 6

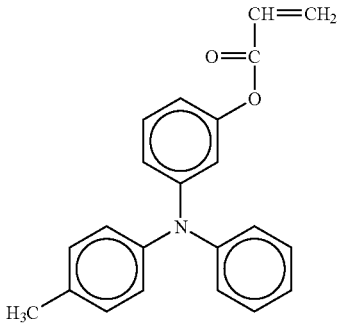

-continued
No. 7
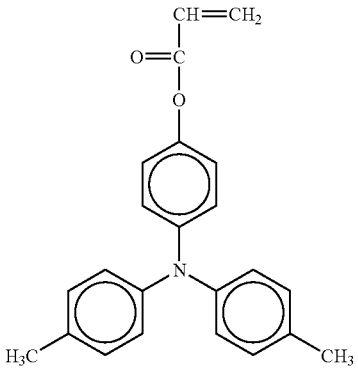
No. 8
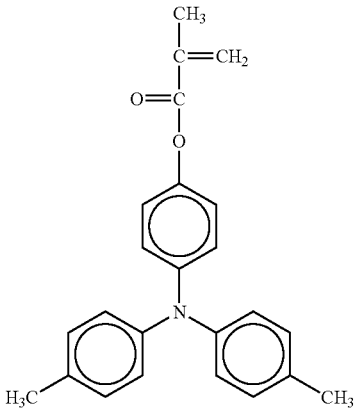
No. 9
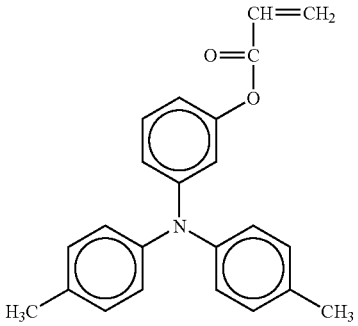
No. 10
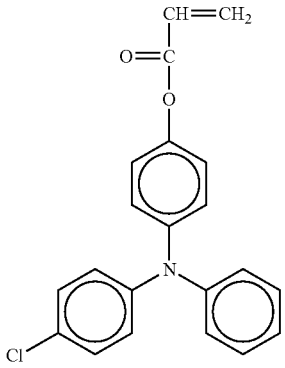
-continued
No. 11
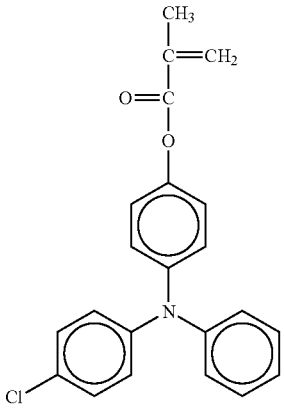
No. 12
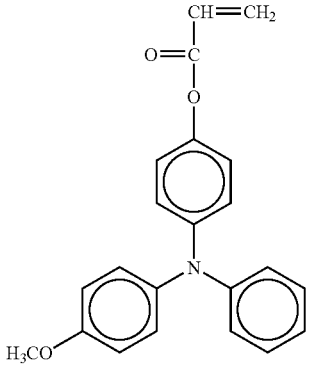
No. 13
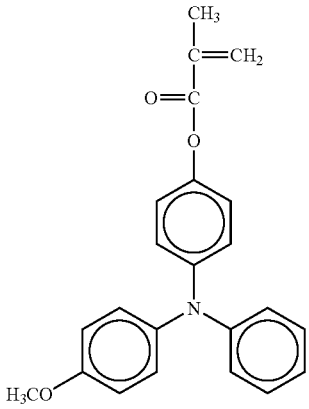
No. 14
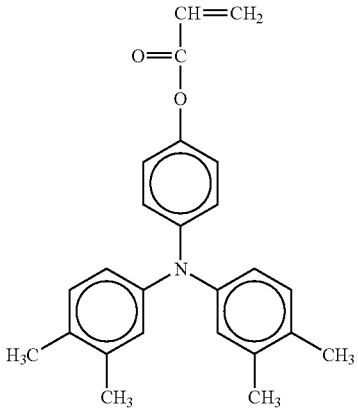

-continued
No. 15
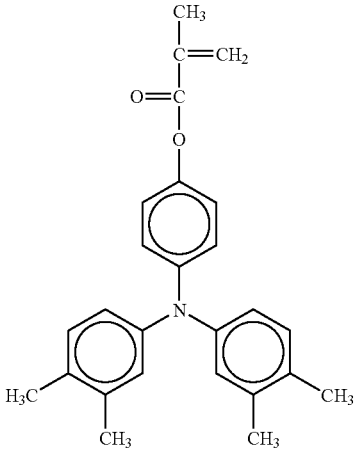
No. 16
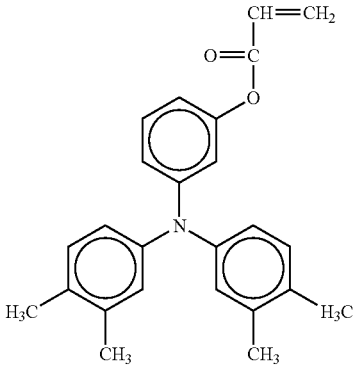
No. 17
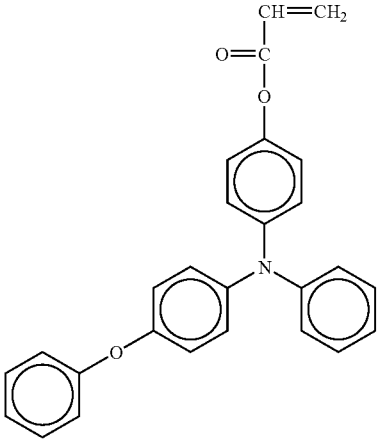
-continued
No. 18
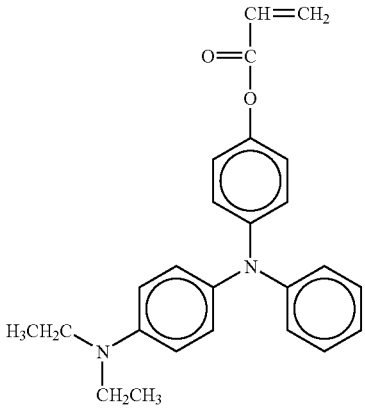
No. 19
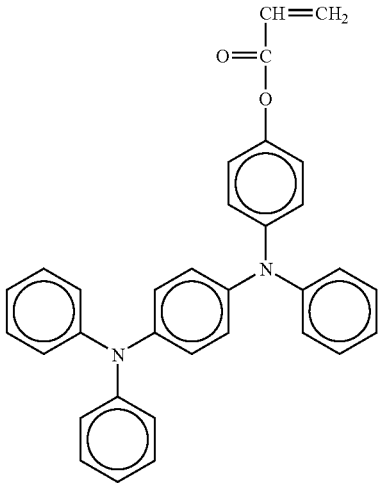
No. 20
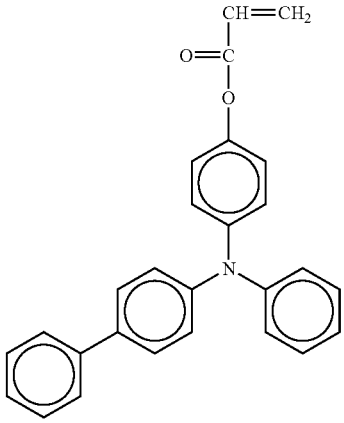

-continued
No. 21
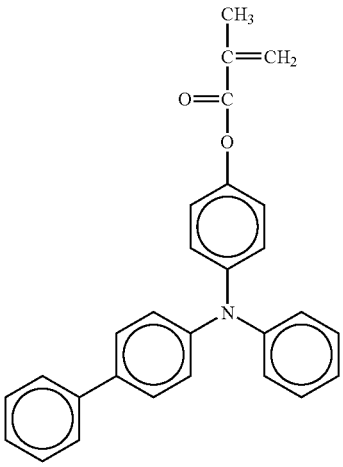
No. 22
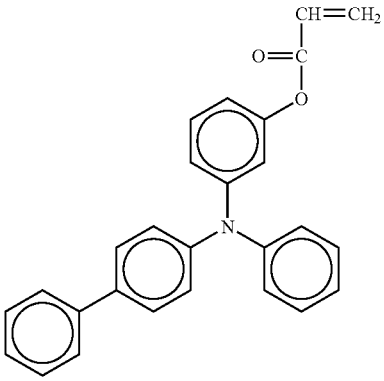
No. 23
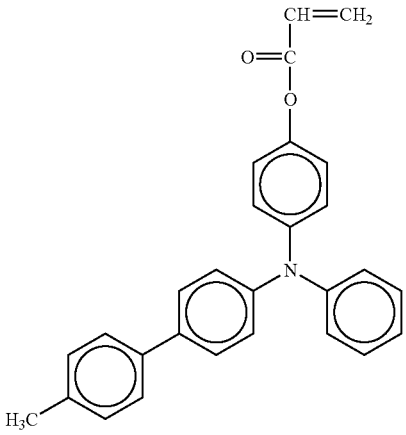
-continued
No. 24
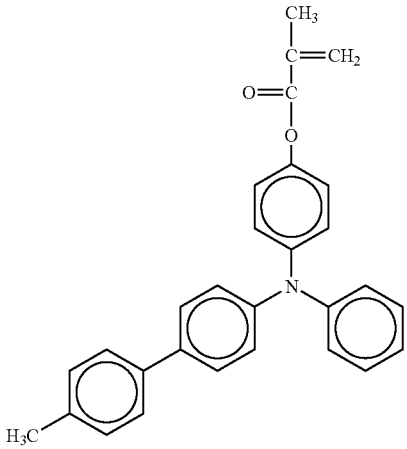
No. 25
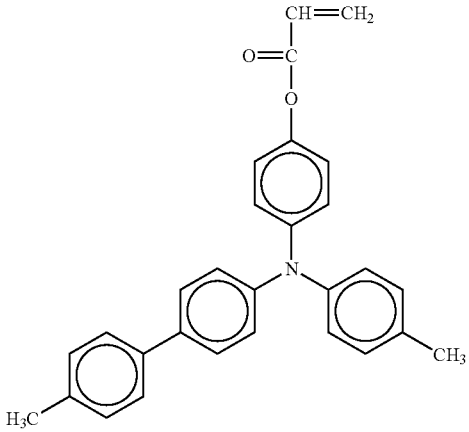
No. 26
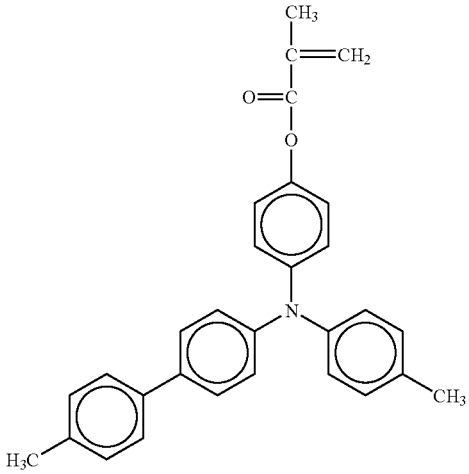

-continued
No. 27
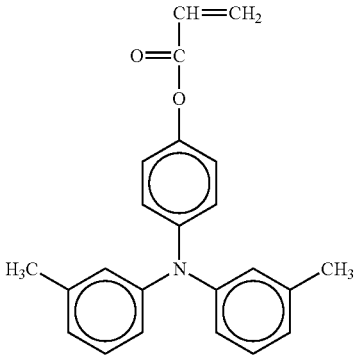
No. 28
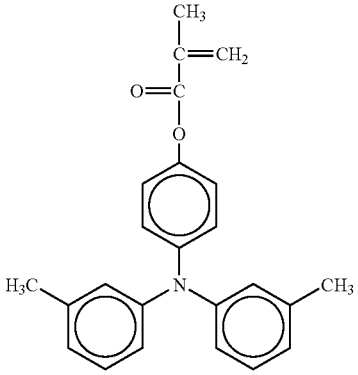
No. 29
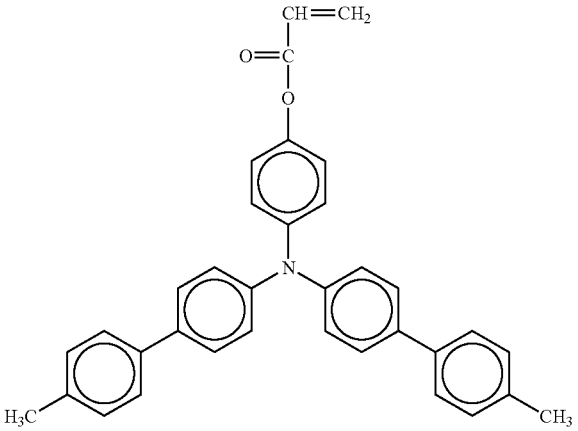
No. 30
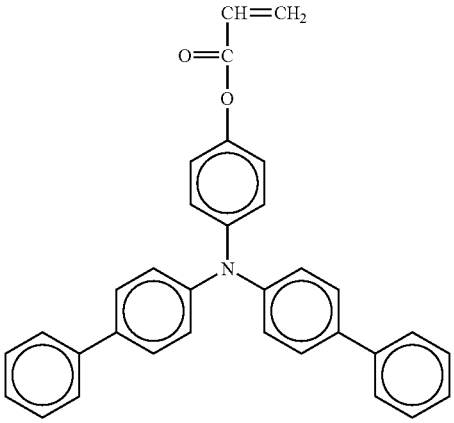
-continued
No. 31
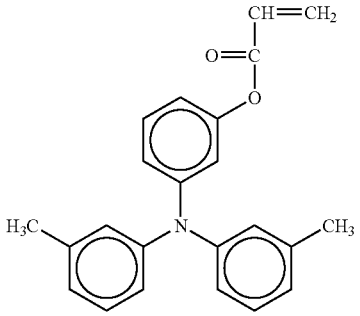
No. 32
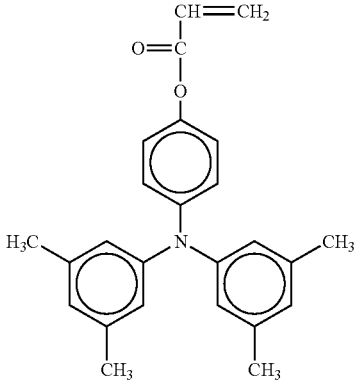
No. 33
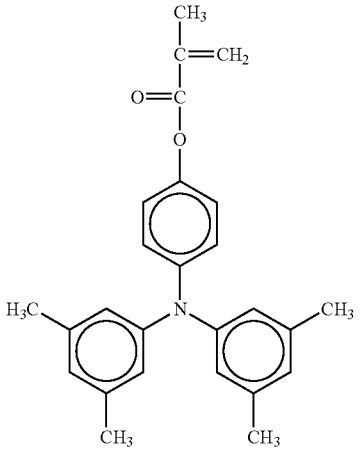
No. 34
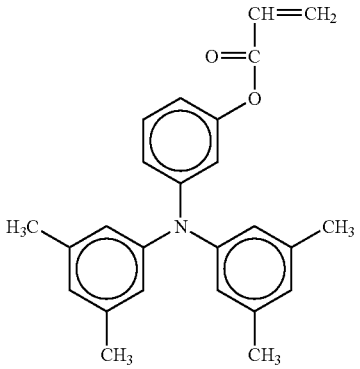

-continued
No. 35
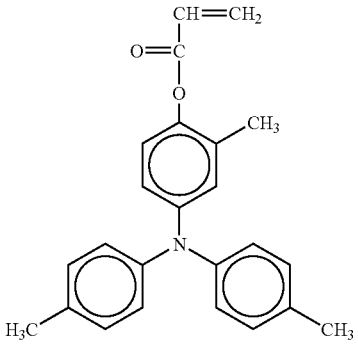
No. 36
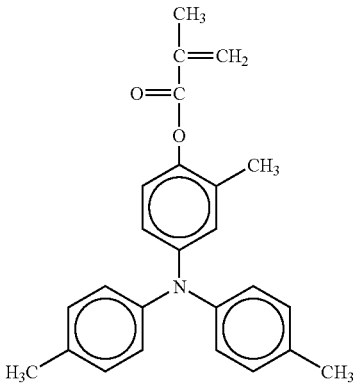
No. 37
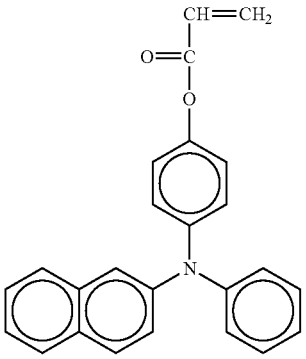
No. 38
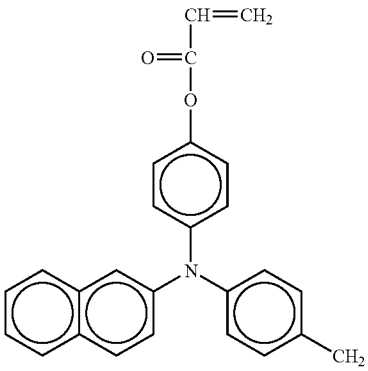
-continued
No. 39
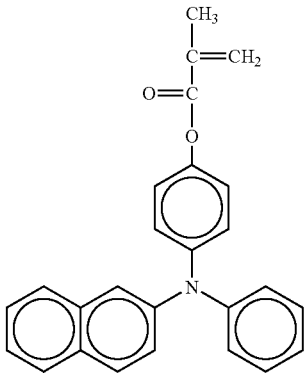
No. 40
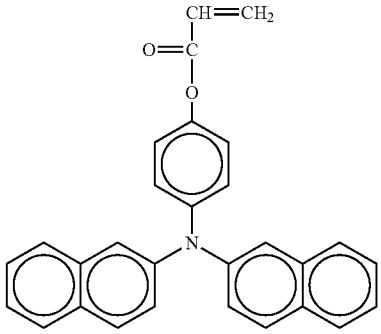
No. 41
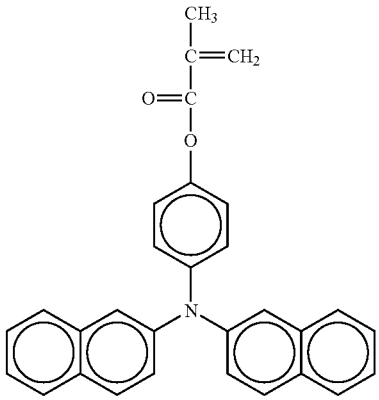
No. 42
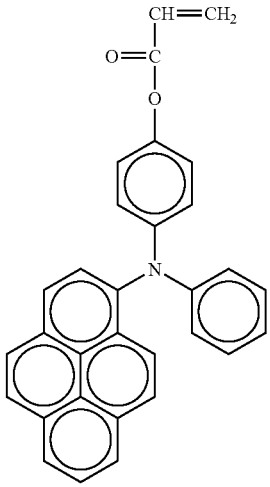

-continued
No. 43
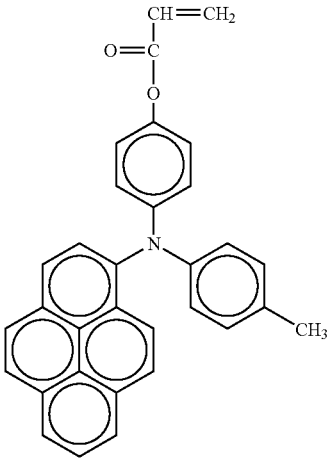
No. 44
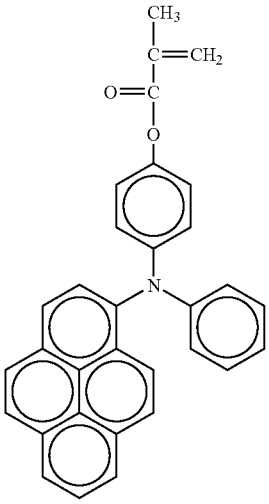
No. 45
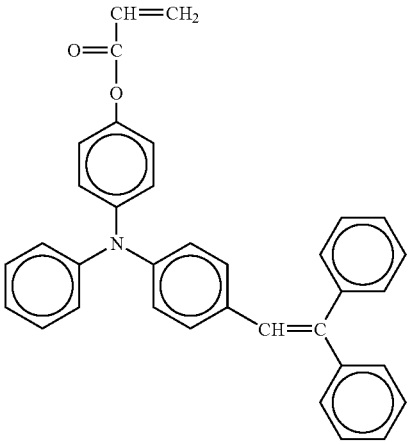
-continued
No. 46
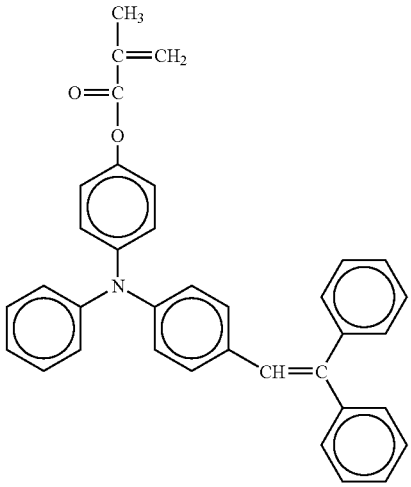
No. 47
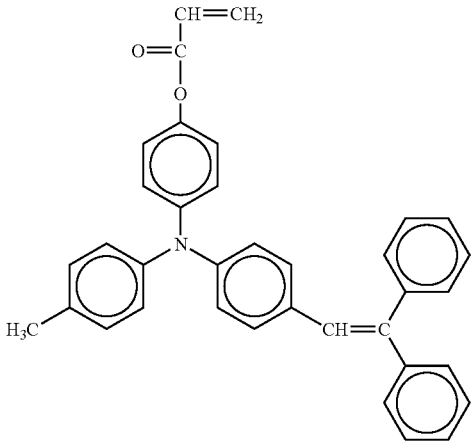
No. 48
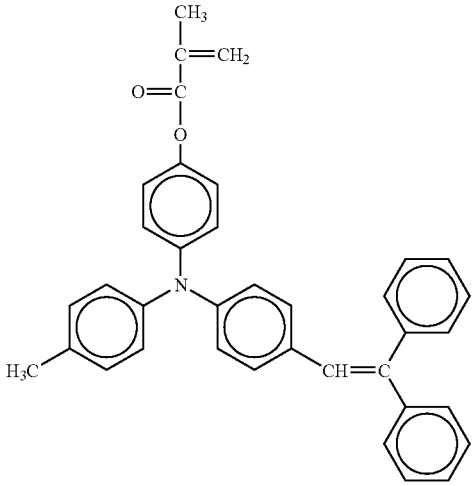

-continued
No. 49
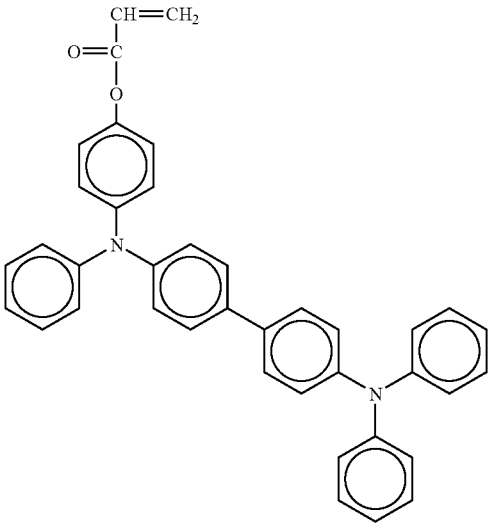
No. 50
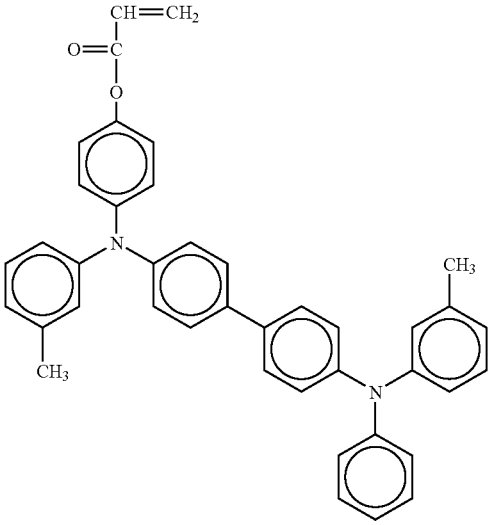
No. 51
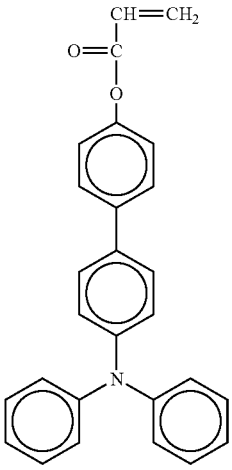
-continued
No. 52
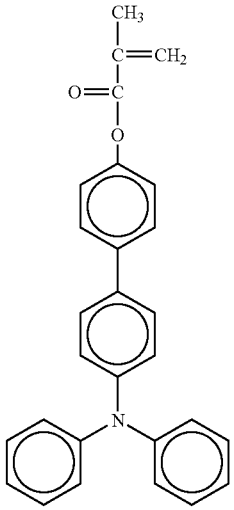
No. 53
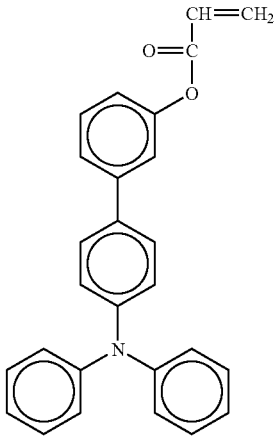
No. 54
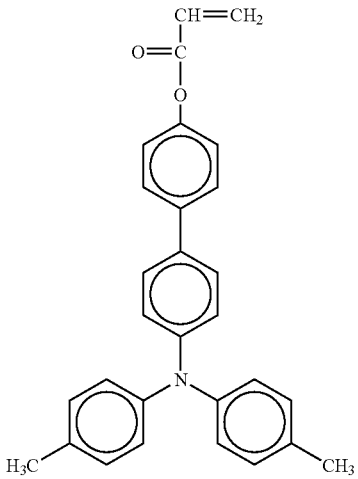

-continued
No. 55
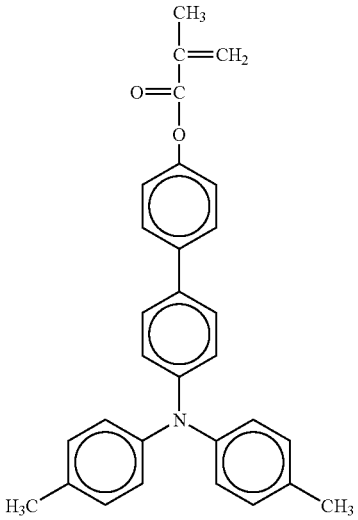
No. 56
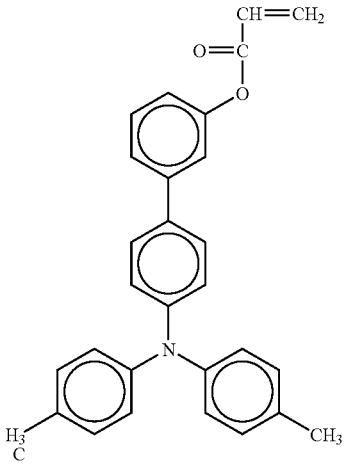
No. 57
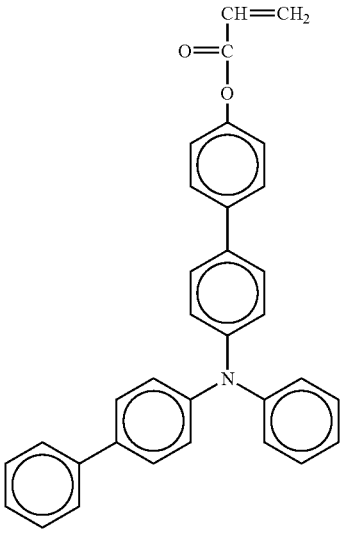
-continued
No. 58
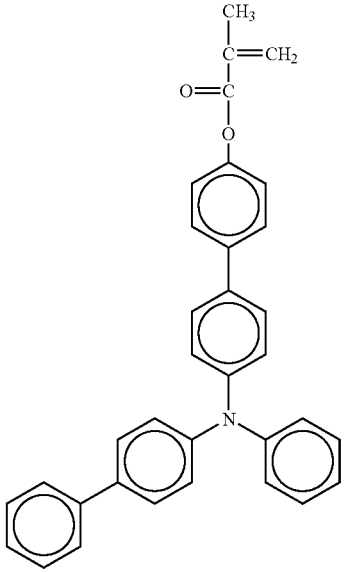
No. 59
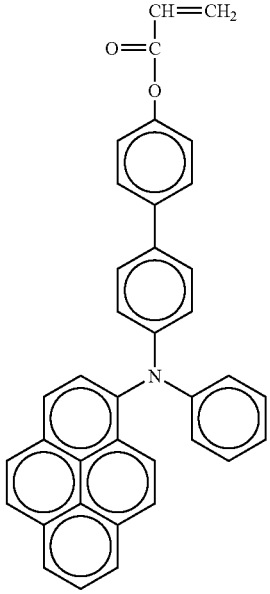
No. 60
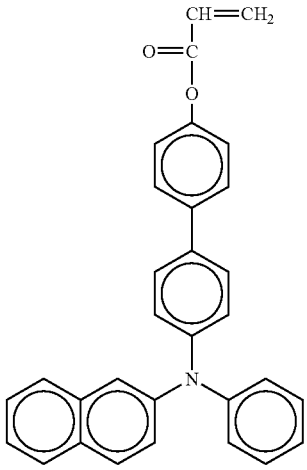

-continued
No. 61
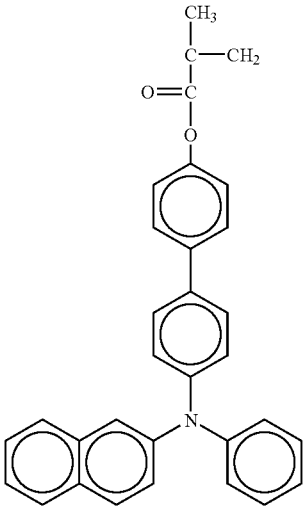
No. 62
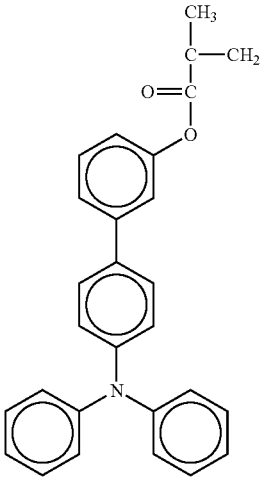
No. 63
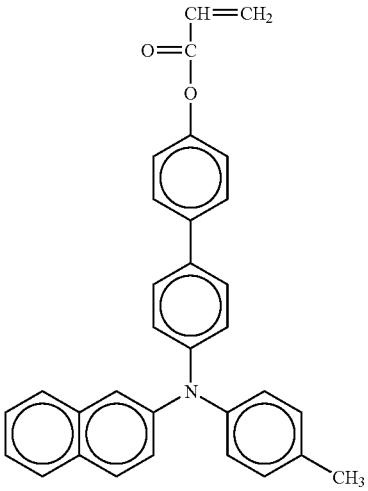
-continued
No. 64
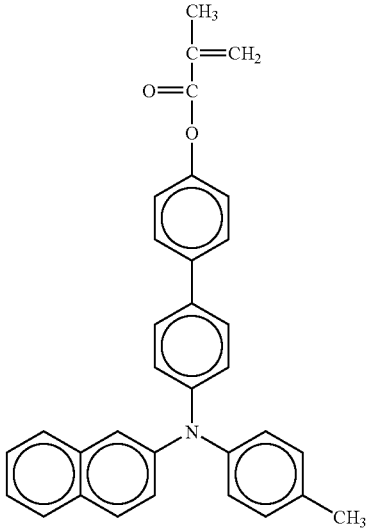
No. 65
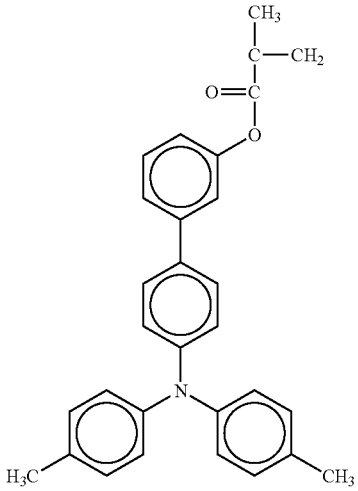
No. 66
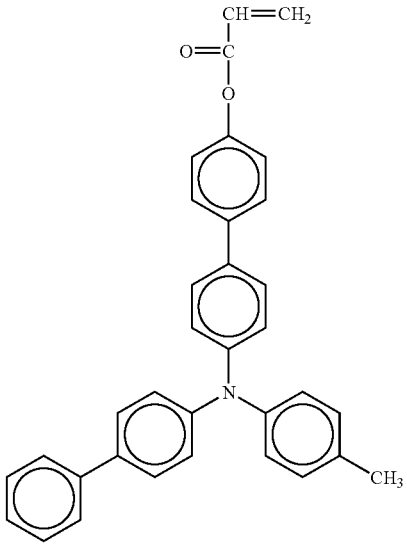

-continued
No. 67
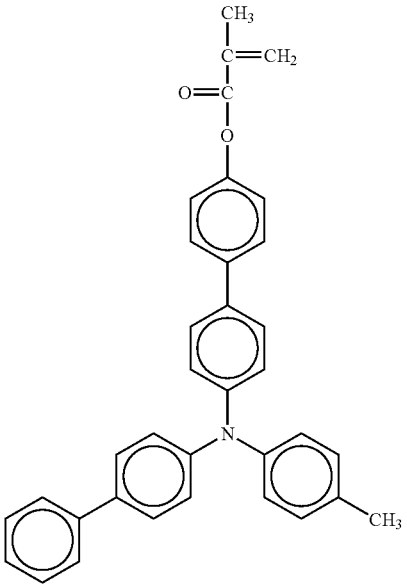
-continued
No. 69
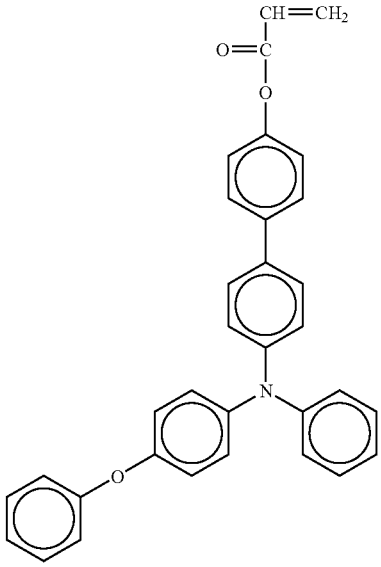
No. 68
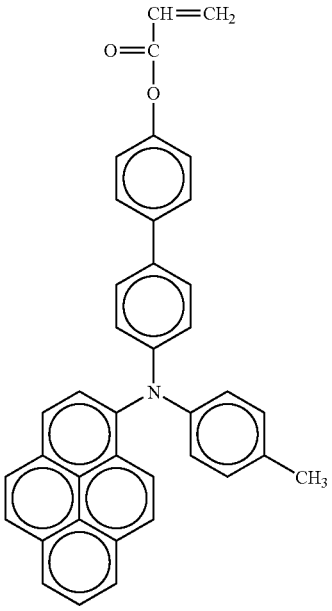
No. 70
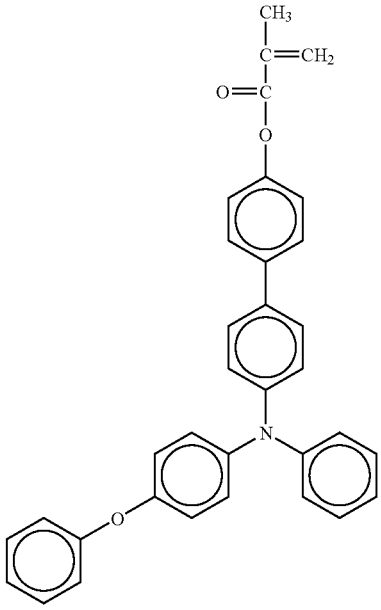

-continued
No. 71
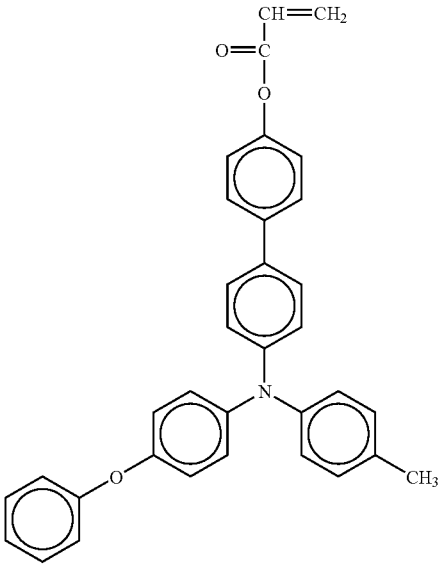
No. 72
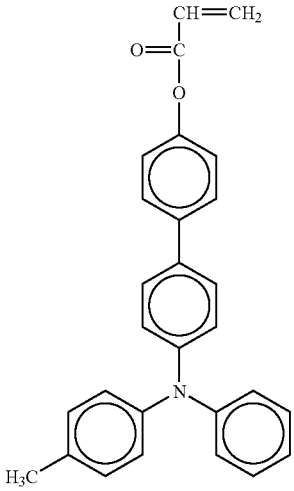
No. 73
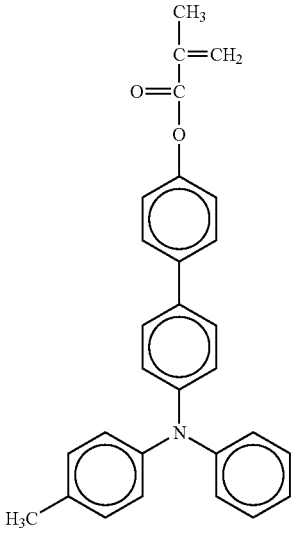
-continued
No. 74
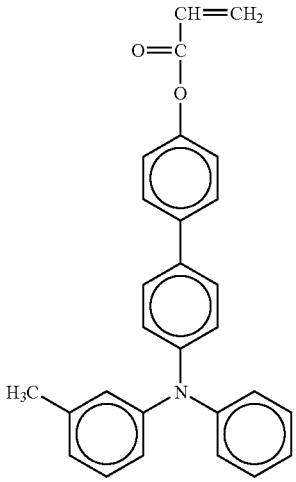
No. 75
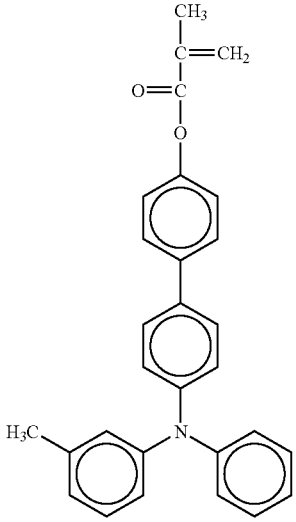
No. 76
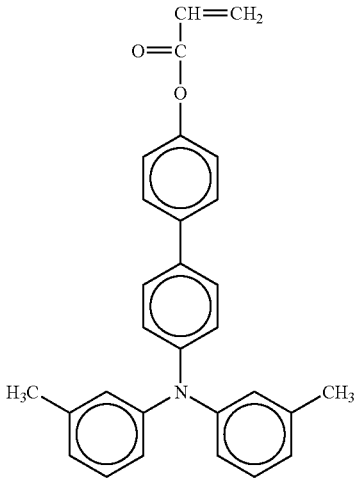

-continued
No. 77
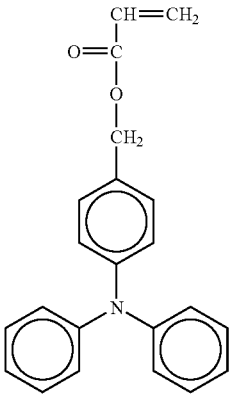
No. 78
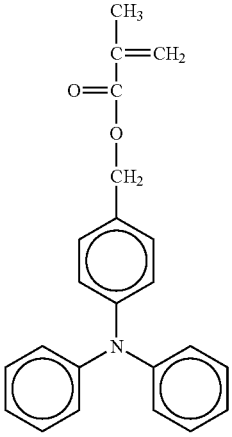
No. 79
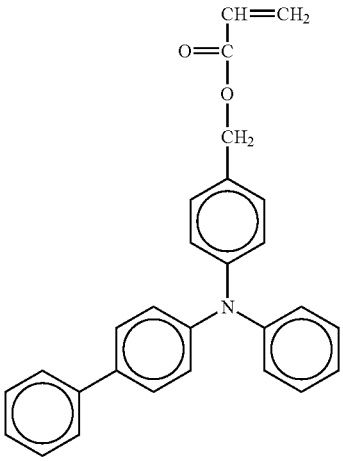
-continued
No. 80
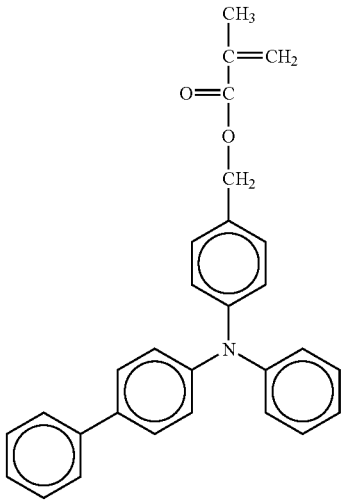
No. 81
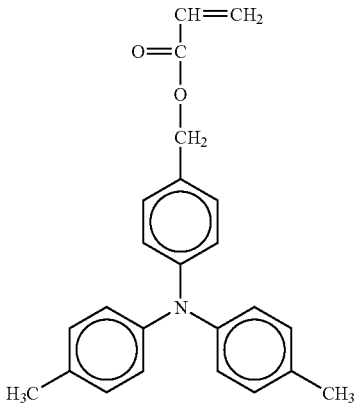
No. 82
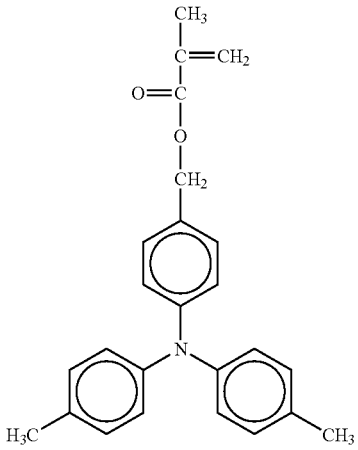

-continued
No. 83
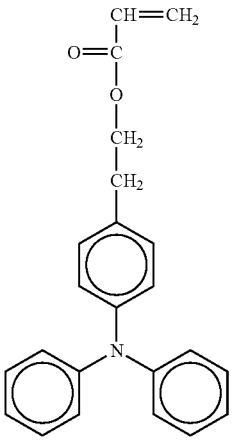
No. 84
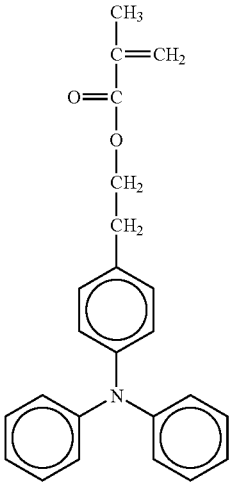
No. 85
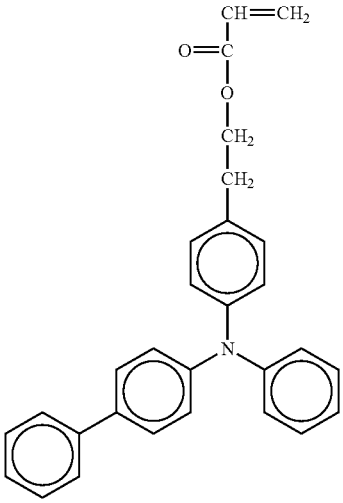
-continued
No. 86
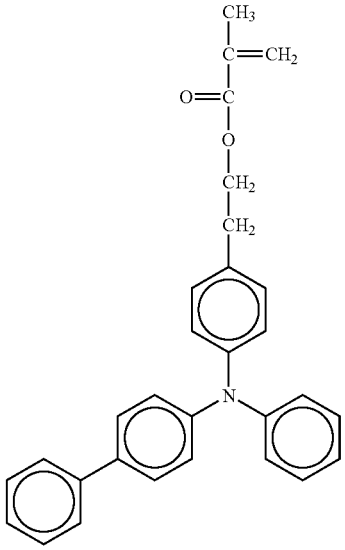
No. 87
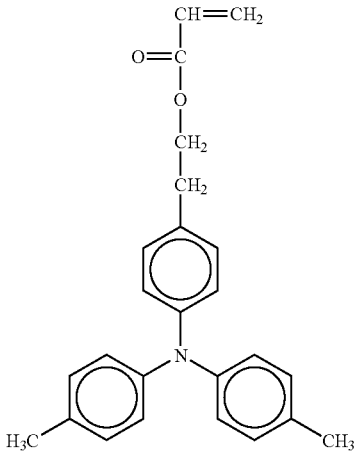
No. 88
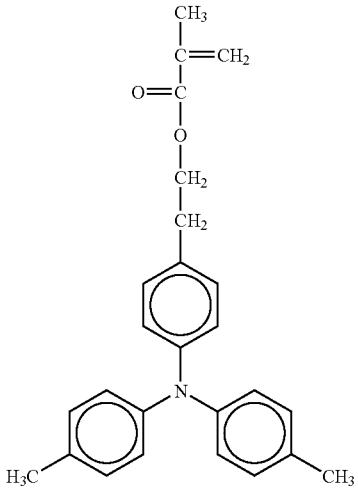

-continued
No. 89
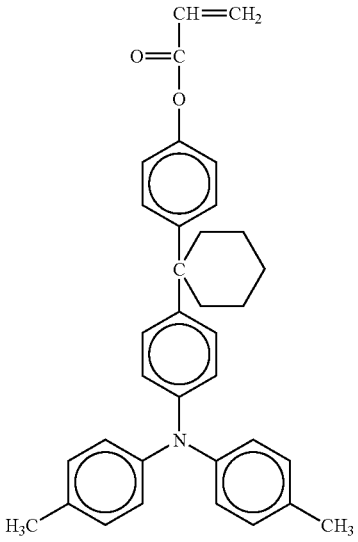
-continued
No. 91
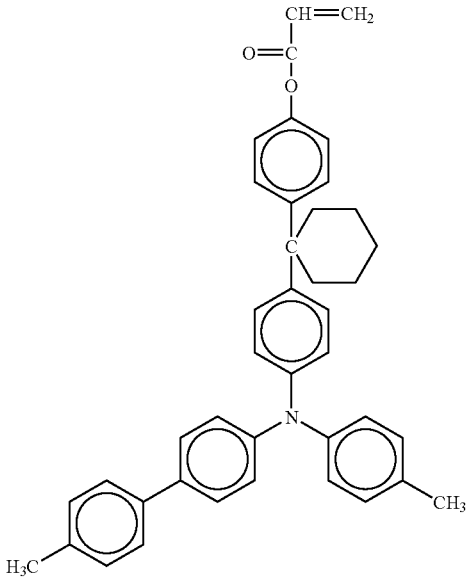
No. 90
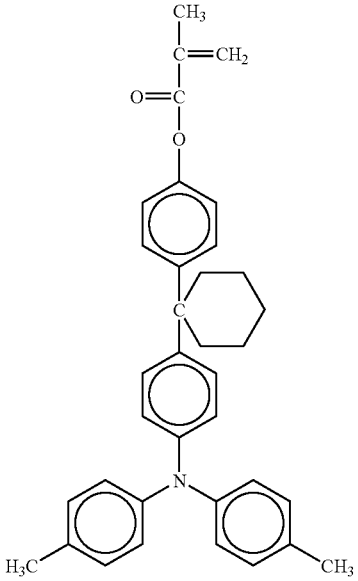
No. 92
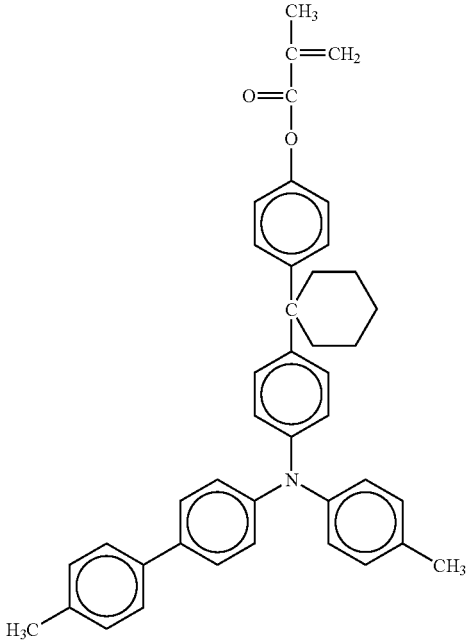

-continued
No. 93
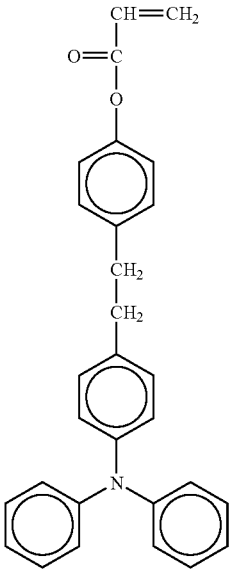
-continued
No. 95
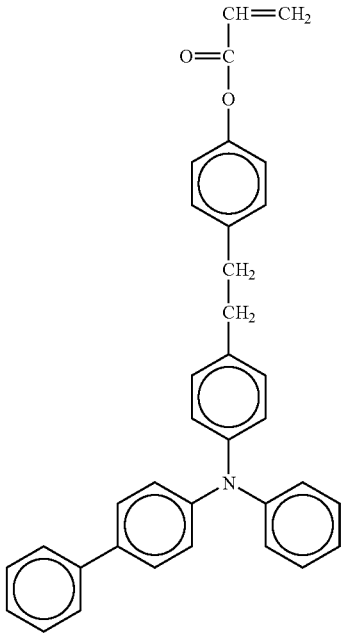
No. 94
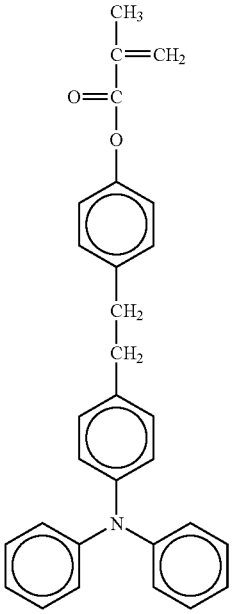
No. 96
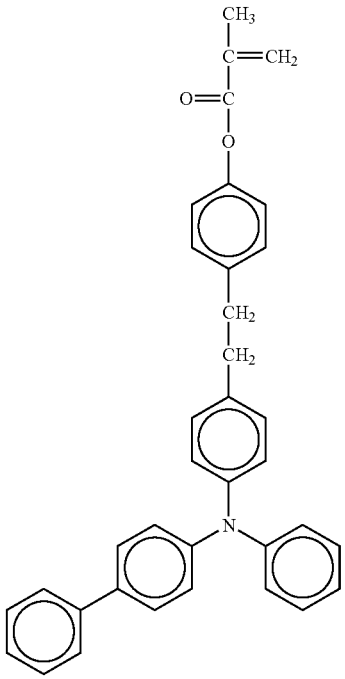

-continued
No. 97
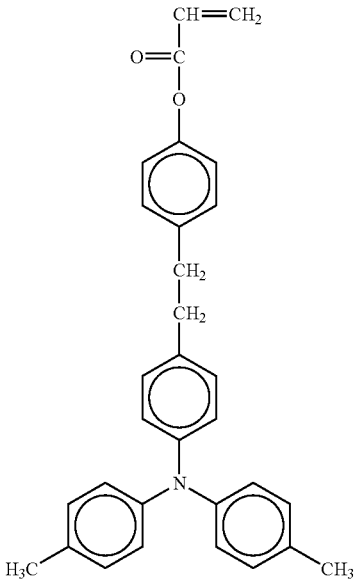
No. 98
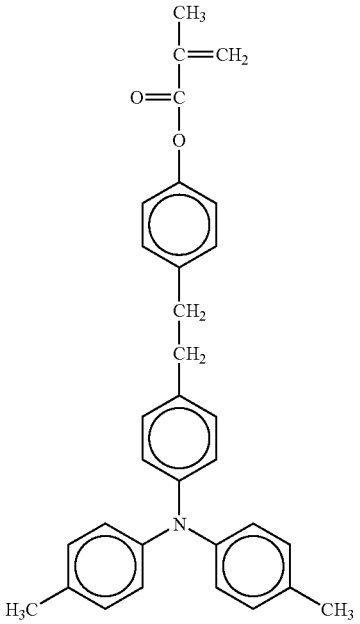
-continued
No. 99
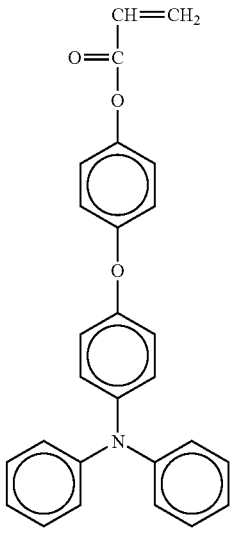
No. 100
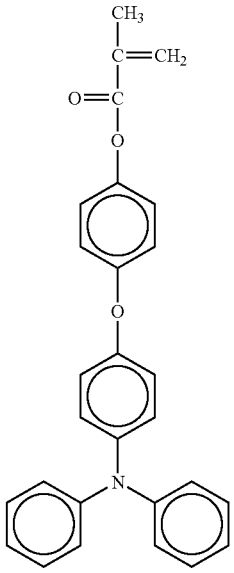

-continued
No. 101
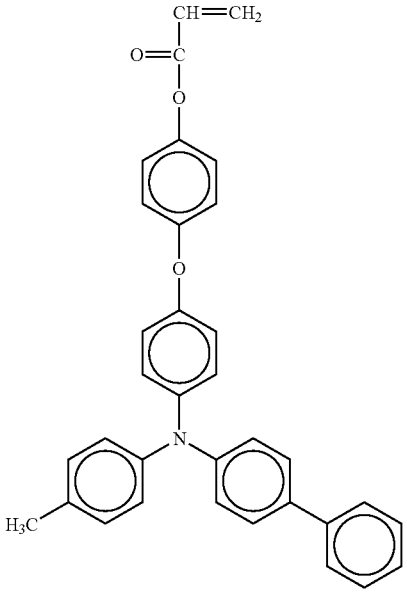
-continued
No. 103
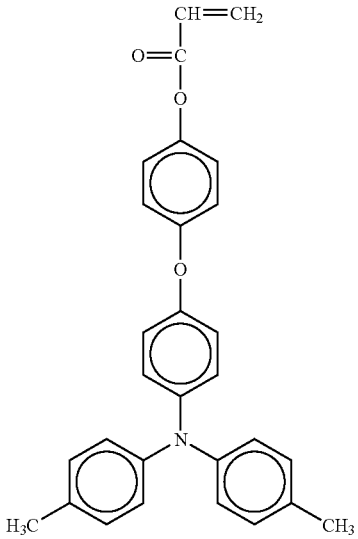
No. 102
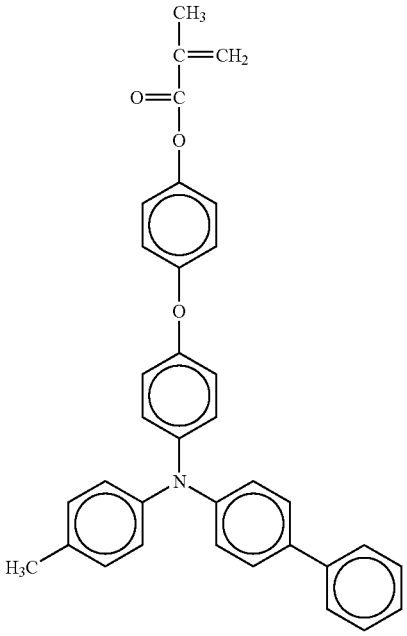
No. 104
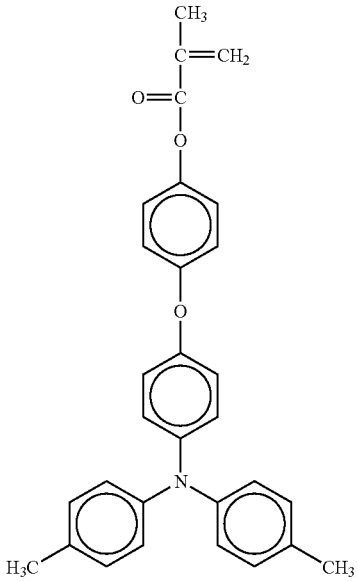

-continued
No. 105
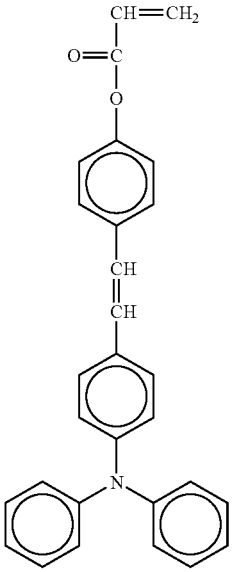
No. 106
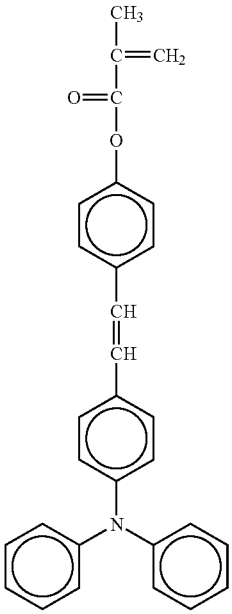
-continued
No. 107
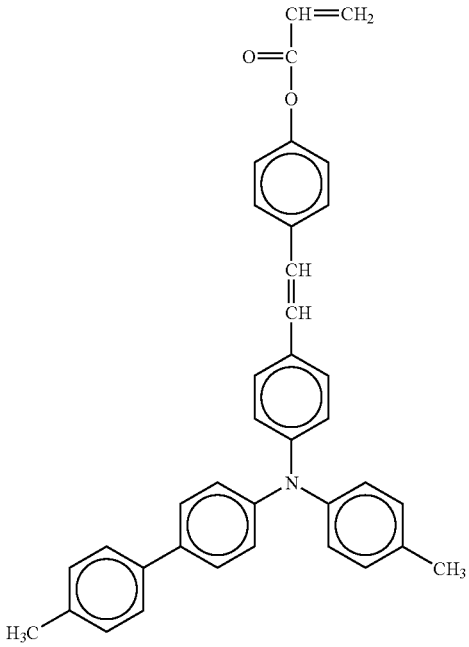
No. 108
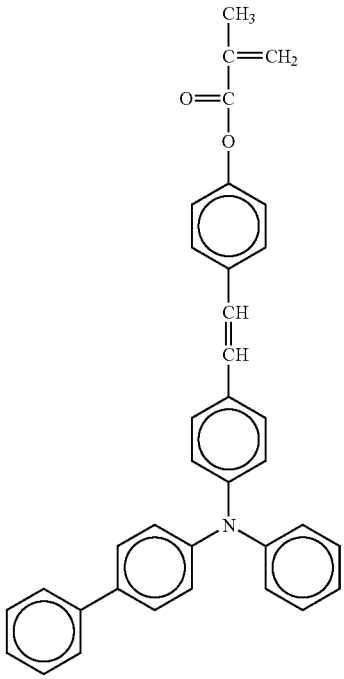

-continued
No. 109
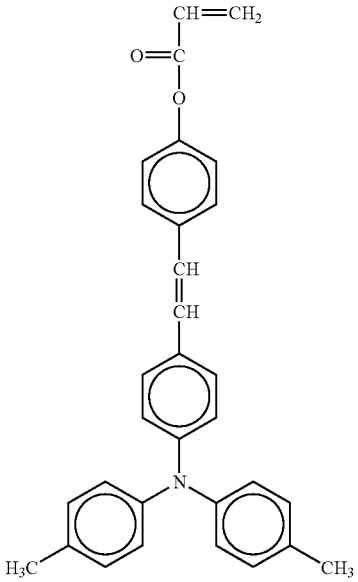
No. 110
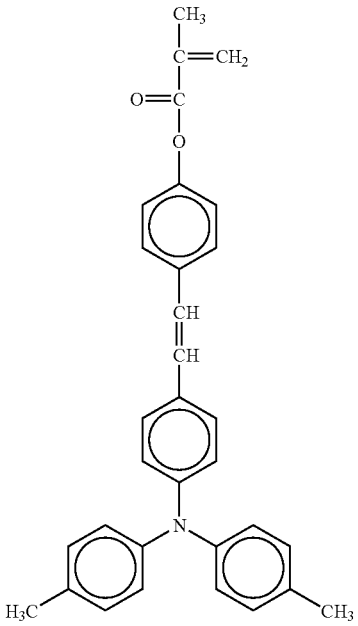
-continued
No. 111
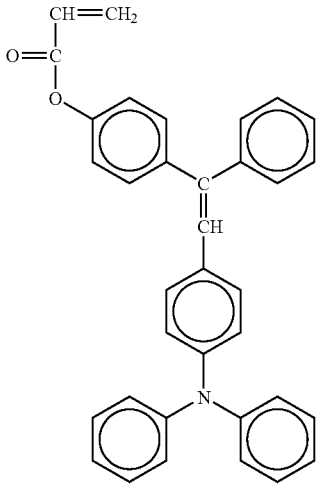
No. 112
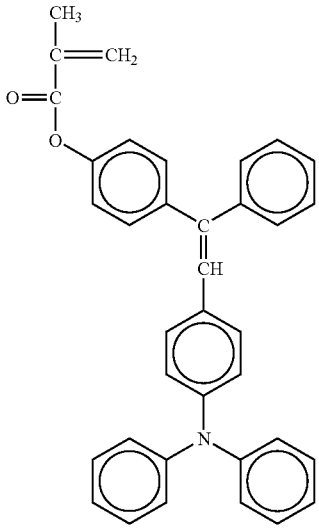
No. 113
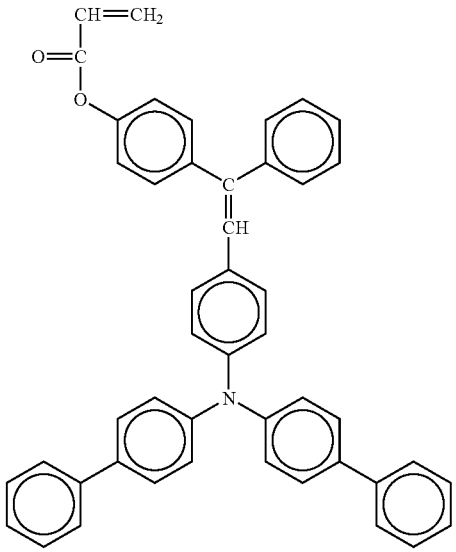

-continued
No. 114
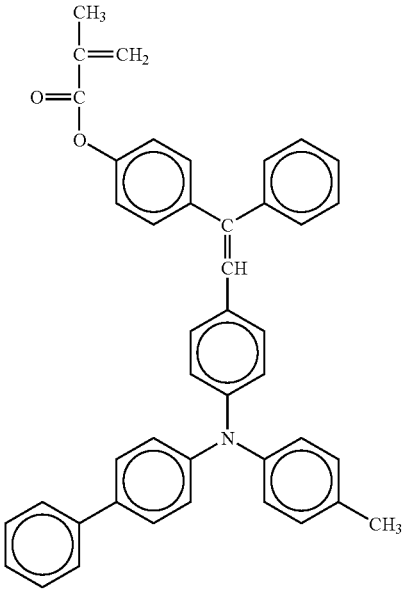
No. 115
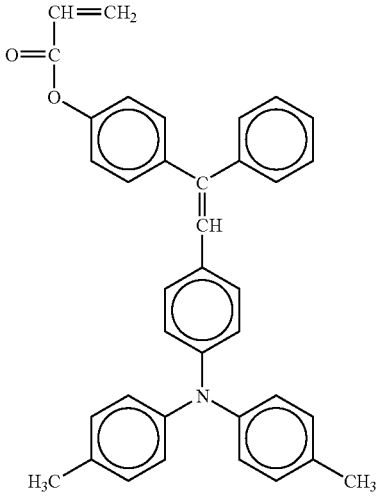
No. 116
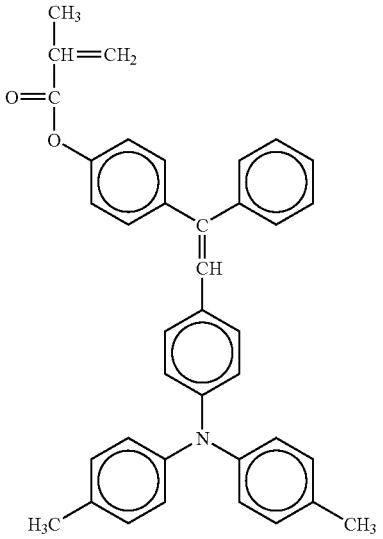
-continued
No. 117
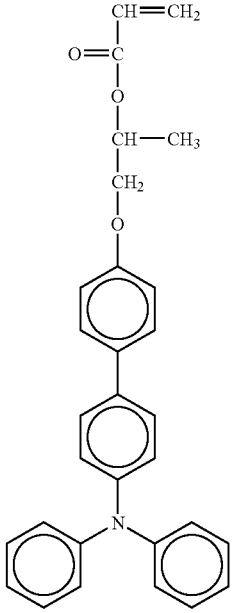
No.118
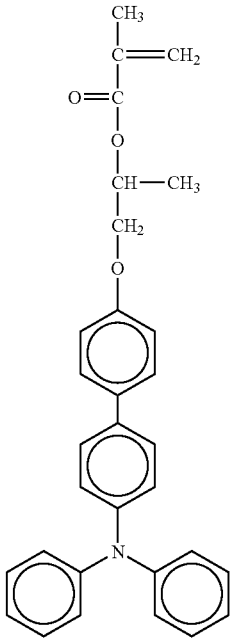

-continued
No. 119
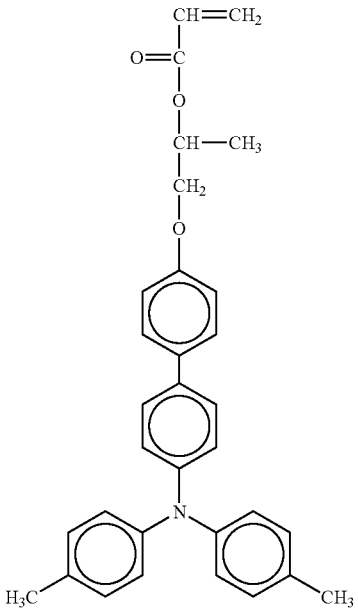
-continued
No. 121
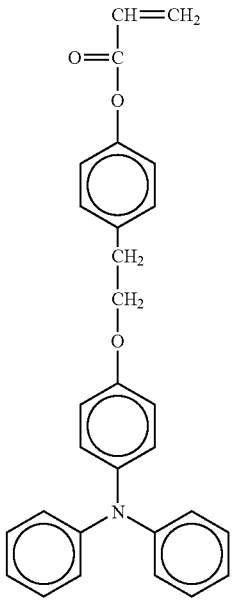
No. 120
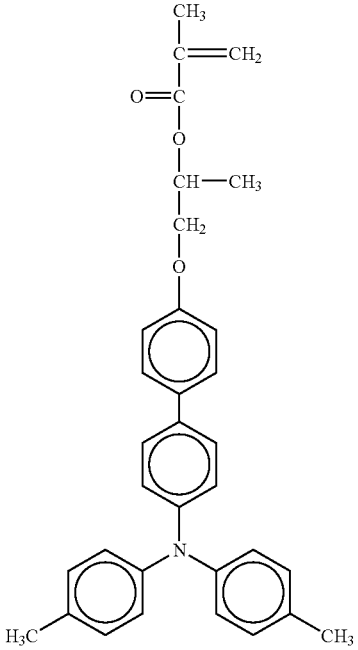
No. 122
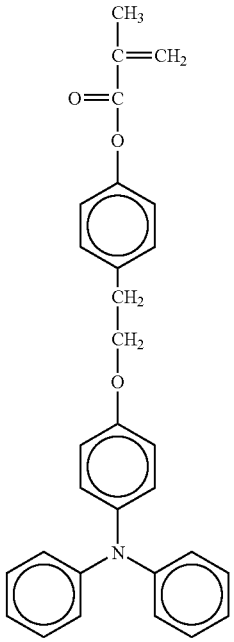

-continued
No. 123
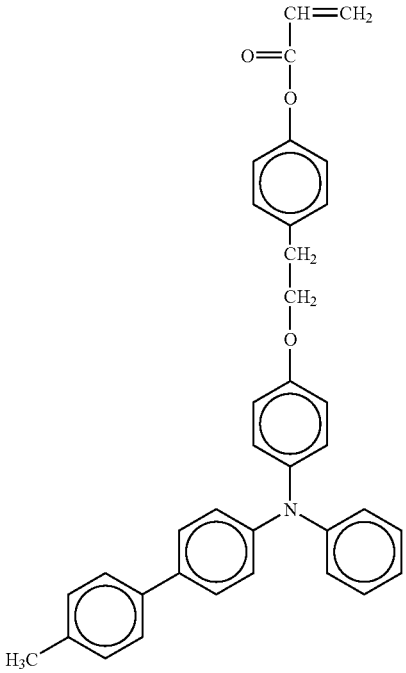
No. 124
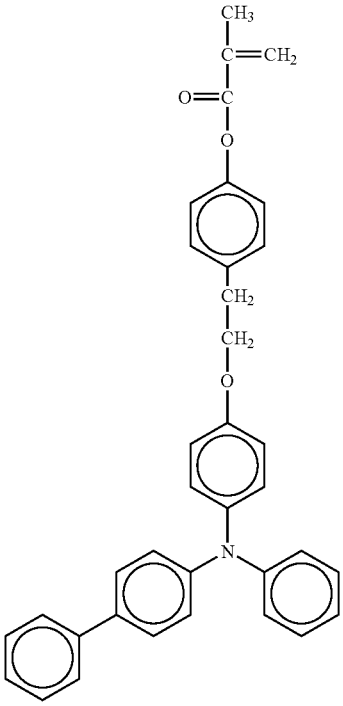
-continued
No. 125
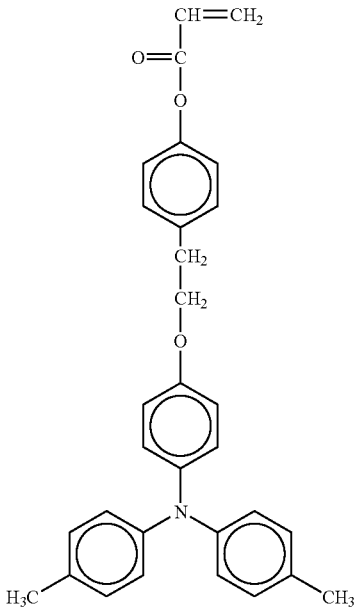
No. 126
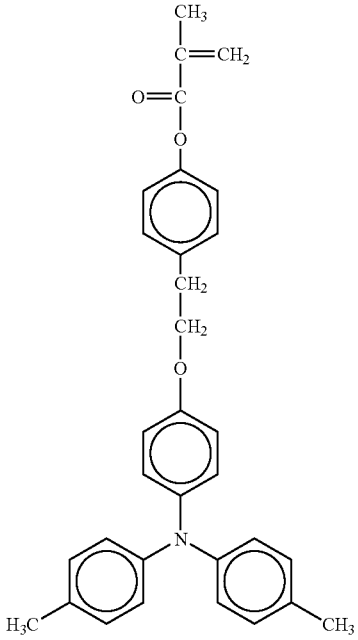

-continued
No. 127
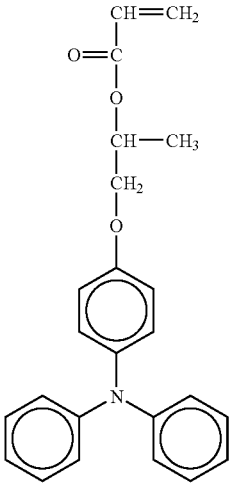
No. 128
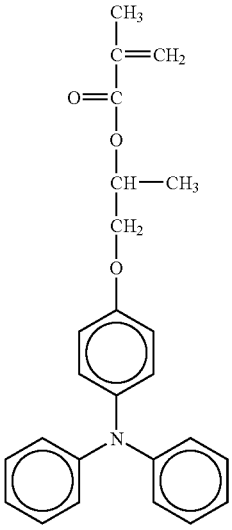
No. 129
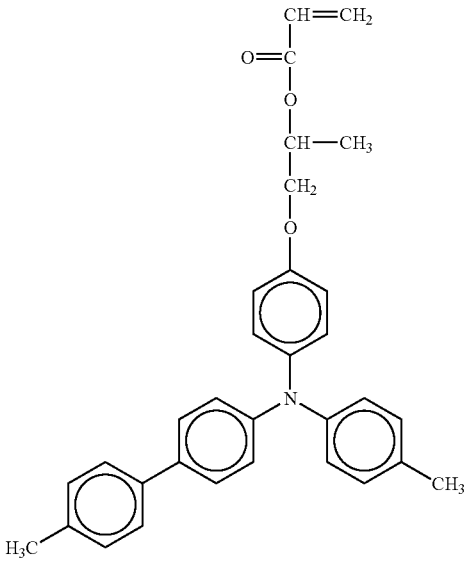
-continued
No. 130
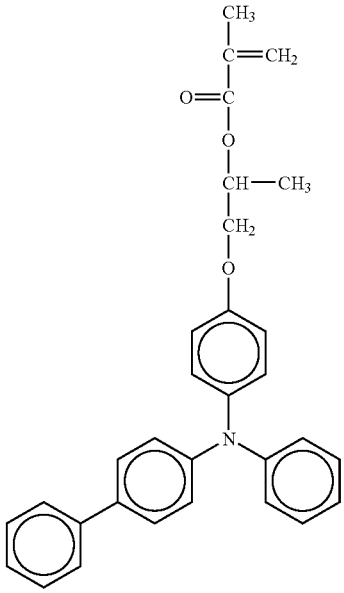
No. 131
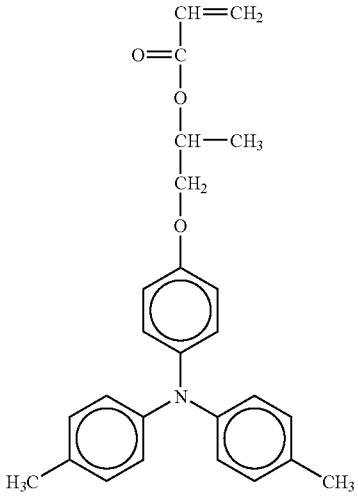
No. 132
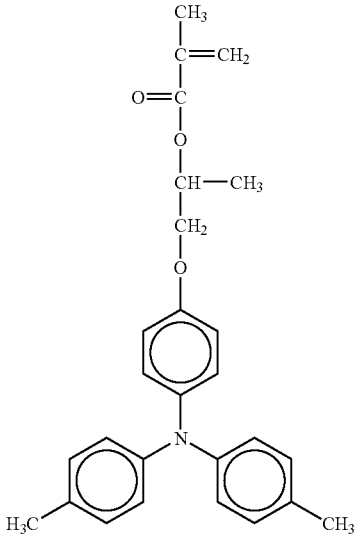

-continued
No. 133
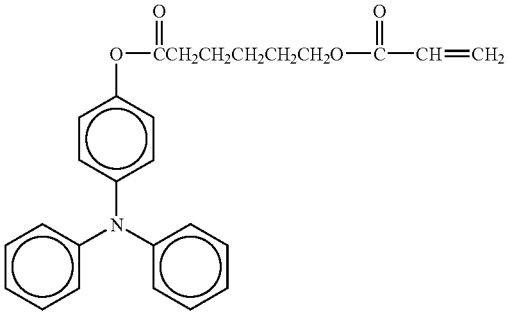
No. 134
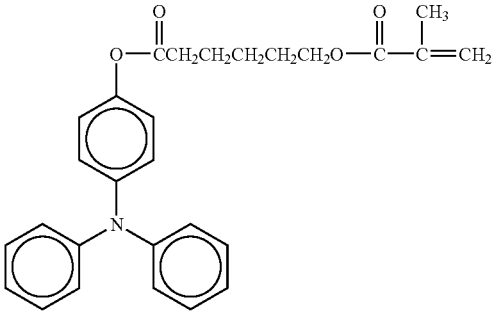
No. 135
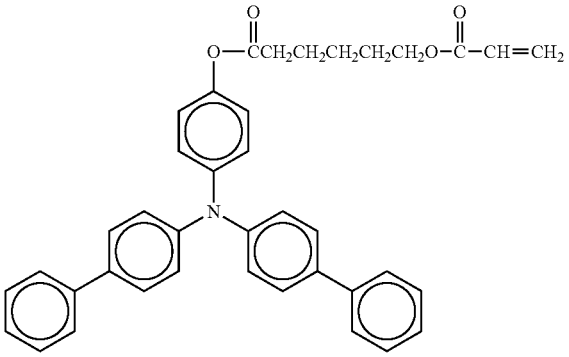
No. 136
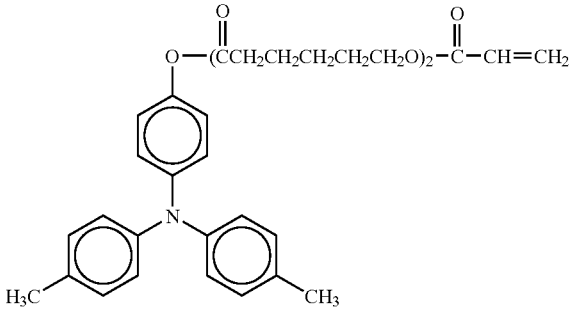
-continued
No. 137
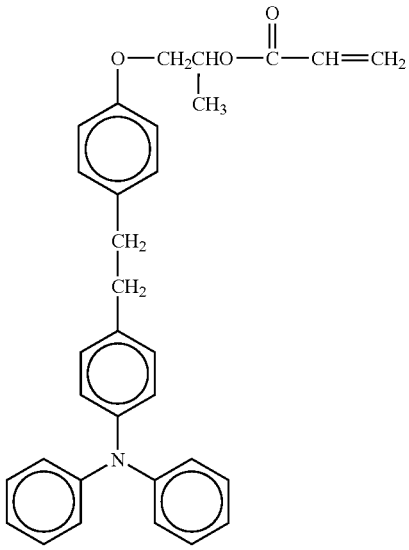
No. 138
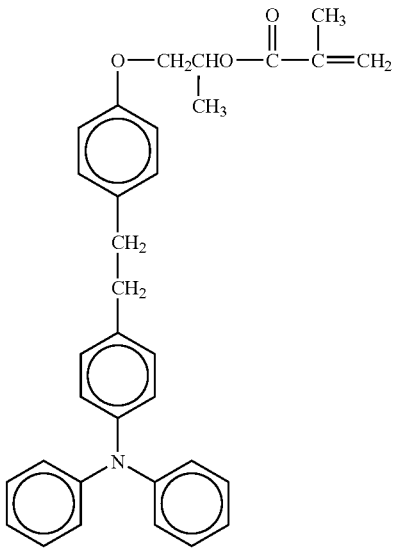

-continued
No. 139
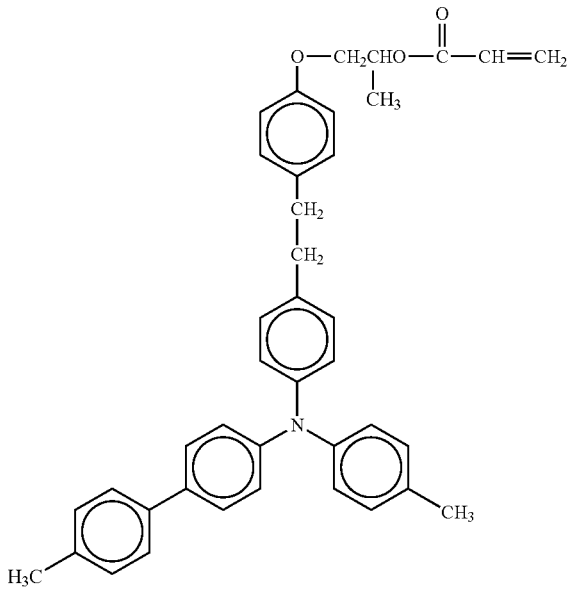
No. 140
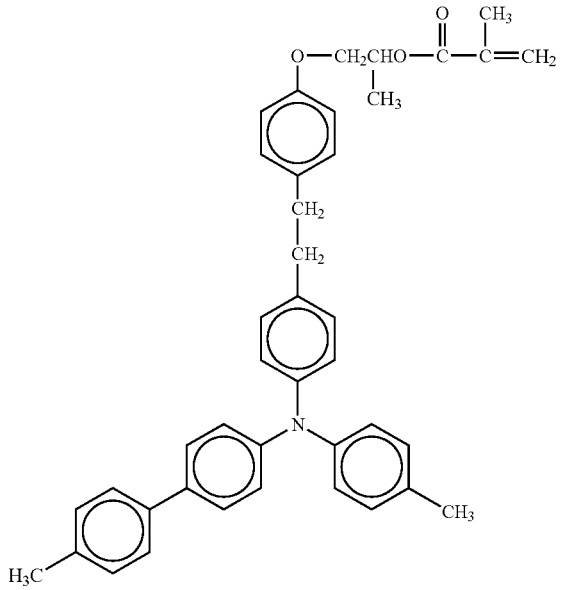
-continued
No. 141
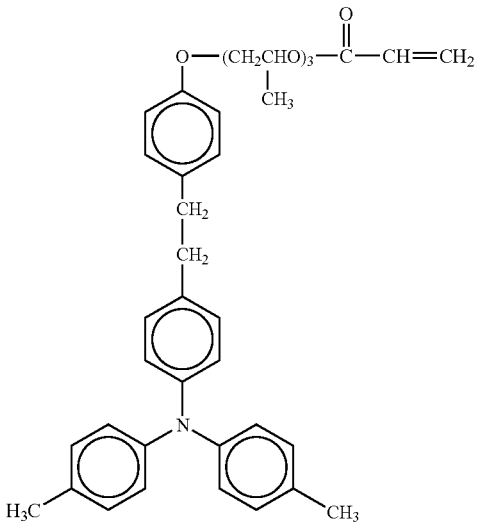
No. 142
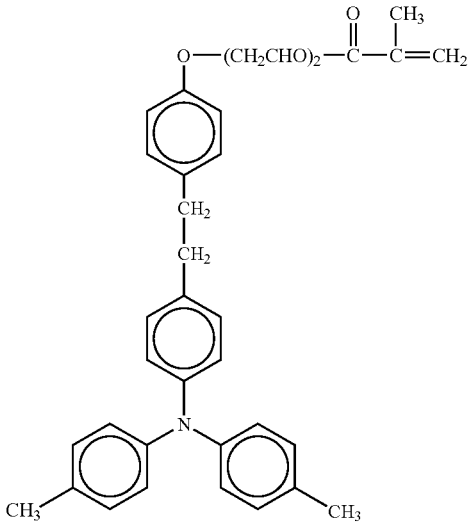
No. 143
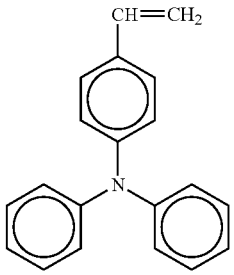

-continued
No. 144
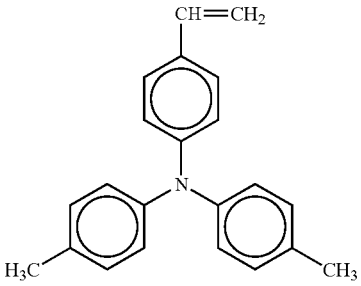
No. 145
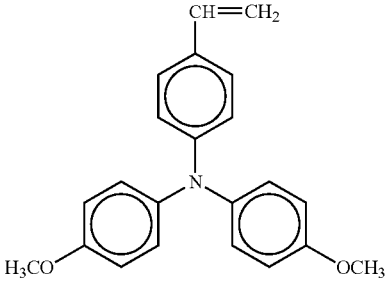
No. 146
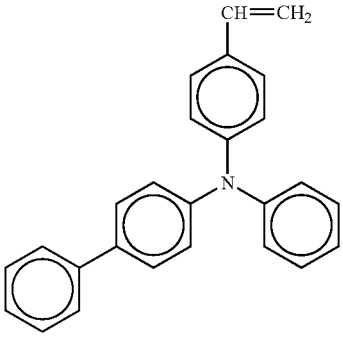
No. 147
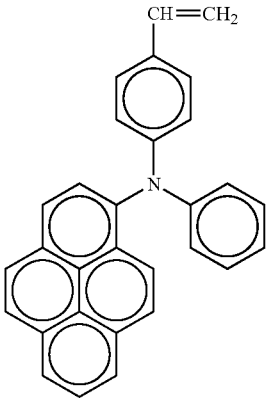
No. 148
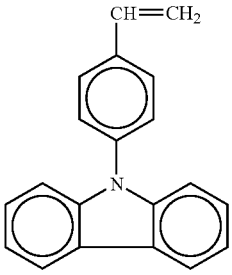
-continued
No. 149
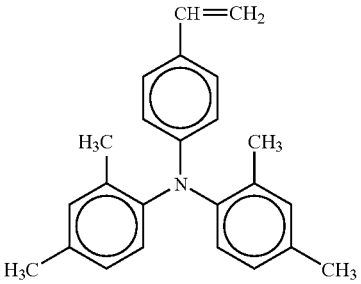
No. 150
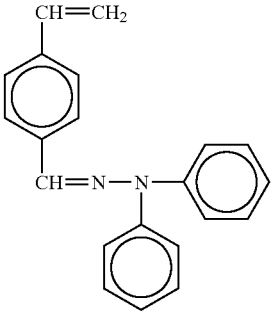
No. 151
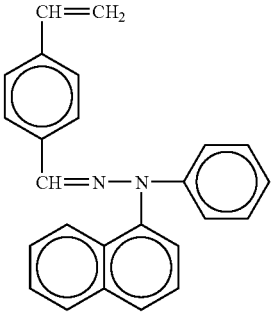
No. 152
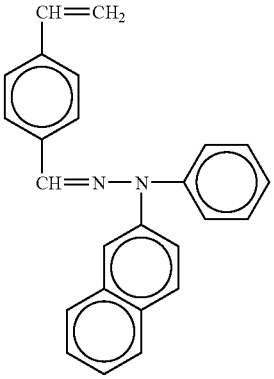
No. 153
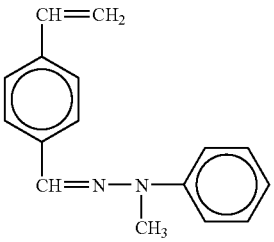

-continued
No. 154
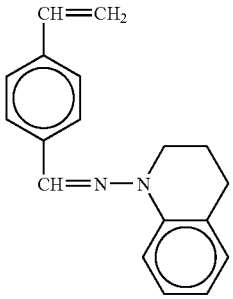
No. 155
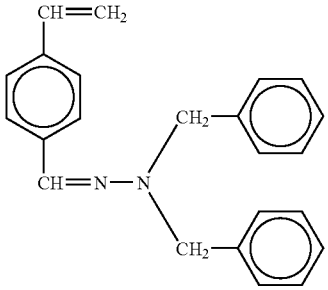
No. 156
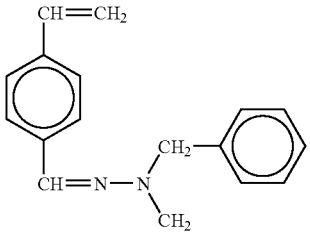
No. 157
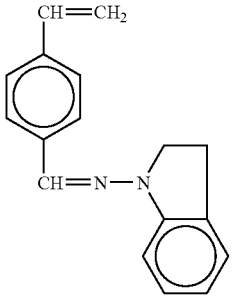
No. 158
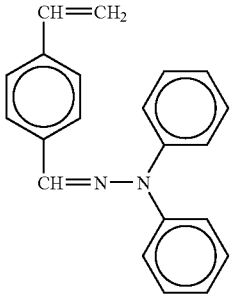
-continued
No. 159
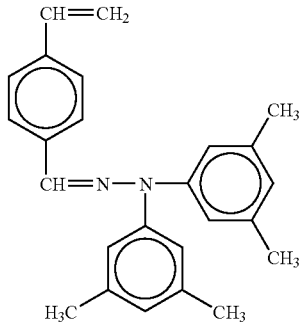
No. 160
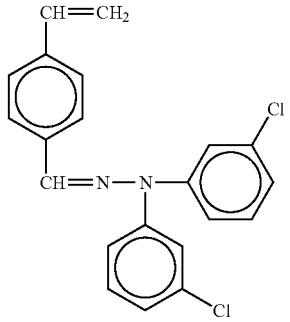
Specific examples of the radical-polymerizable compound having two functionalities and a charge transport units according to the present invention include the compounds represented by the following formulas No. 161 to No. 362, which should not be construed as limiting the scope of the present invention.
NO. 161
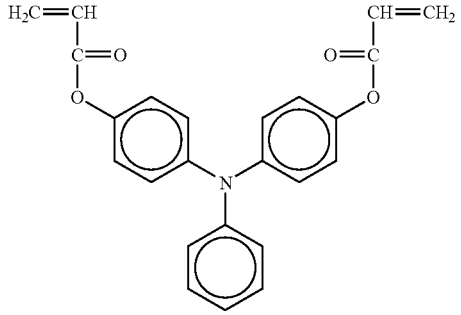
NO. 162
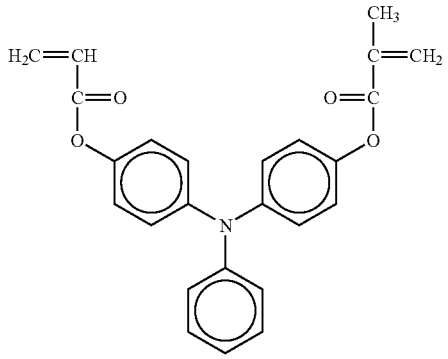

-continued
NO. 163
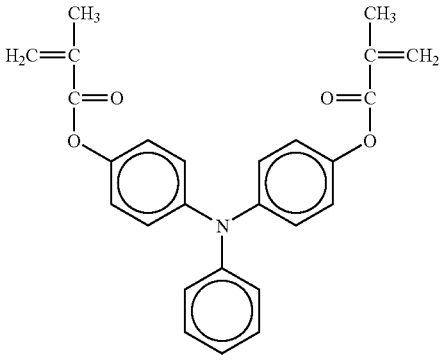
NO. 164
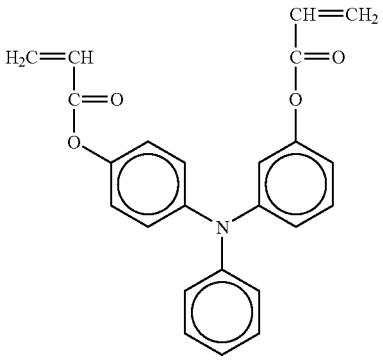
NO. 165
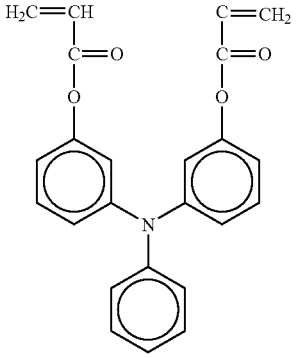
NO. 166
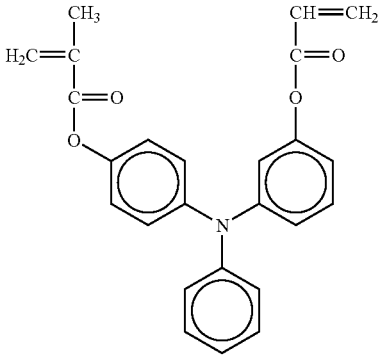
-continued
NO. 167
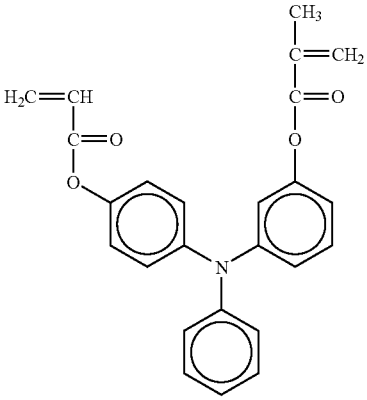
NO. 168
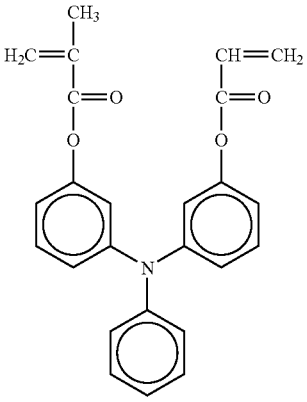
NO. 169
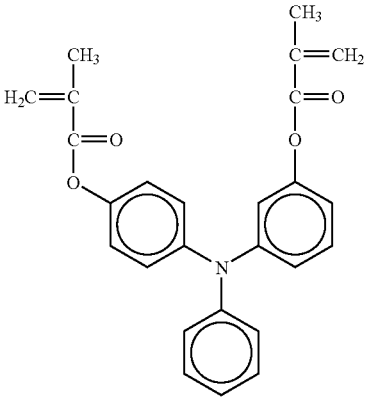
NO. 170
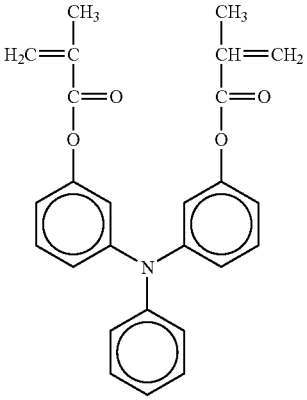

-continued
NO. 171
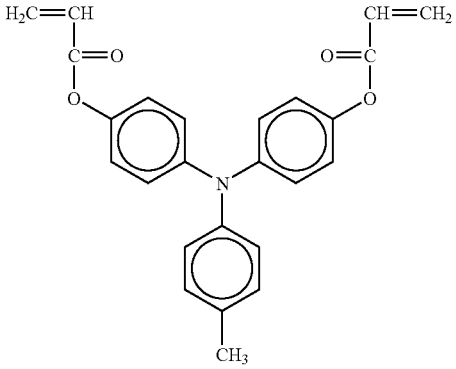
NO. 172
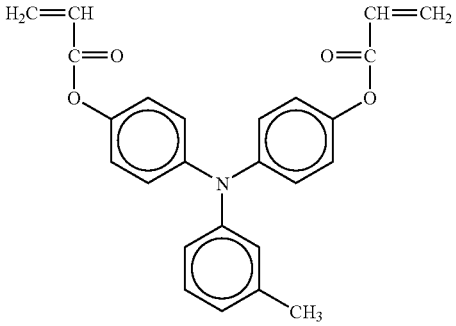
NO. 173
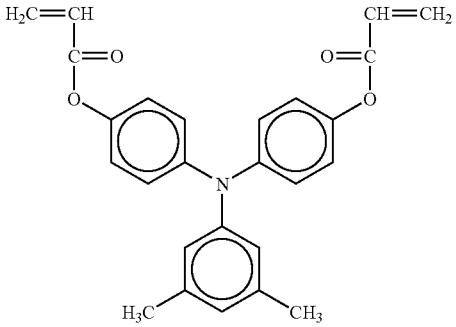
NO. 174
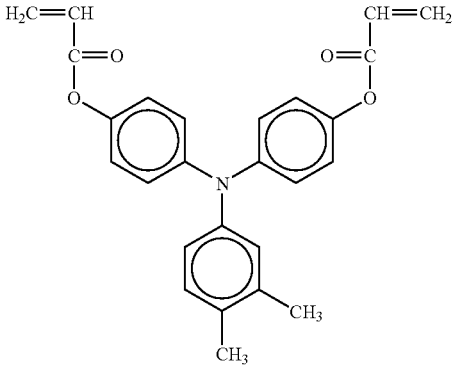
-continued
NO. 175
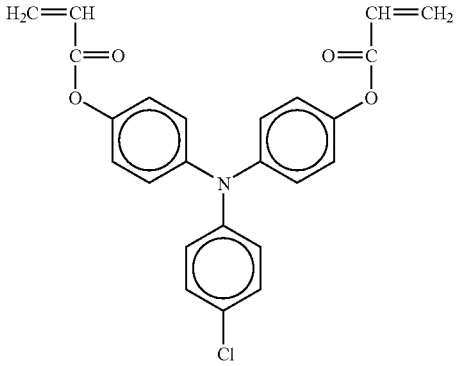
NO. 176
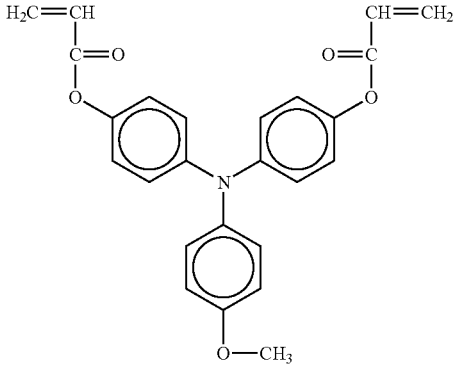
NO. 177
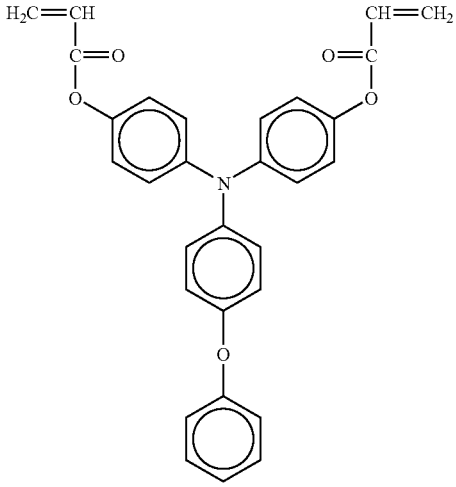

-continued
NO. 178
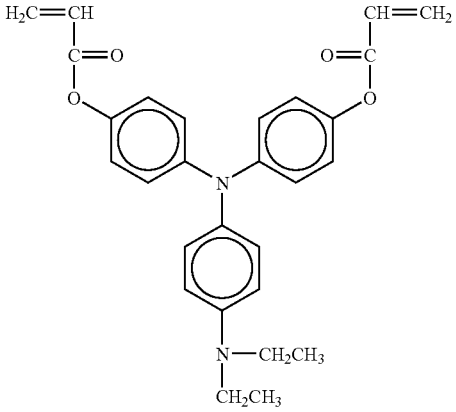
NO. 179
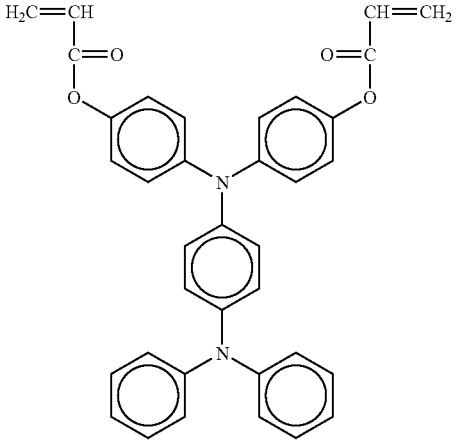
NO.180
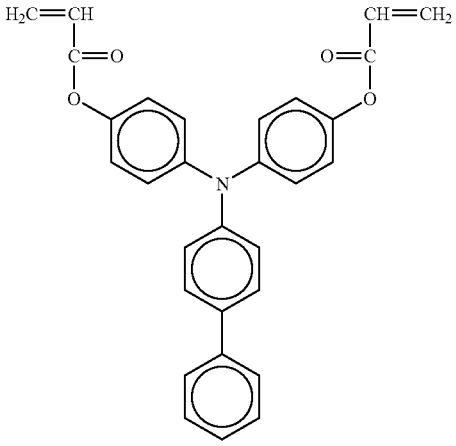
-continued
NO. 181
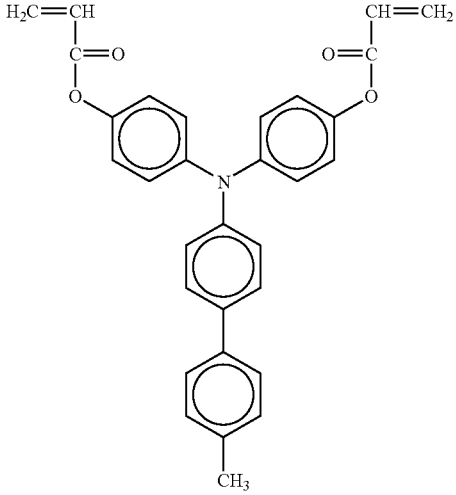
NO. 182
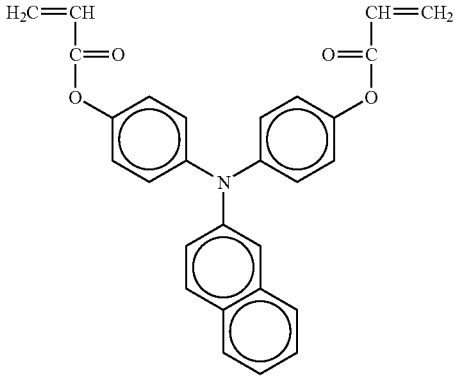
NO. 183
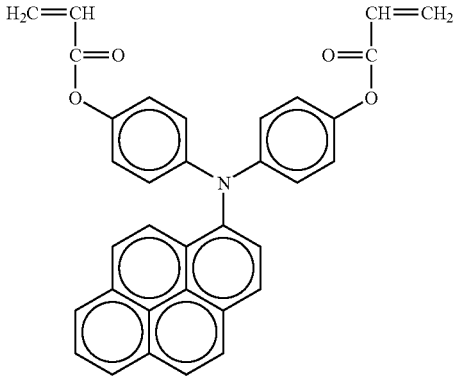

-continued
NO. 184
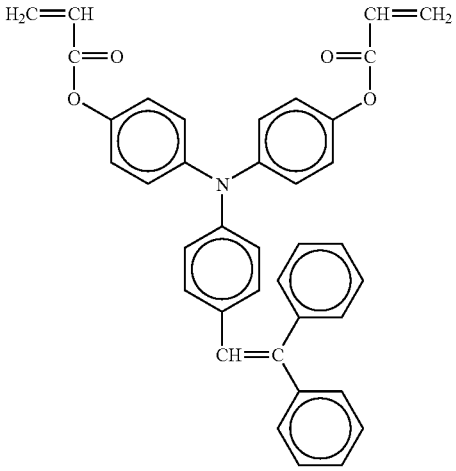
NO. 185
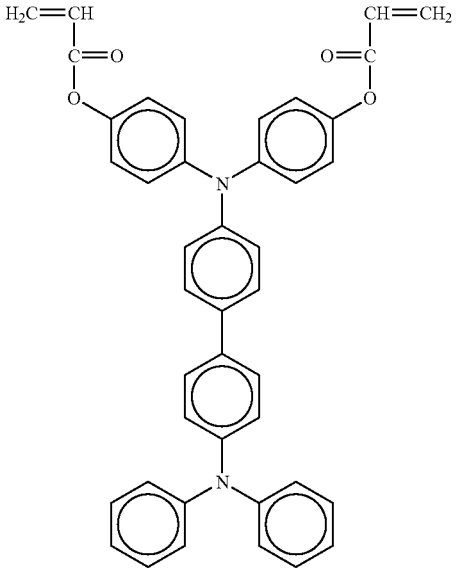
-continued
NO. 186
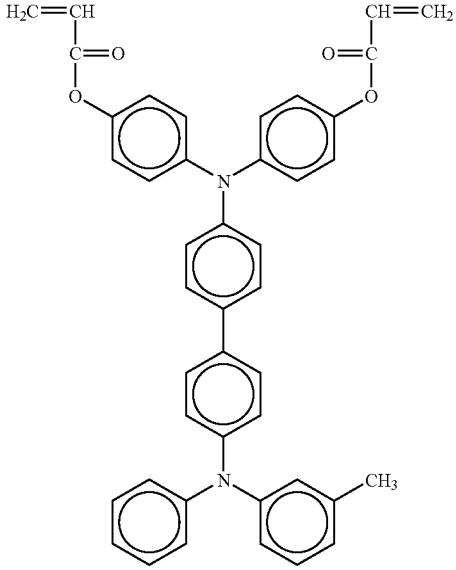
NO. 187
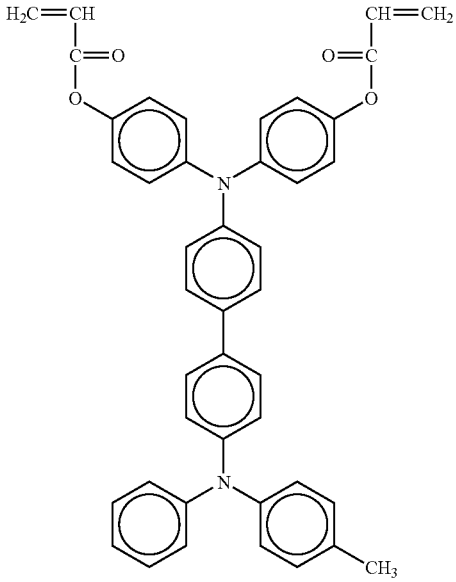
NO. 188
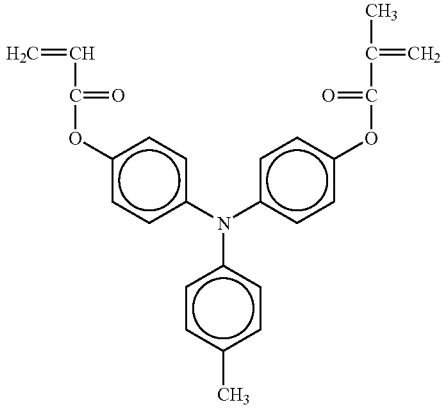

-continued
NO. 189
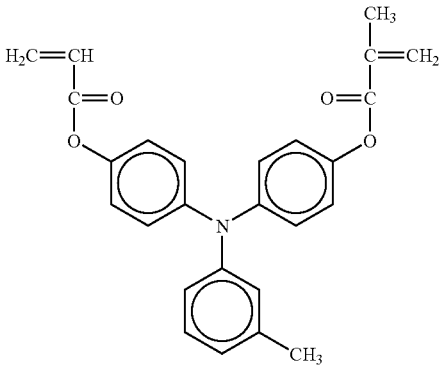
NO. 190
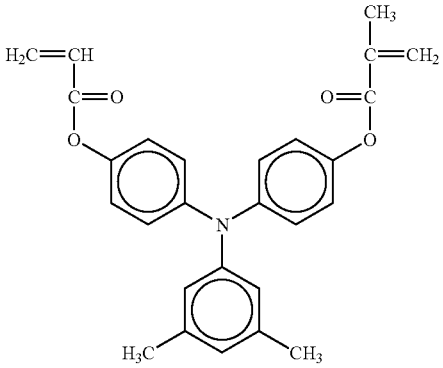
NO. 191
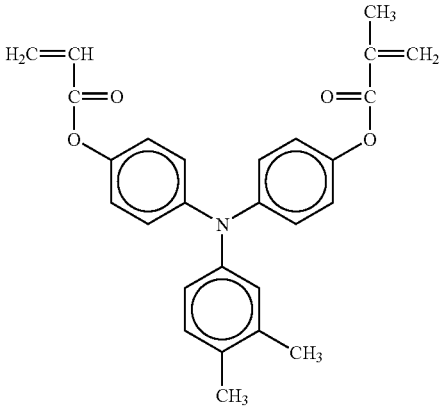
NO. 192
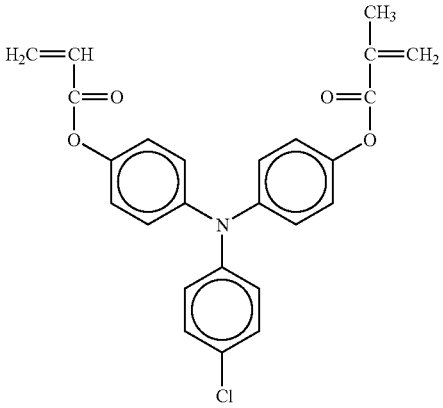
-continued
NO. 193
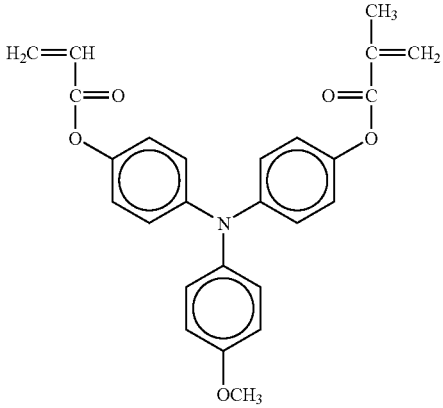
NO. 194
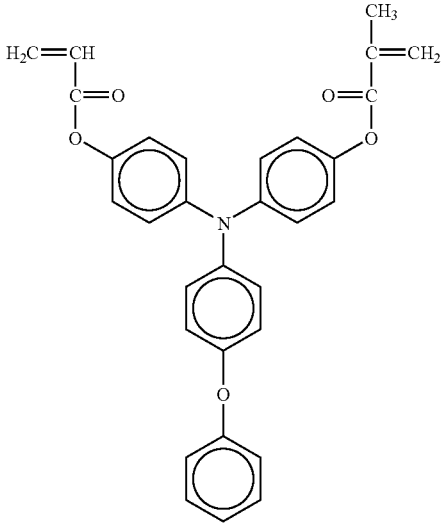
NO. 195
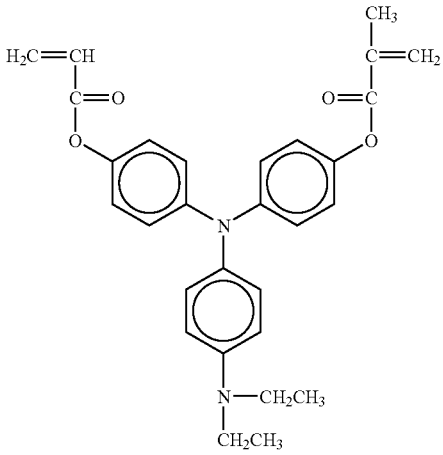

-continued
NO. 196
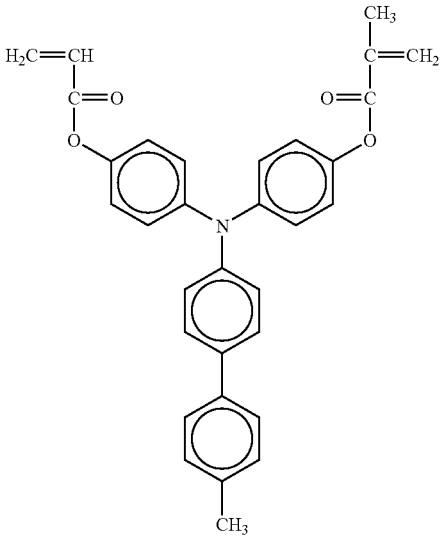
NO. 197
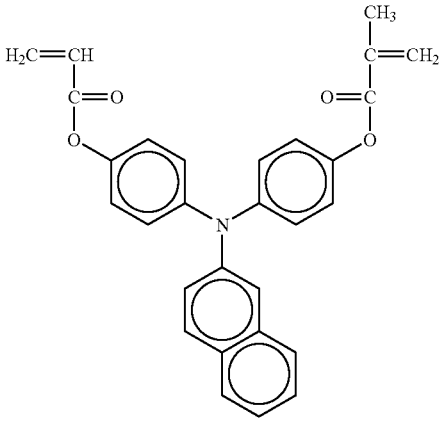
NO. 198
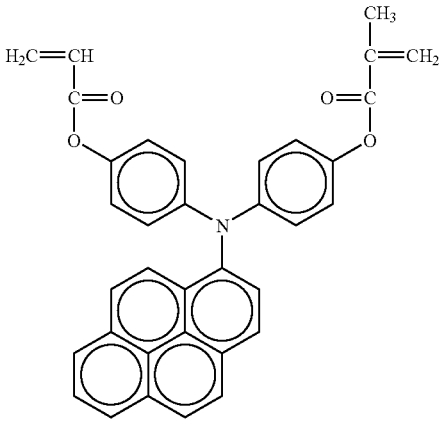
-continued
NO. 199
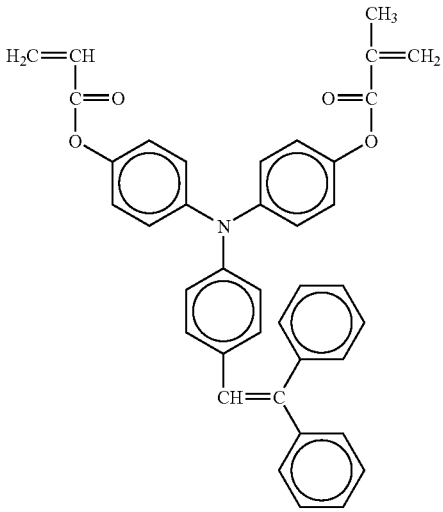
NO. 200
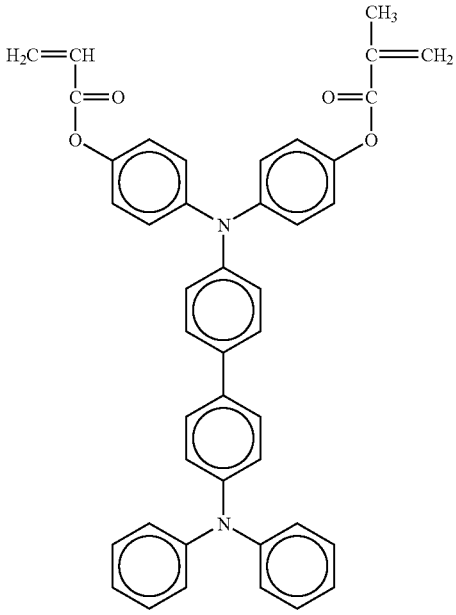

-continued
NO. 201
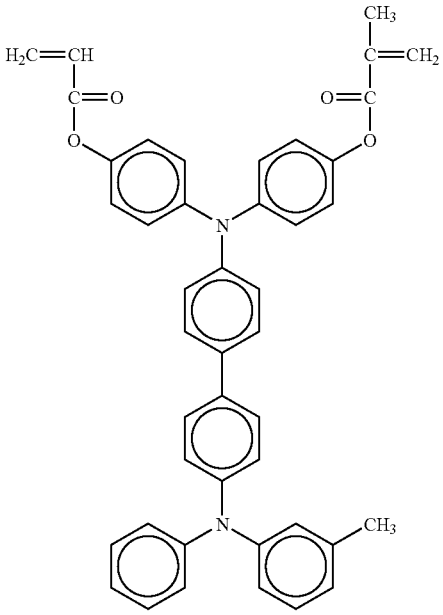
NO. 202
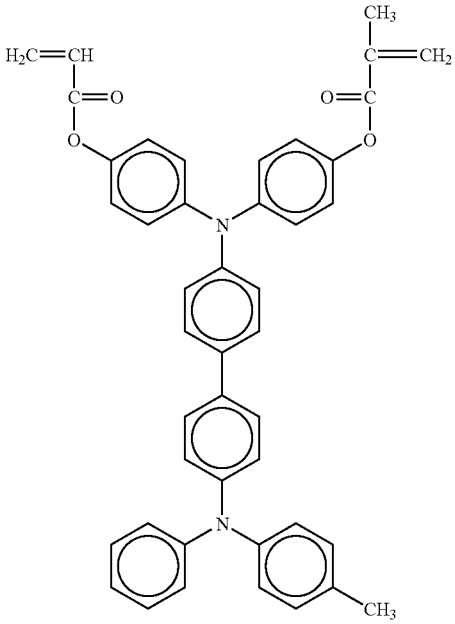
-continued
NO. 203
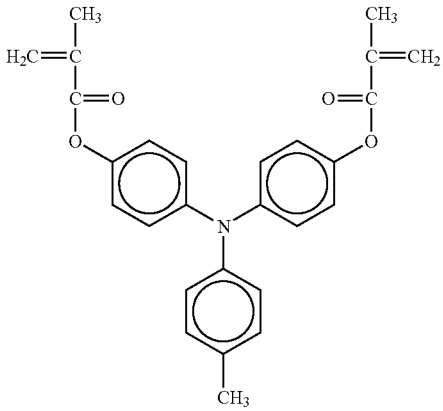
NO. 204
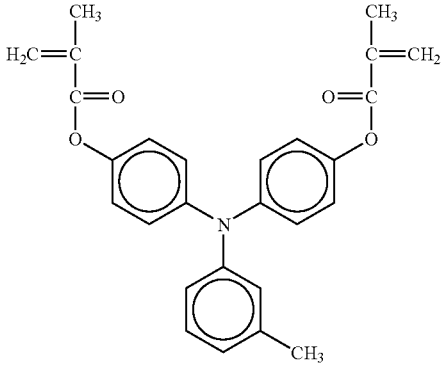
NO. 205
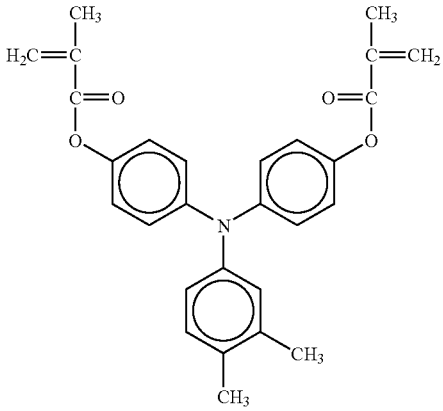
NO. 206
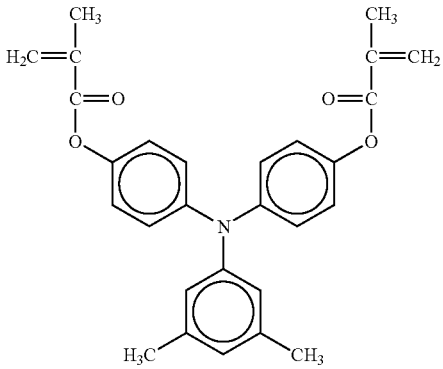

-continued
NO. 207
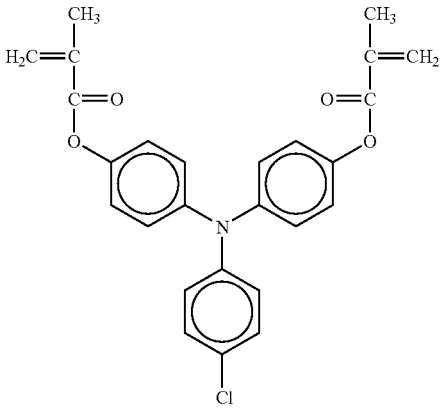
NO. 208
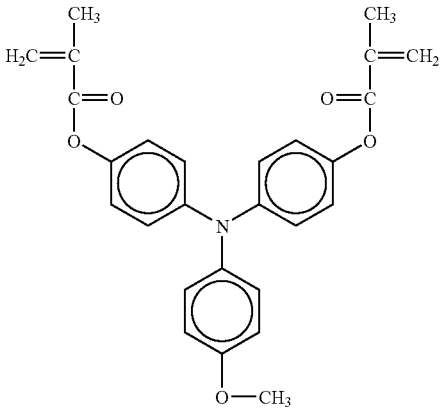
NO. 209
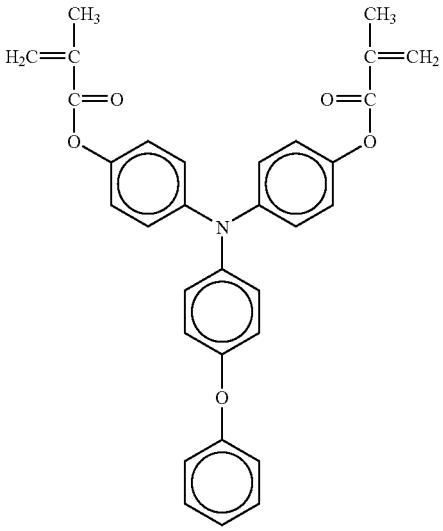
-continued
NO. 210
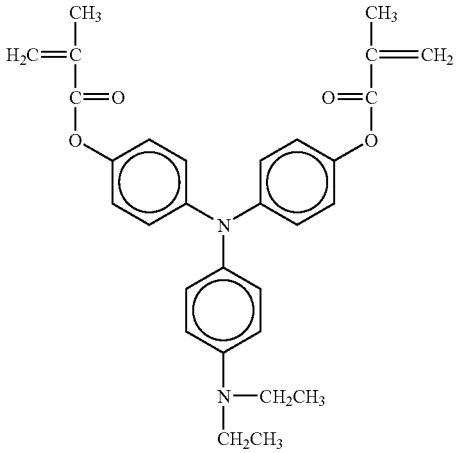
NO. 211
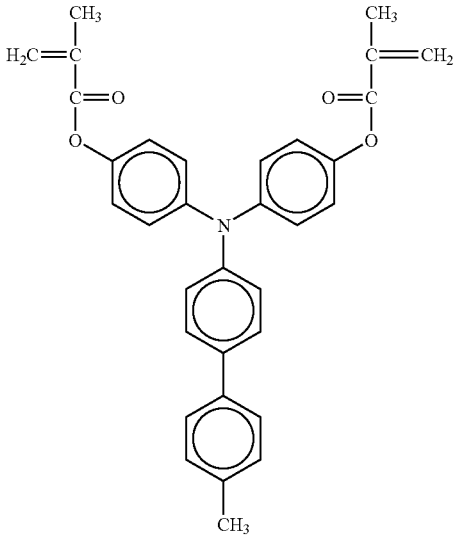
NO. 212
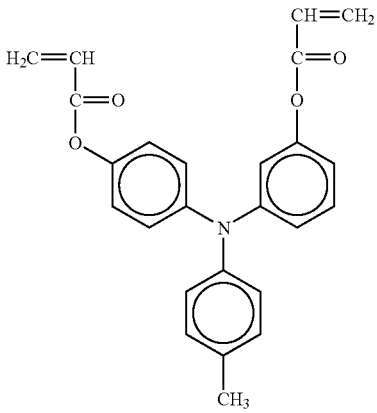

-continued
NO. 213
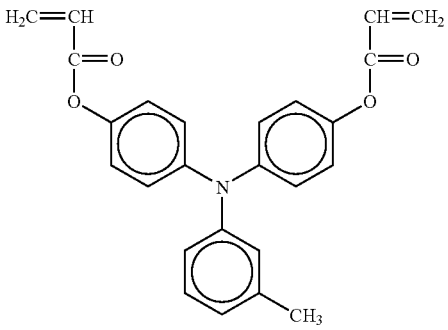
NO. 214
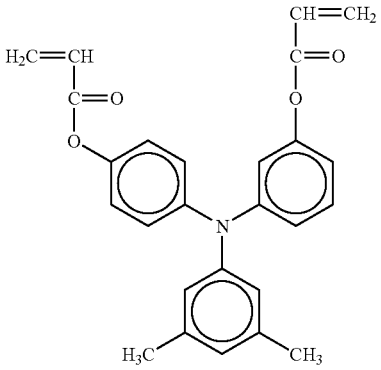
NO. 215
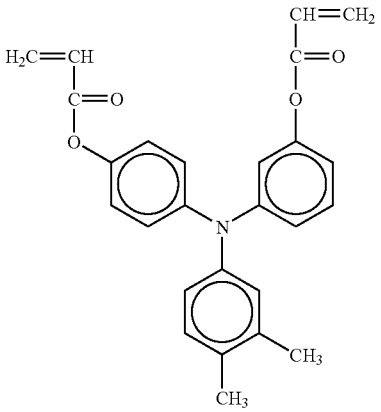
NO. 216
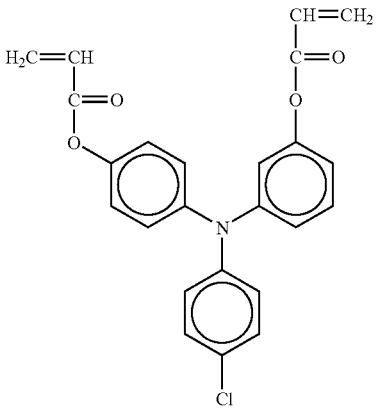
-continued
NO. 217
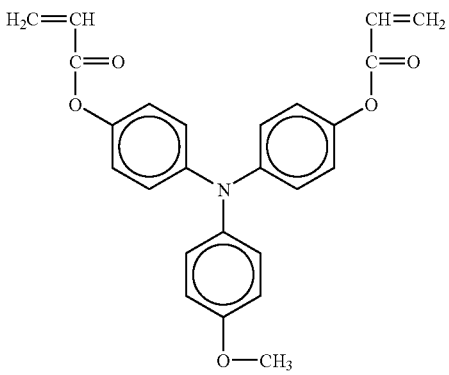
NO. 218
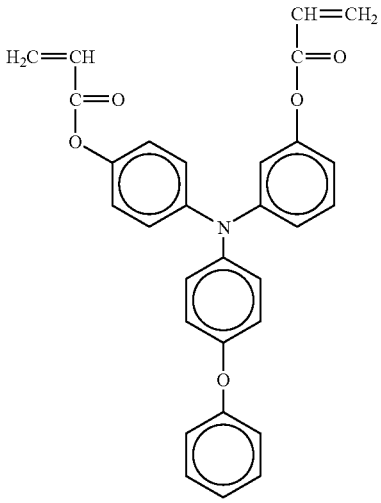
NO. 219
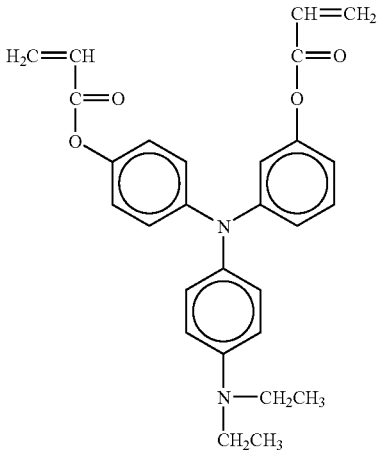

-continued
NO. 220
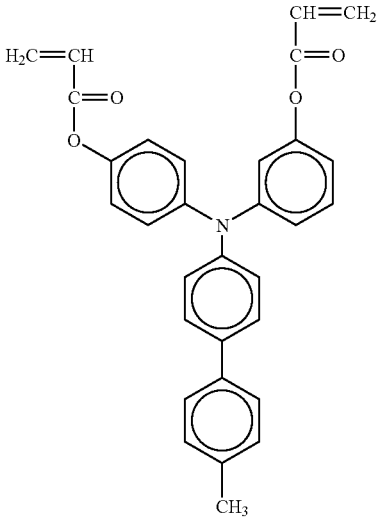
NO. 221
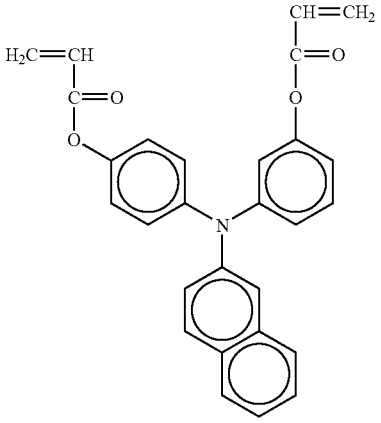
NO. 222
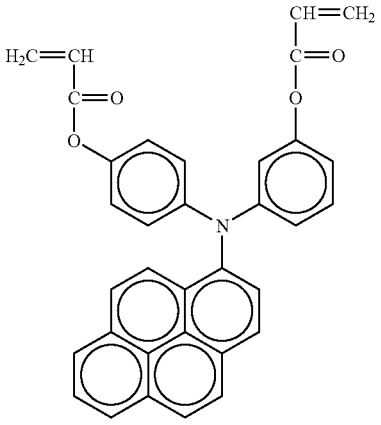
-continued
NO.223
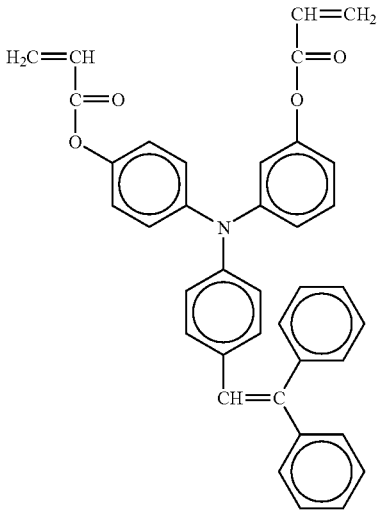
NO. 224
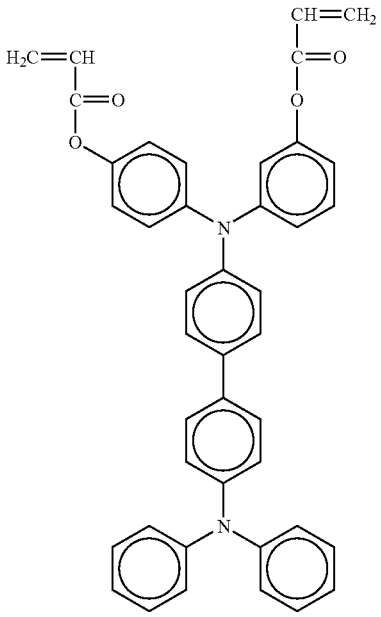

-continued
NO. 225
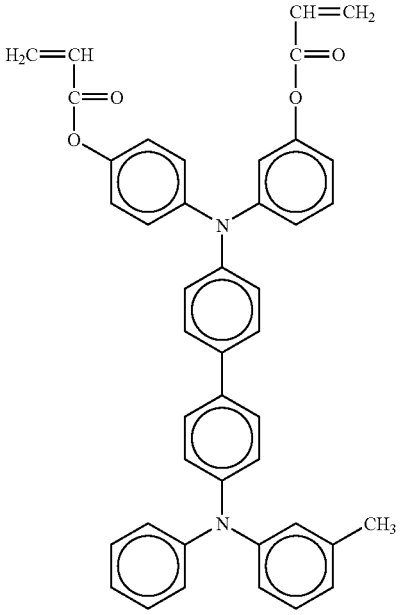
NO. 226
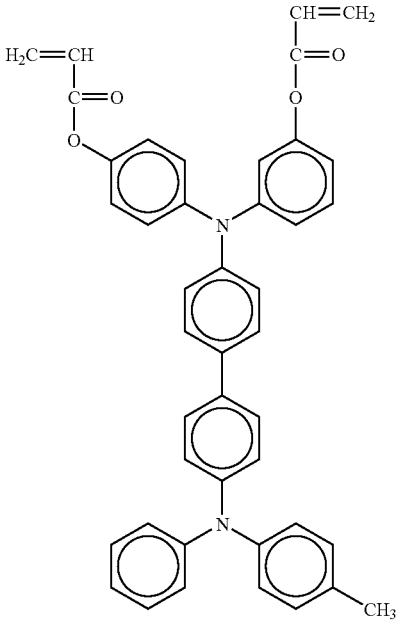
NO. 227
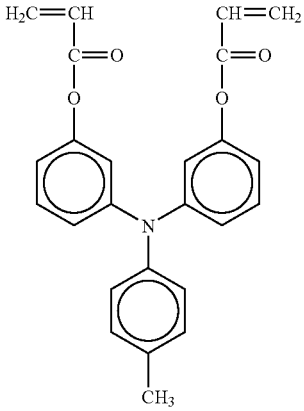
-continued
NO. 228
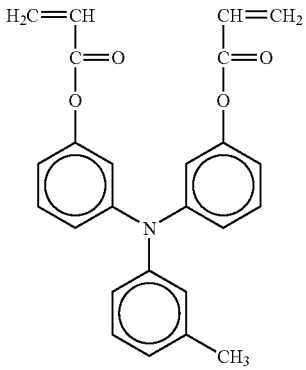
NO. 229
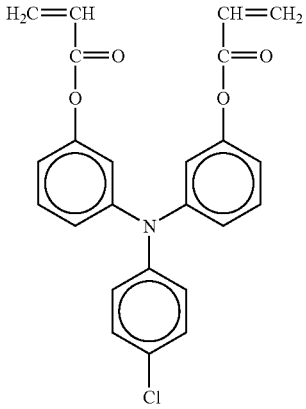
NO. 230
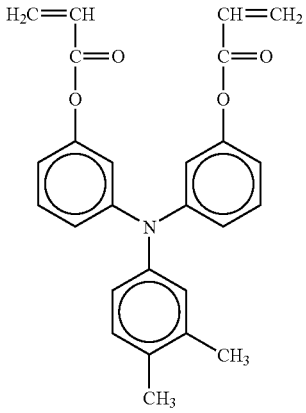
NO. 231
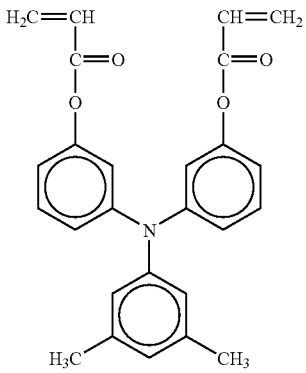

-continued
NO. 232
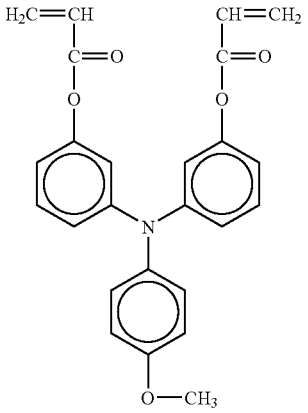
NO. 233
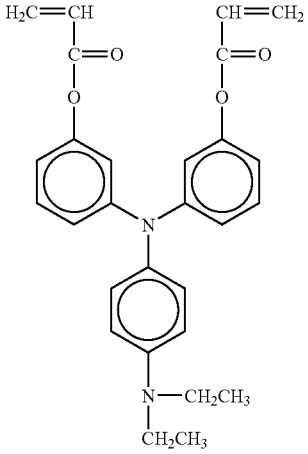
NO. 234
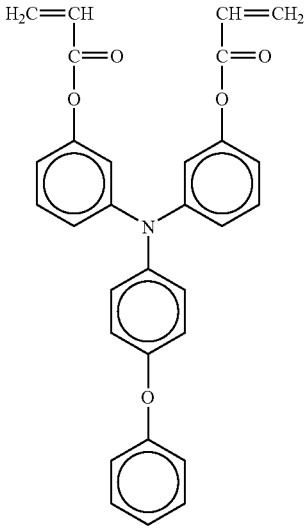
-continued
NO. 235
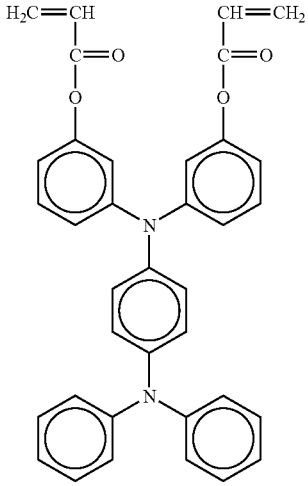
NO. 236
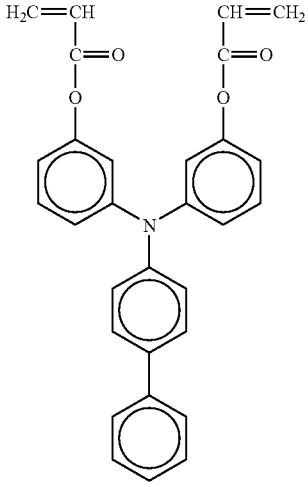
NO. 237
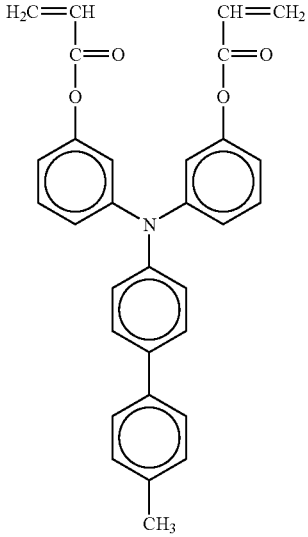

-continued
NO. 238
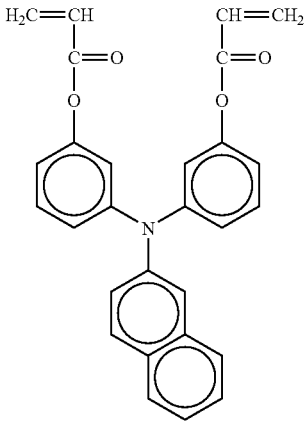
NO. 239
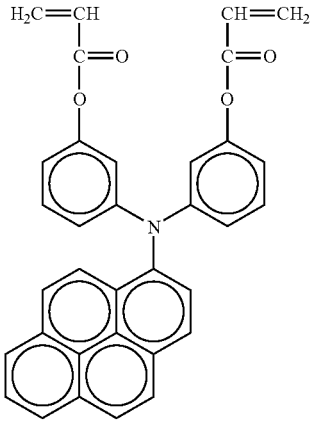
NO. 240
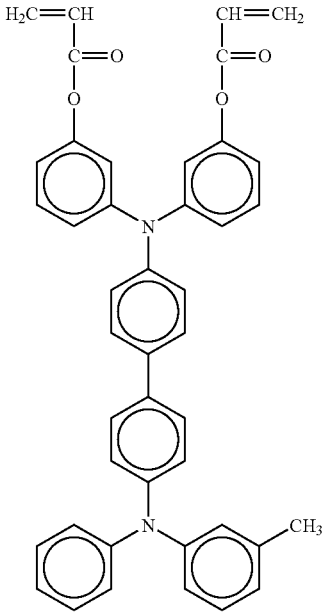
-continued
NO. 241
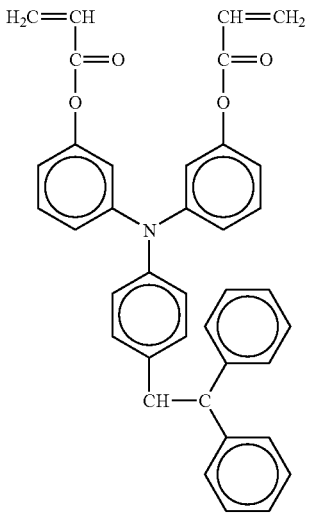
NO. 242
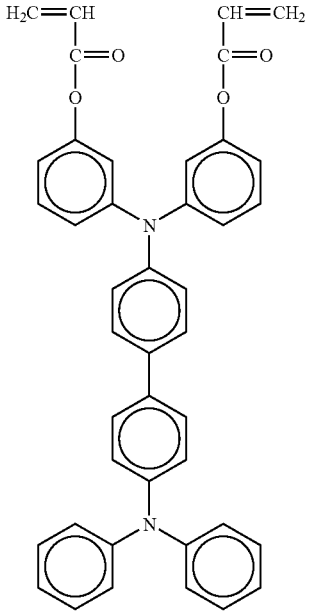

-continued
NO. 243
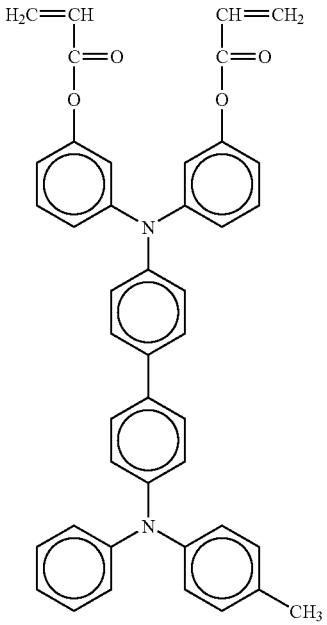
NO. 244
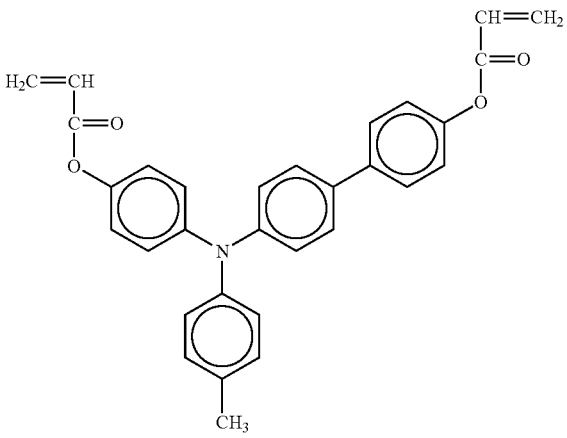
NO. 245
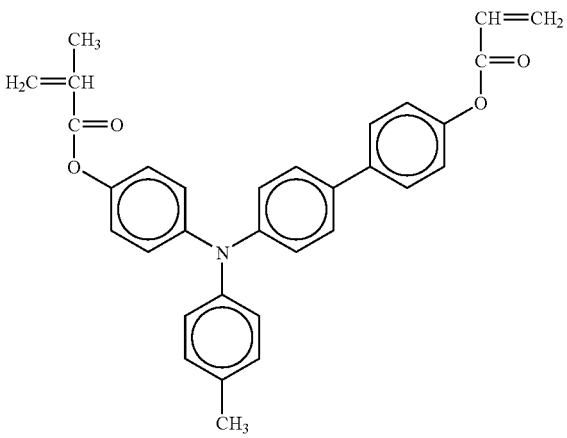
-continued
NO. 246
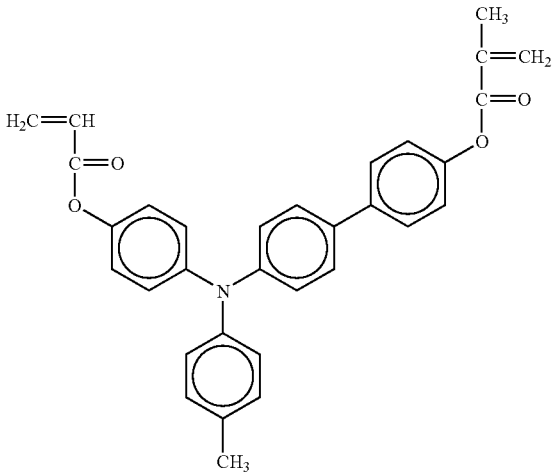
NO. 247
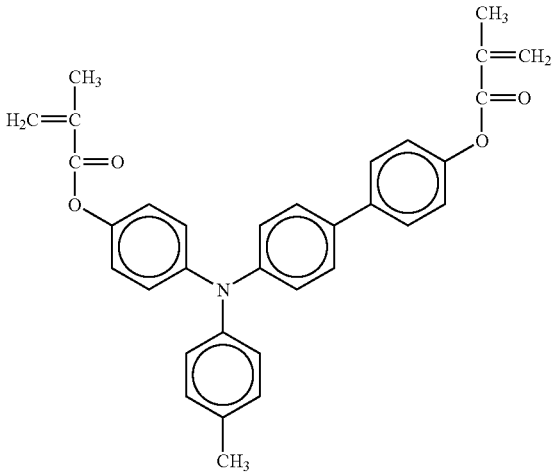
NO. 248
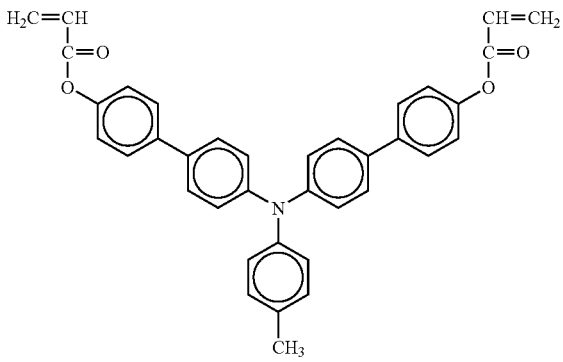

-continued
NO. 249
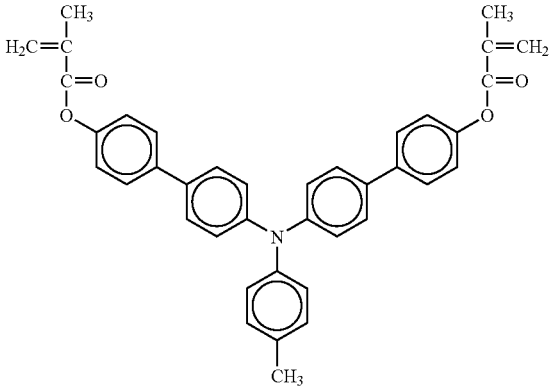
NO. 250
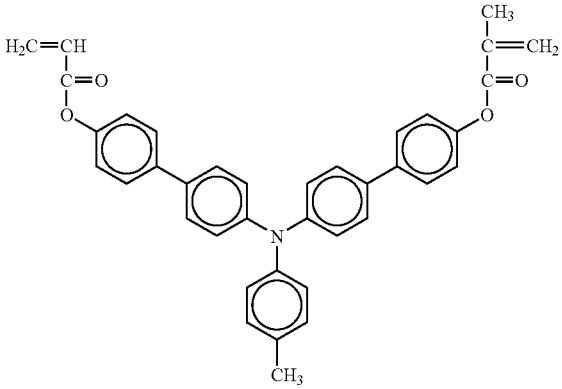
NO. 251
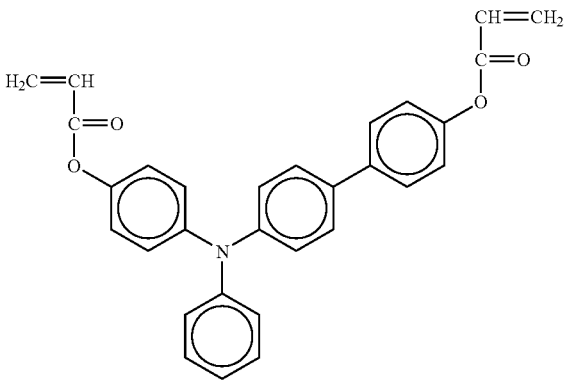
-continued
NO. 252
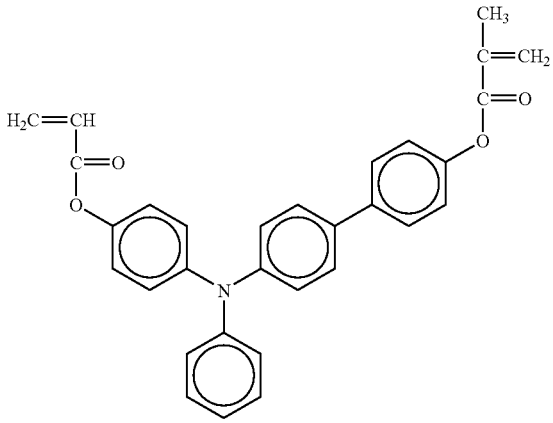
NO. 253
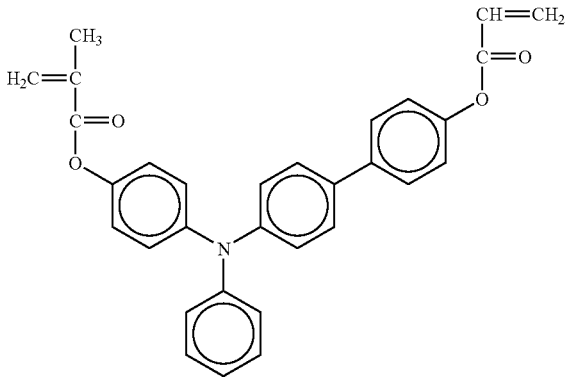
NO. 254
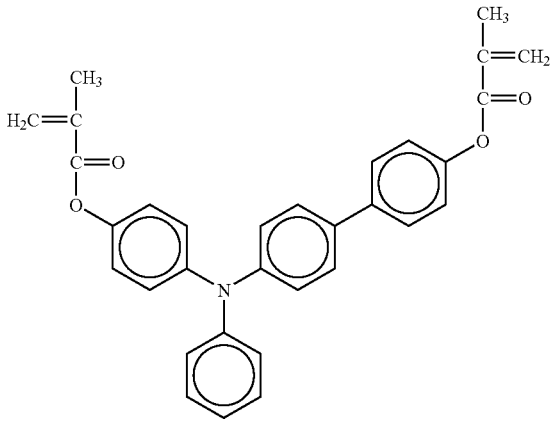
NO. 255
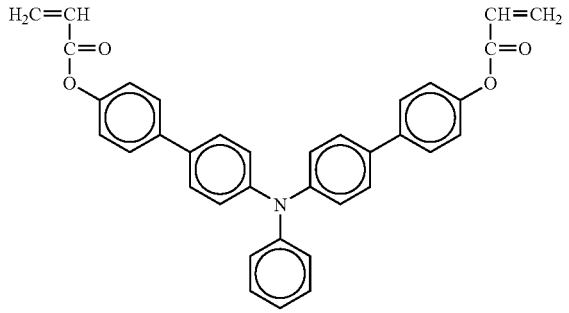

-continued
NO. 256
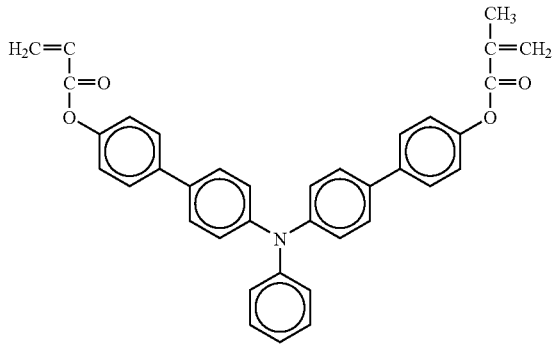
NO. 257
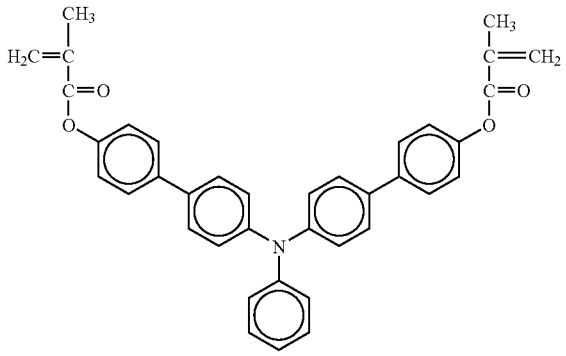
NO. 58
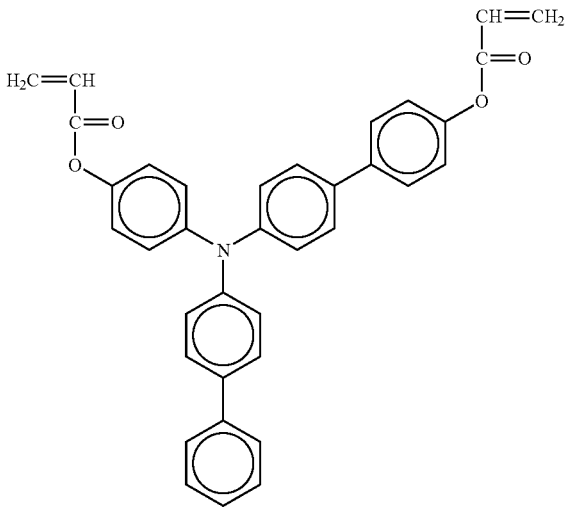
-continued
NO. 259
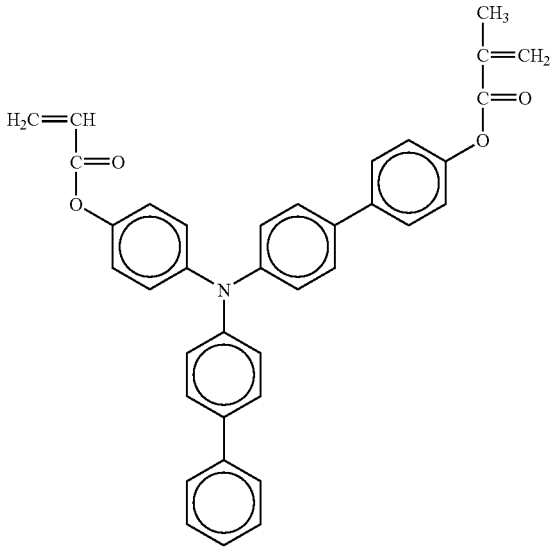
NO. 260
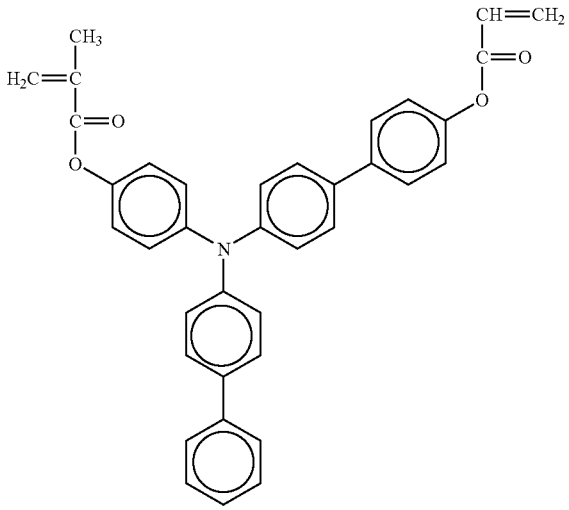

-continued
NO. 261
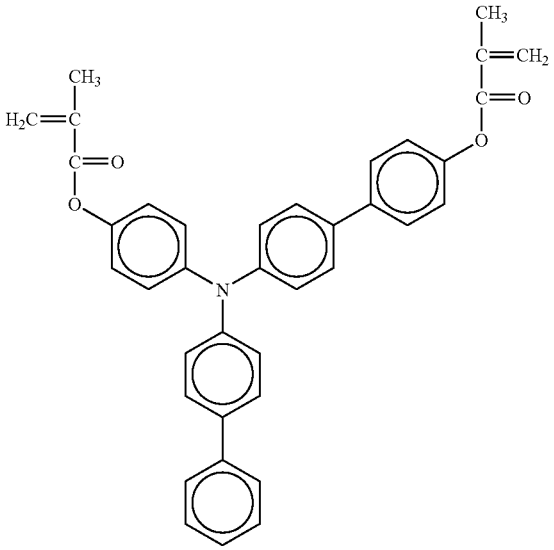
NO. 262
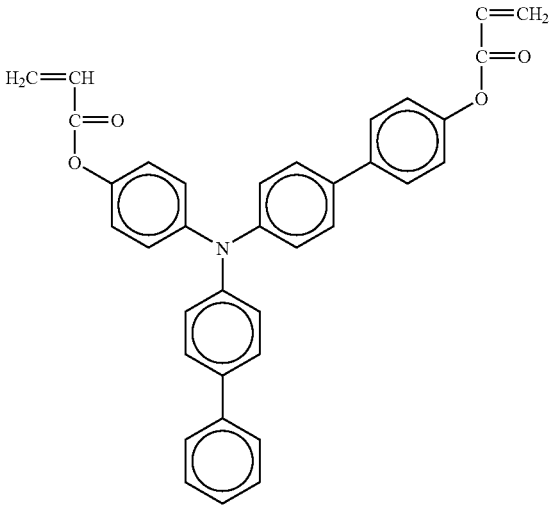
-continued
NO. 263
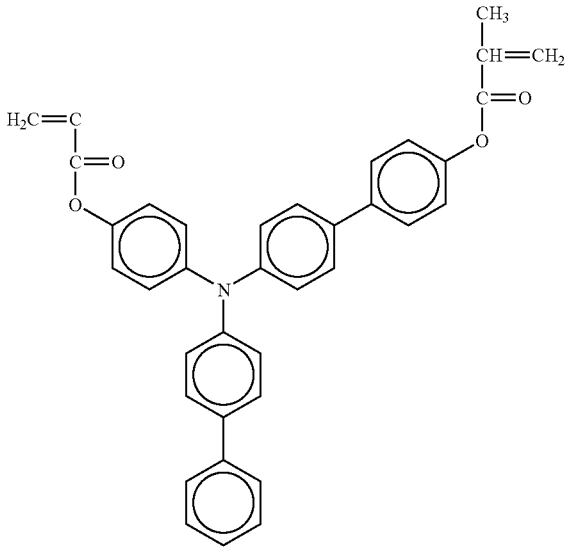
NO. 264
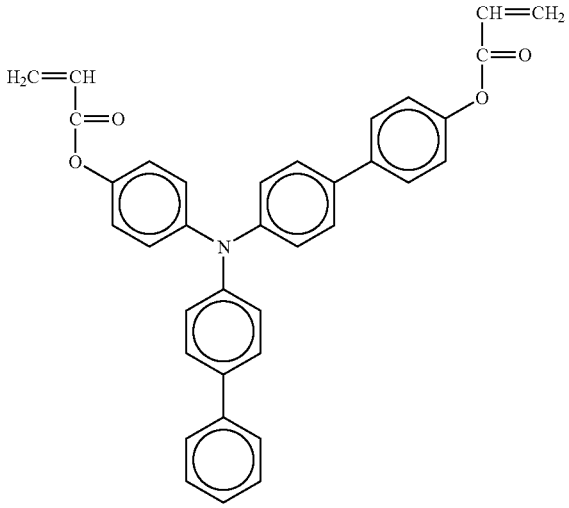
NO. 265
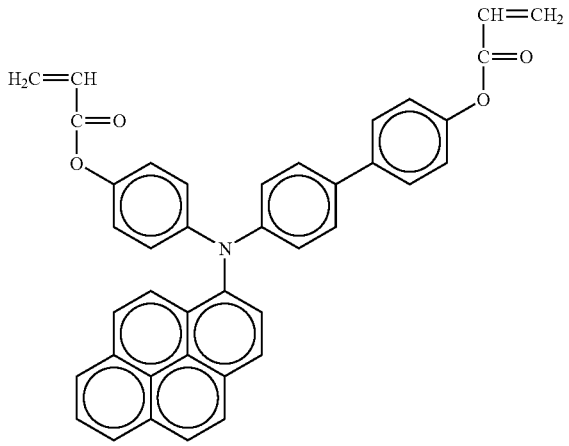

-continued
NO. 266
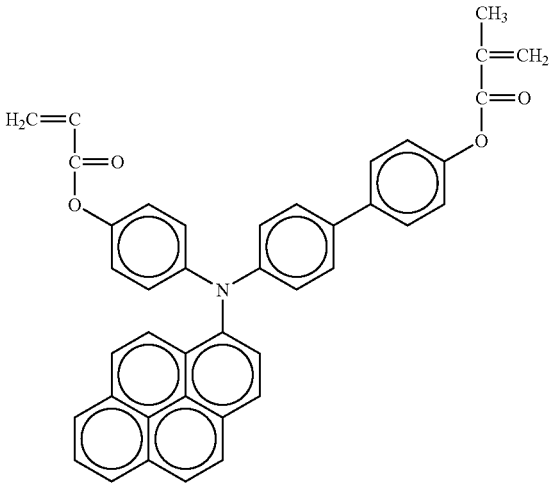
NO. 267
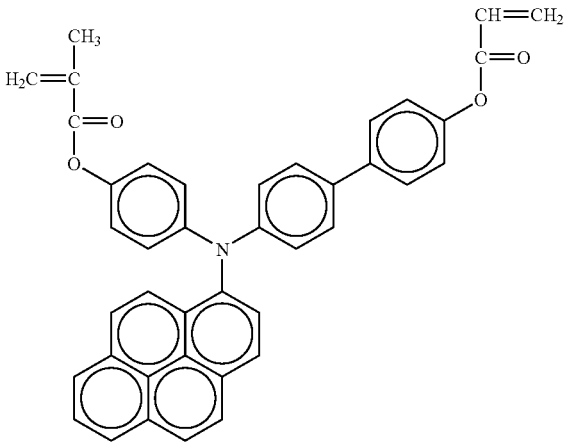
NO. 268
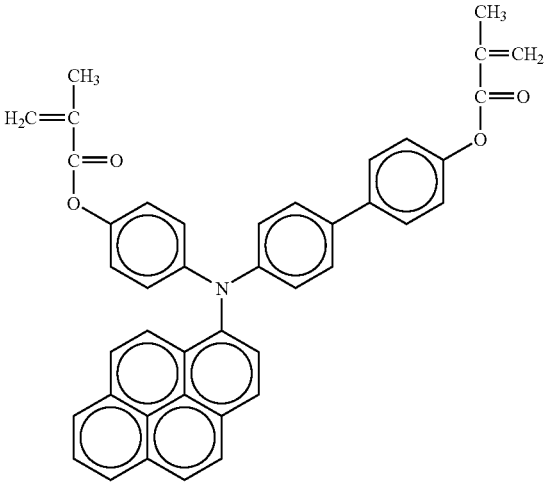
-continued
NO. 269
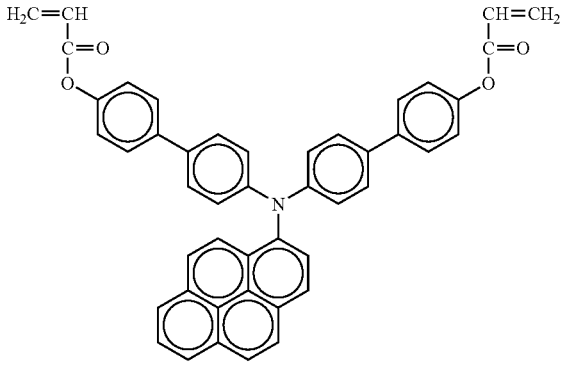
NO. 270
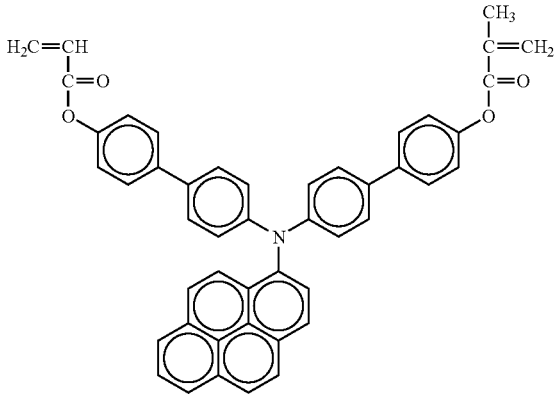
NO. 271
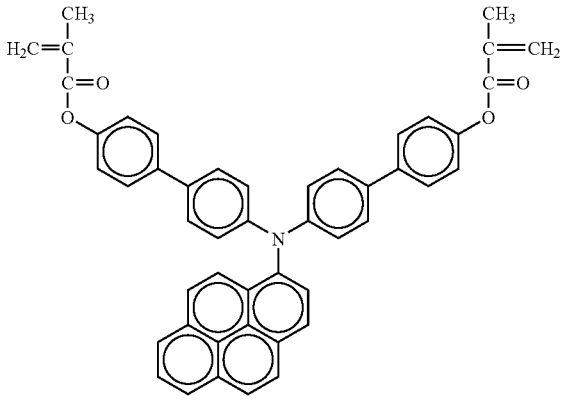

-continued
NO. 272
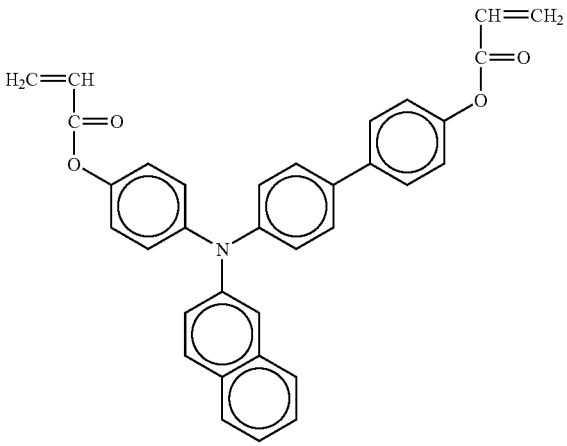
NO. 273
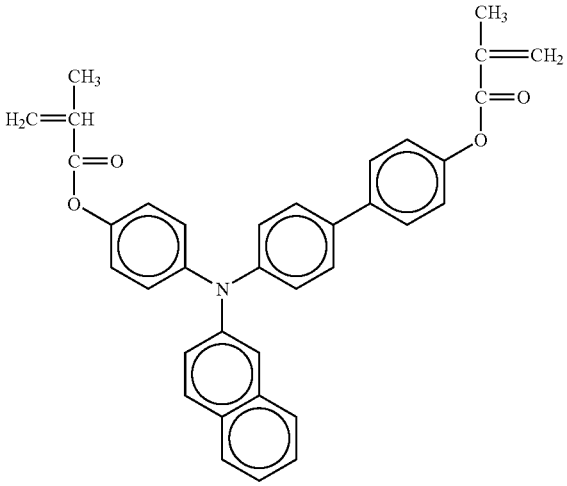
NO. 274
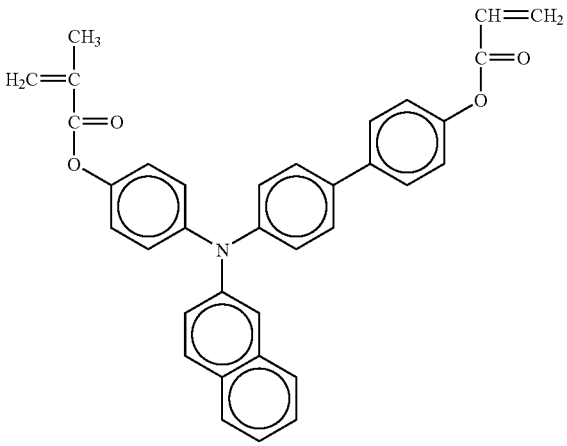
-continued
NO. 275
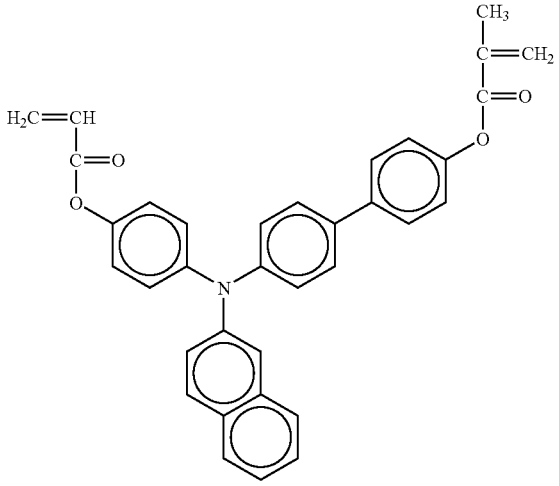
NO. 276
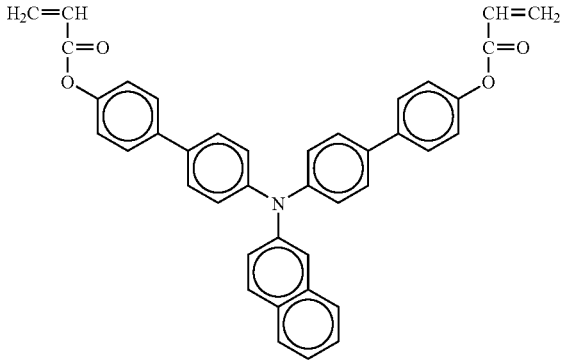
NO. 277
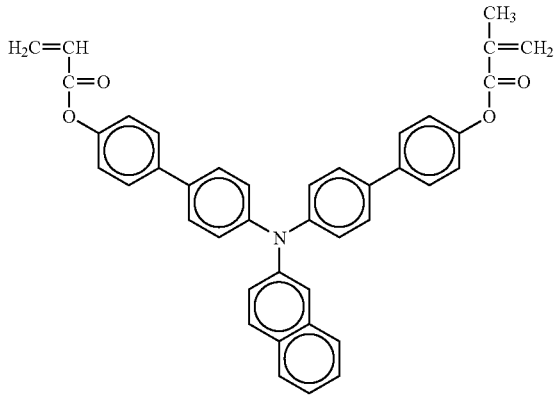

-continued
NO. 278
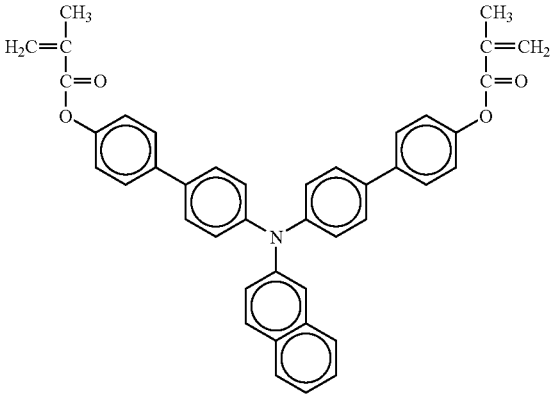
NO. 279
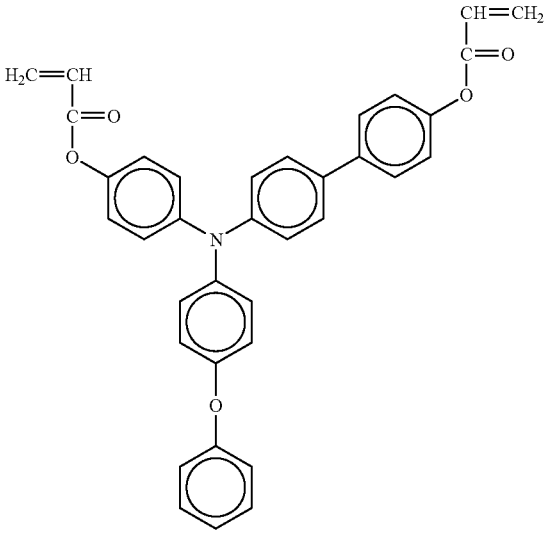
NO. 280
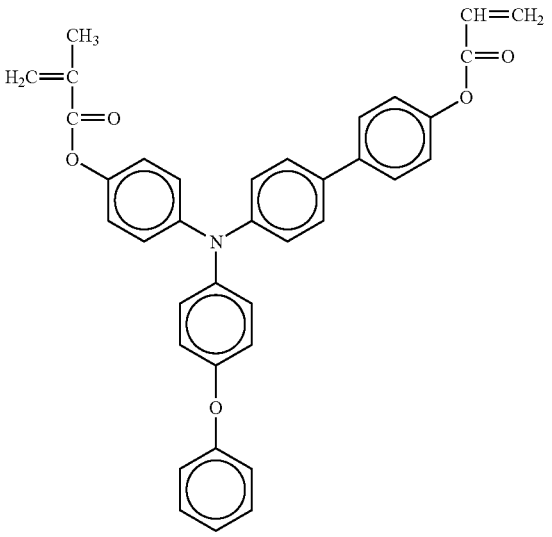
-continued
NO. 281
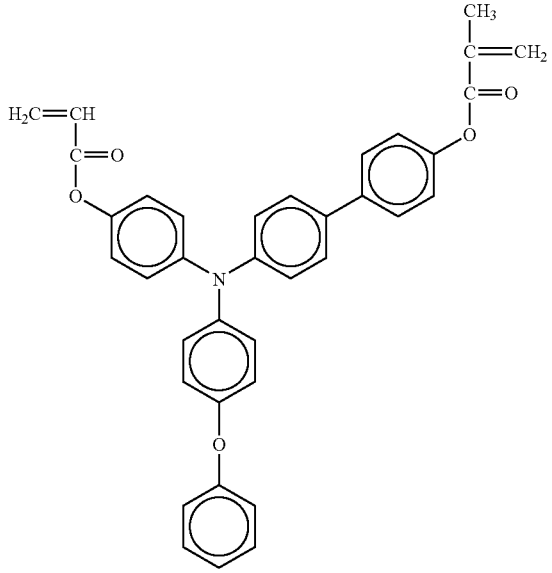
NO. 282
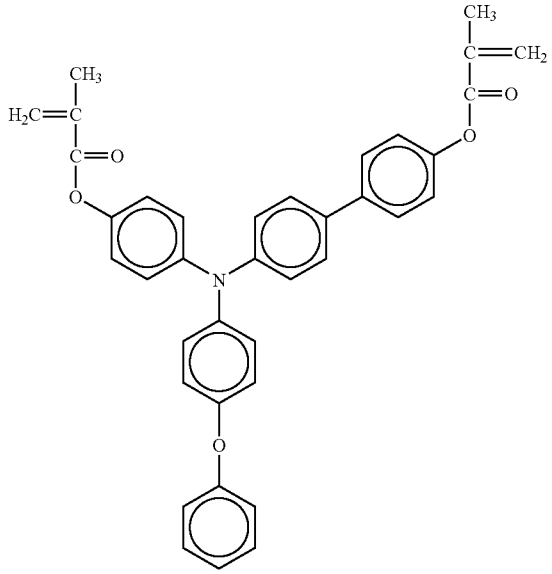

-continued
NO. 283
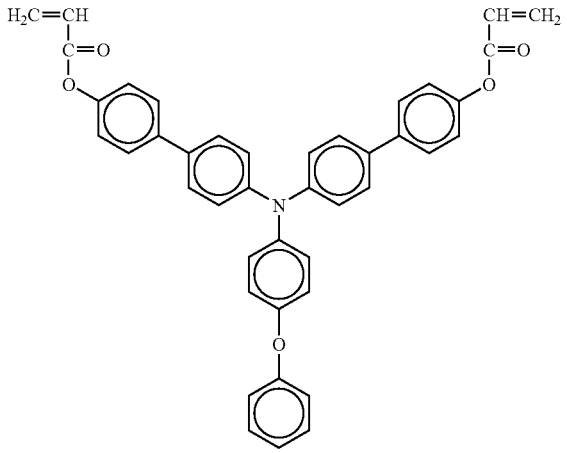
NO. 284
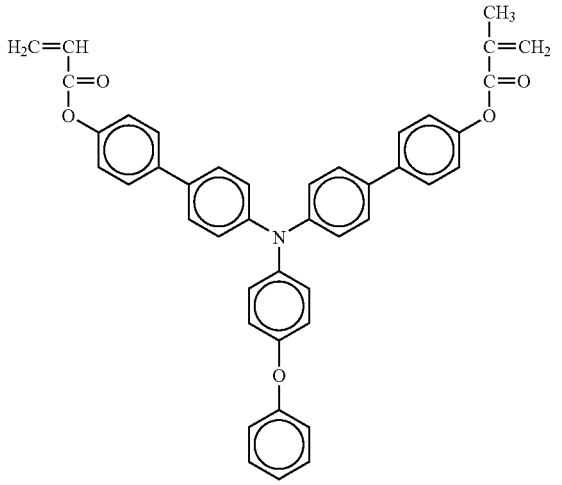
NO. 285
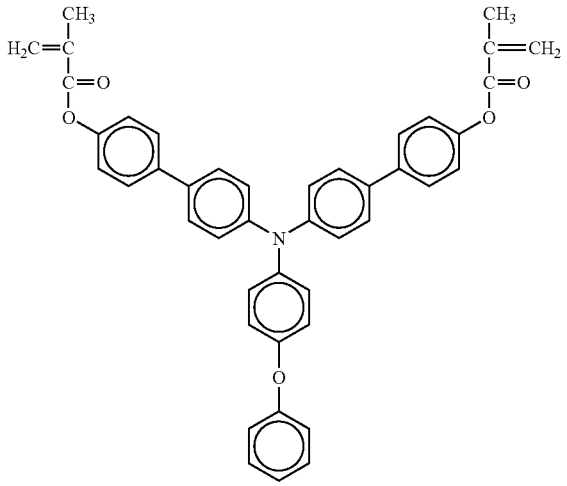
-continued
NO. 286
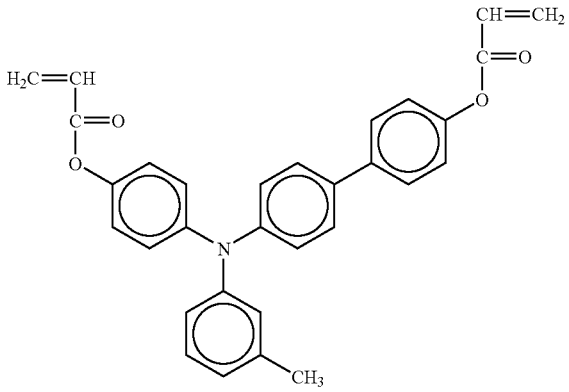
NO. 287
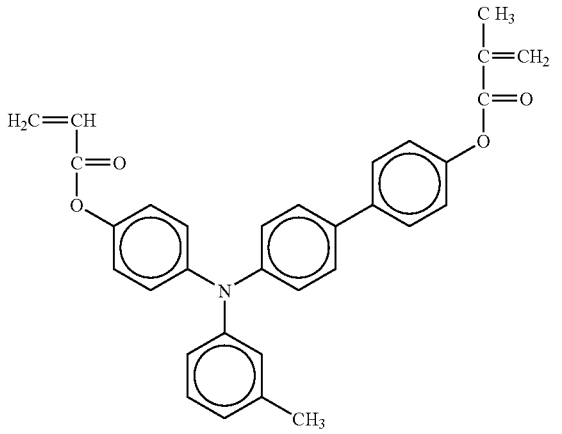
NO. 288
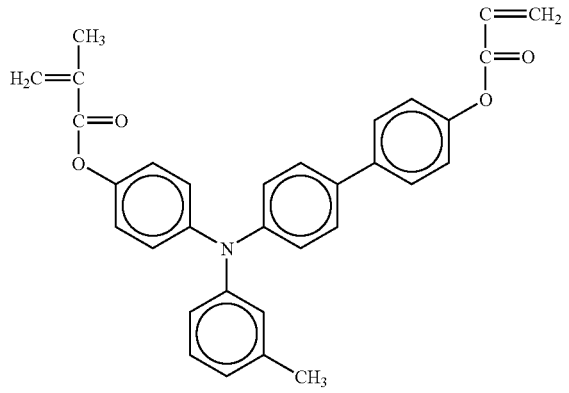

-continued
NO. 289
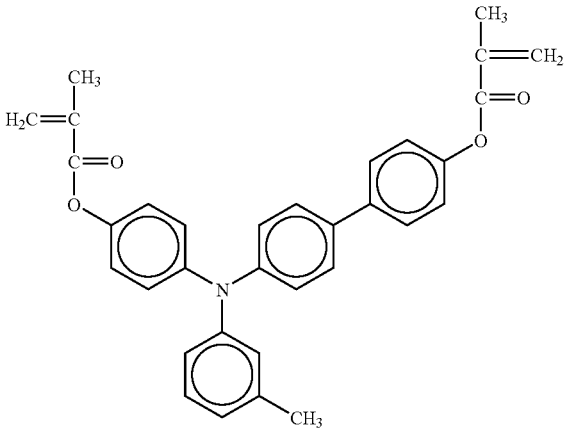
NO. 290
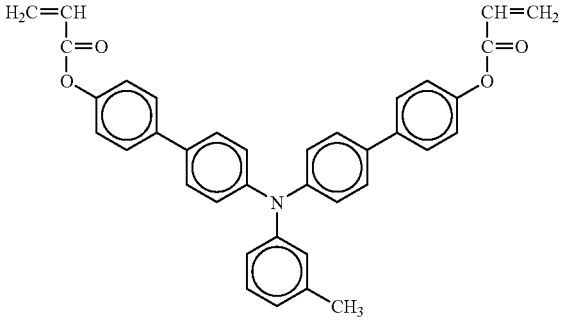
NO. 291
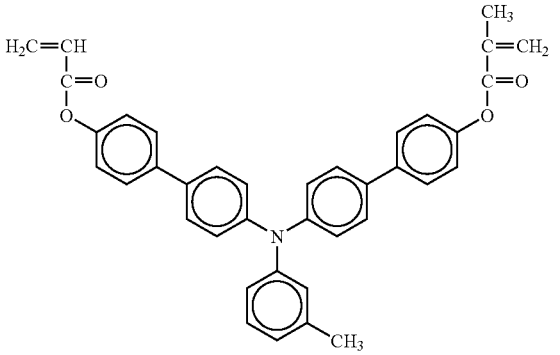
NO. 292
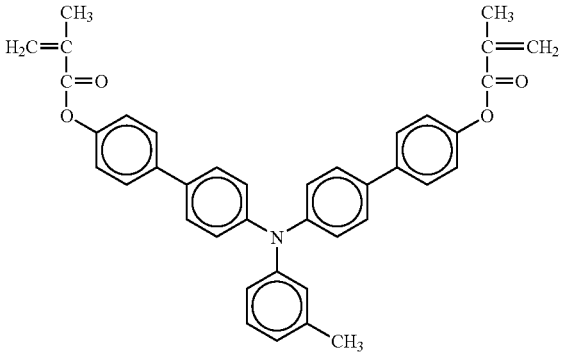
-continued
NO. 293
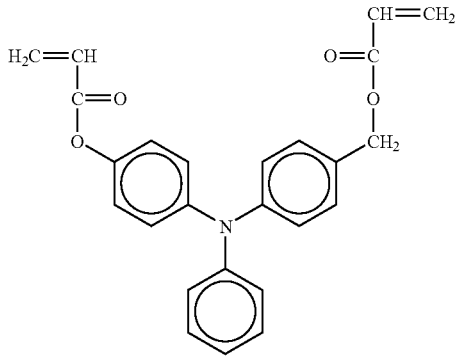
NO. 294
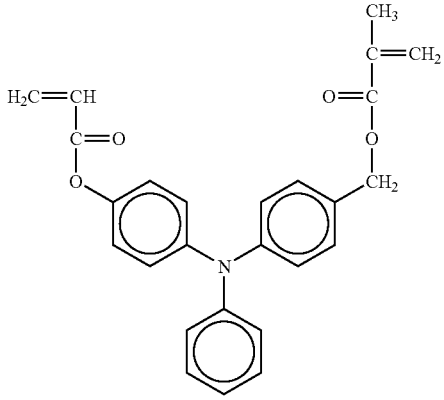
NO. 295
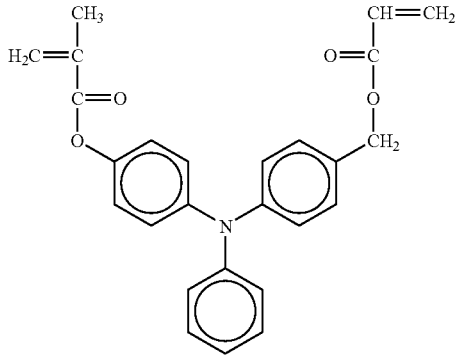
NO. 296
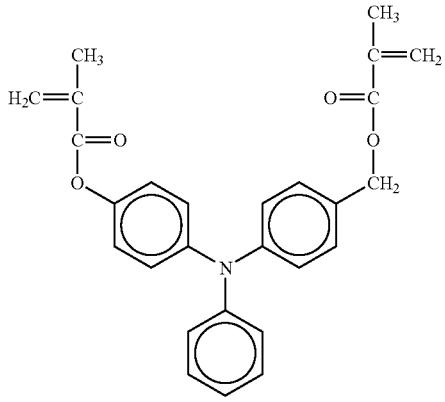

-continued
NO. 297
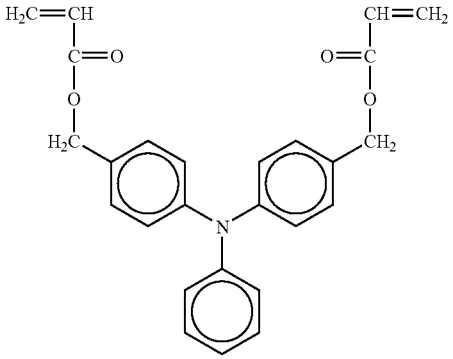
NO. 298
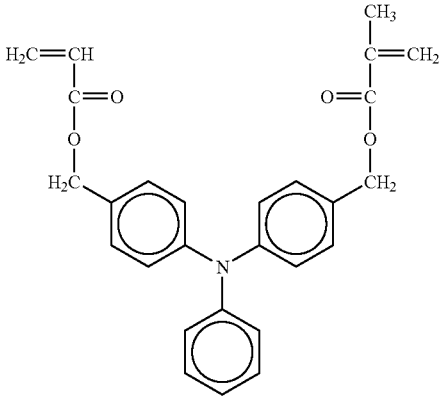
NO. 299
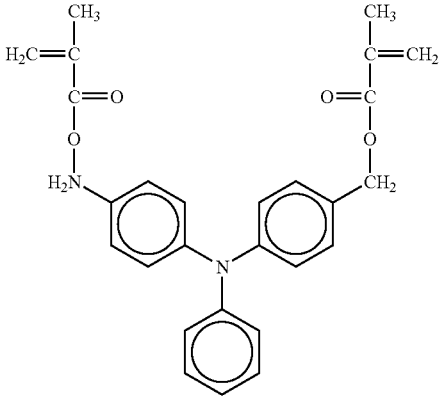
NO. 300
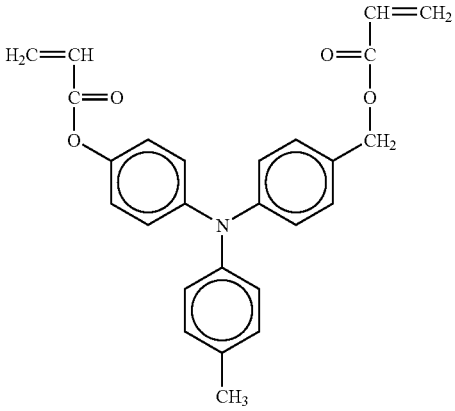
-continued
NO. 301
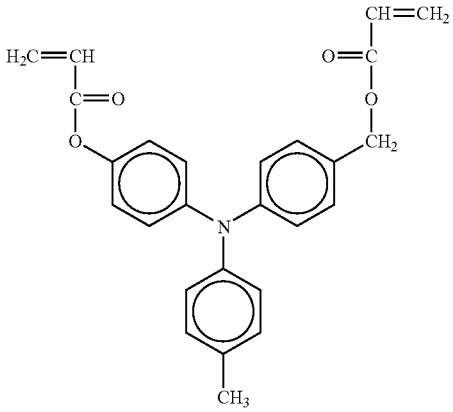
NO. 302
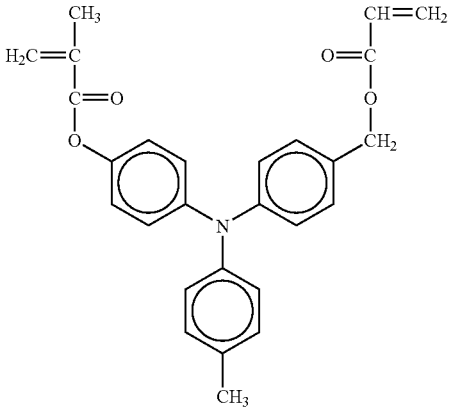
NO. 303
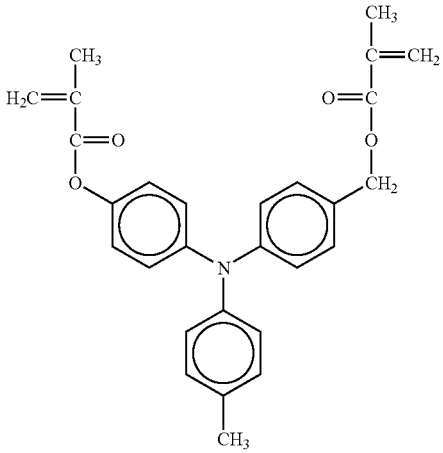

-continued
NO. 304
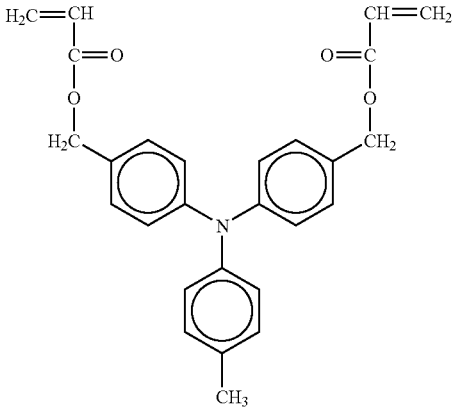
NO. 305
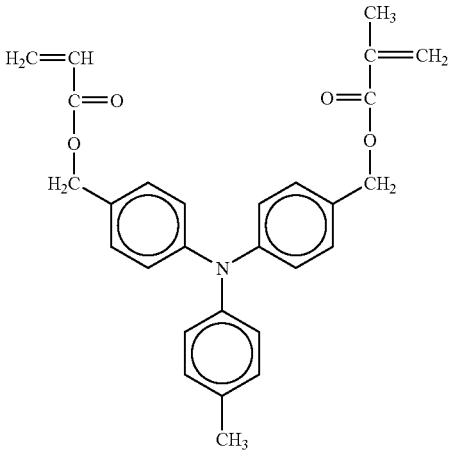
NO. 306
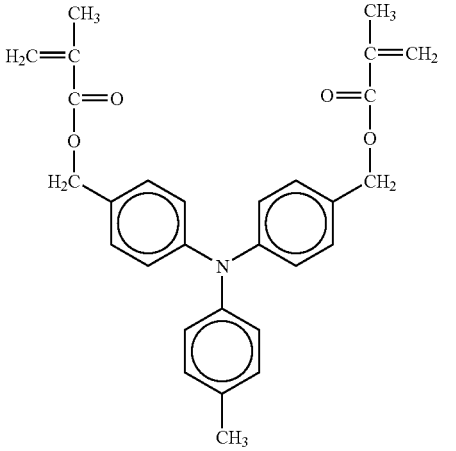
-continued
NO. 307
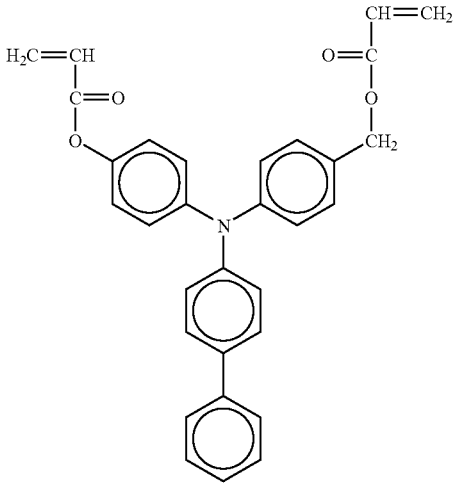
NO. 308
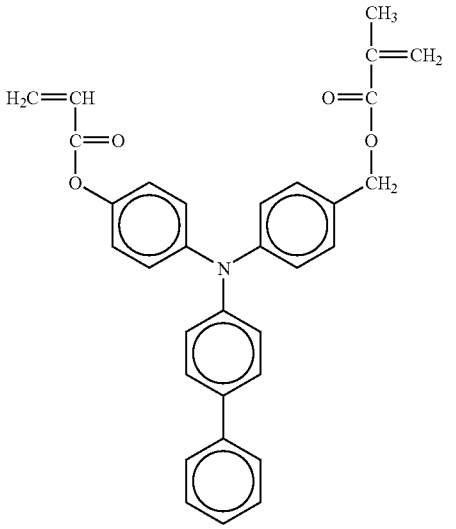
NO. 309
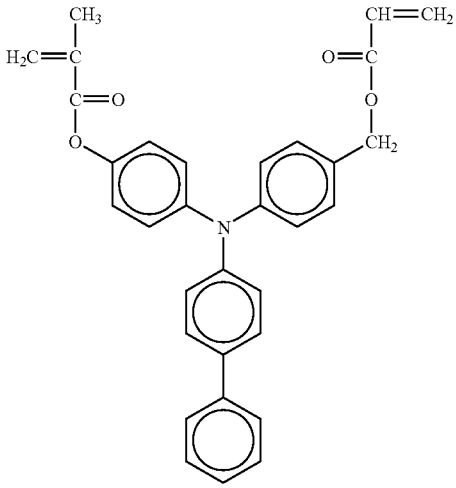

-continued
NO. 310
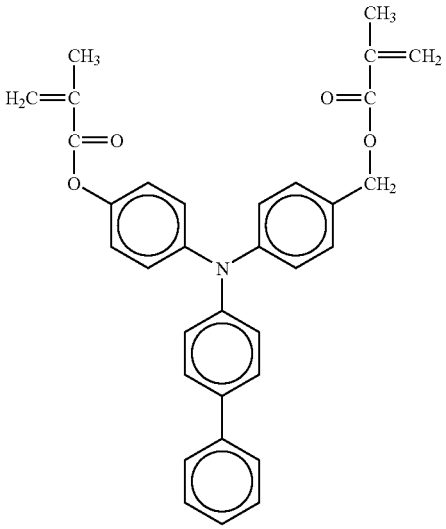
NO. 311
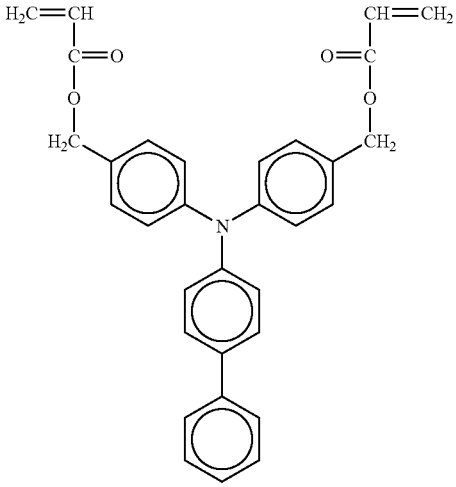
NO. 312
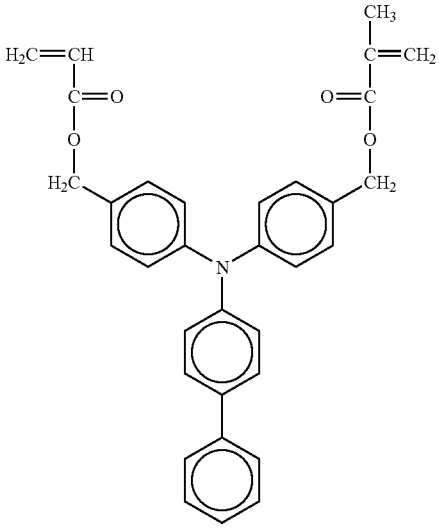
-continued
NO. 313
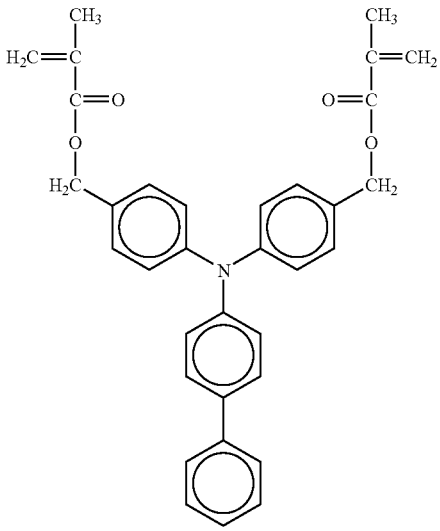
NO. 314
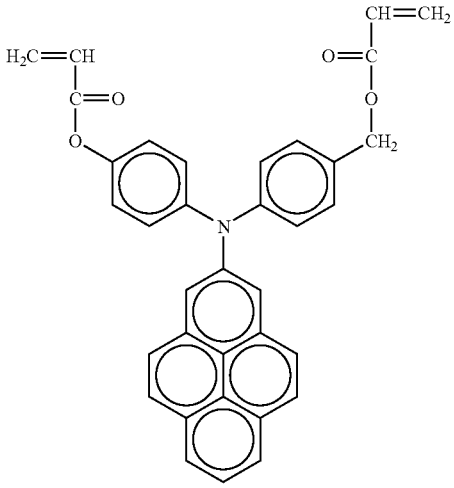
NO. 315
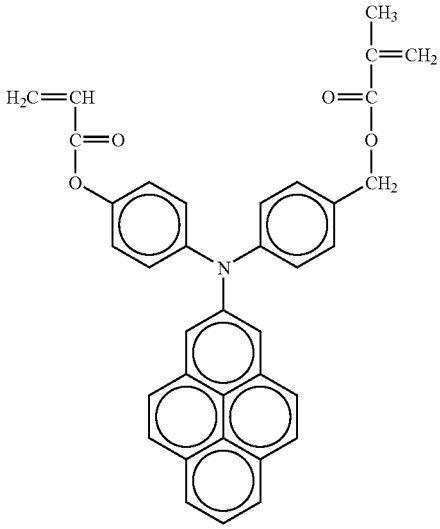

-continued
NO. 316
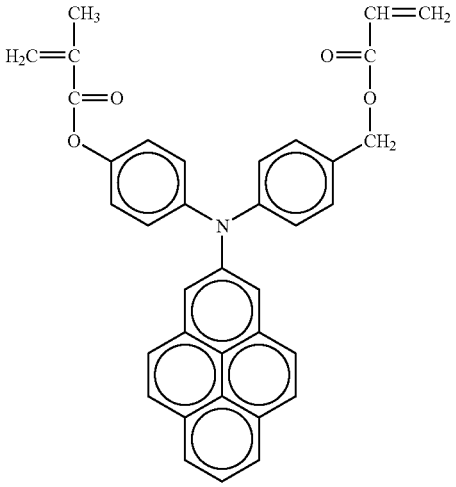
NO. 317
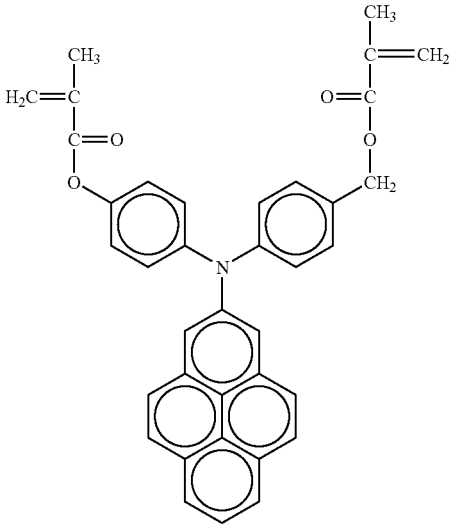
NO. 318
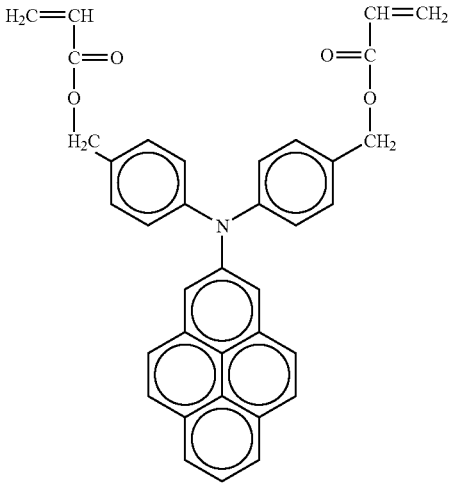
-continued
NO. 319
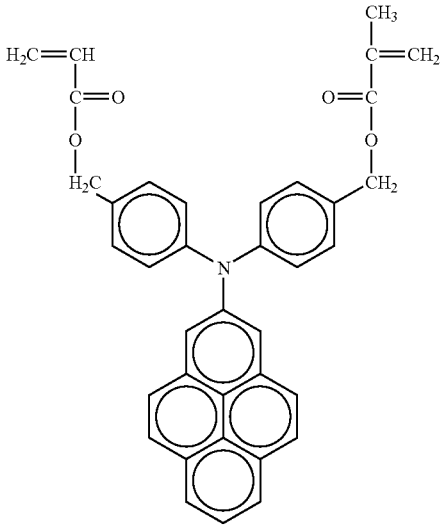
NO. 320
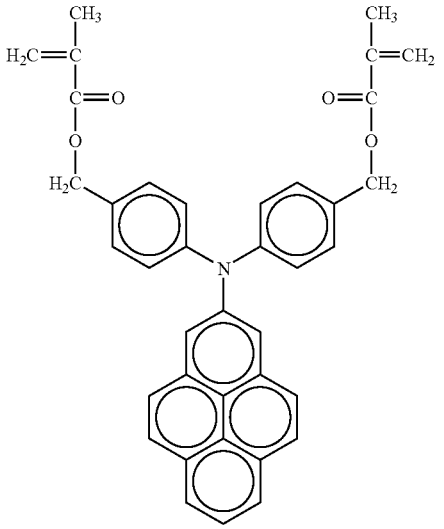
NO. 321
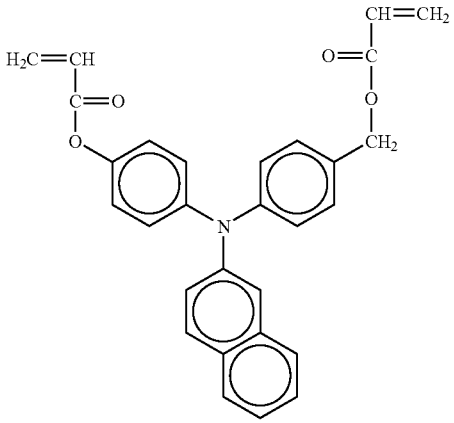

-continued
NO. 322
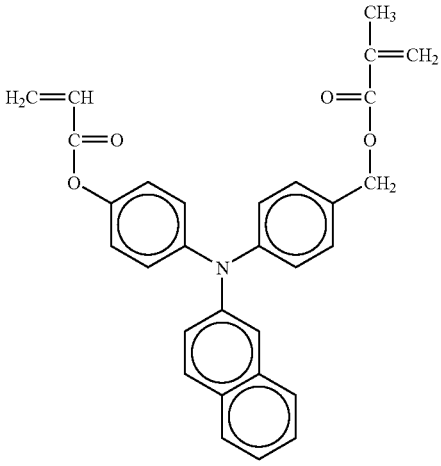
NO. 323
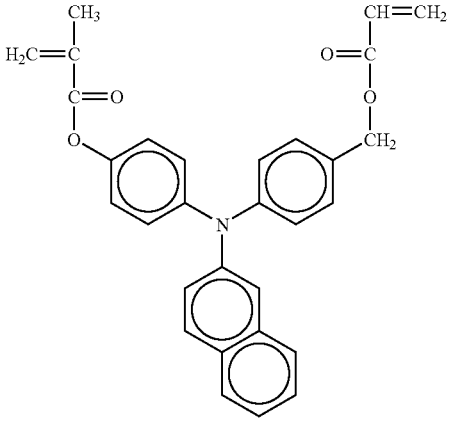
NO. 324
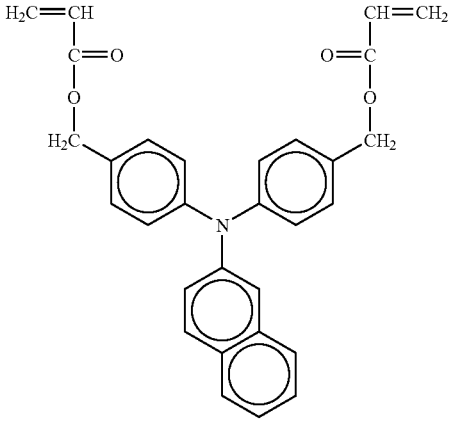
-continued
NO. 325
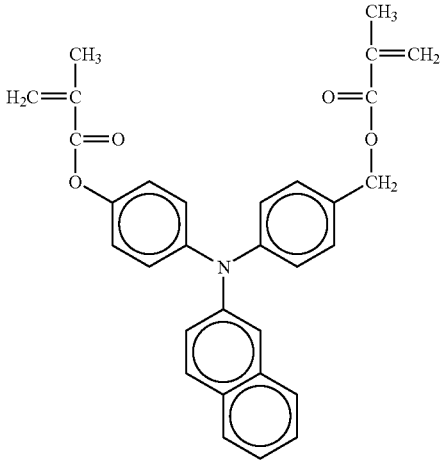
NO. 326
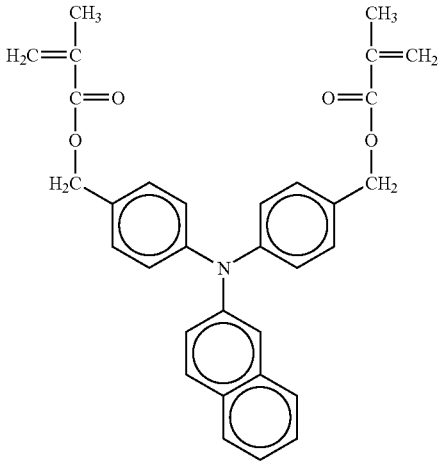
NO. 327
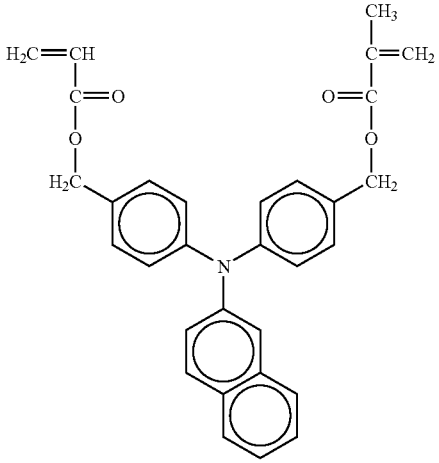

-continued
NO. 328
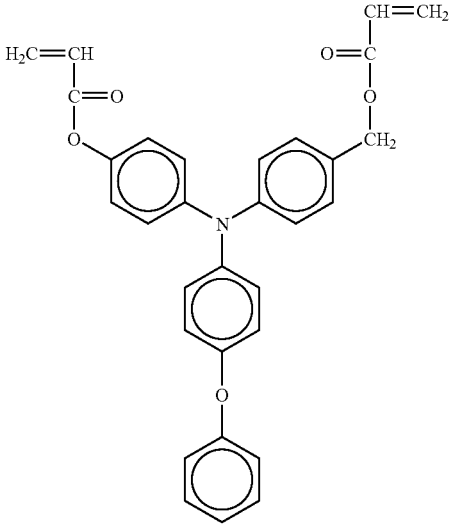
-continued
NO. 330
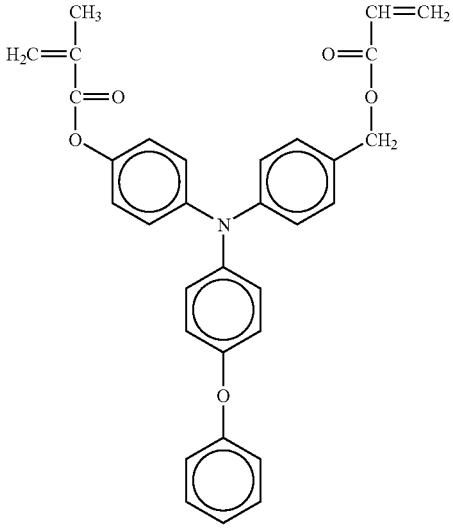
NO. 329
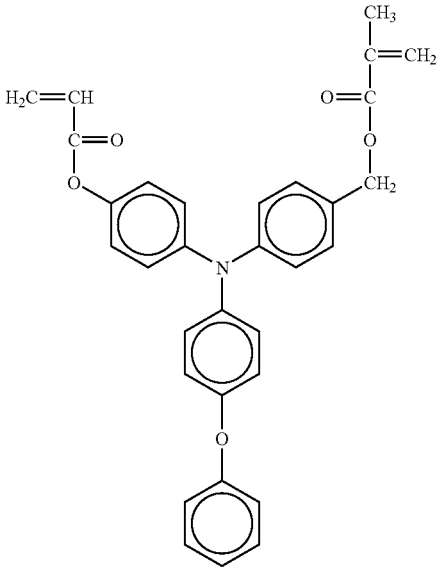
NO. 331
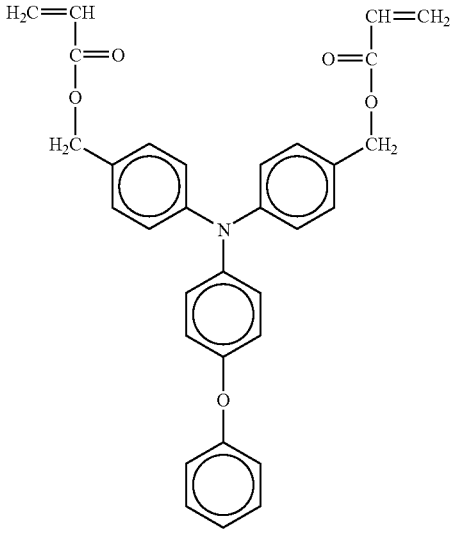

-continued
NO. 332
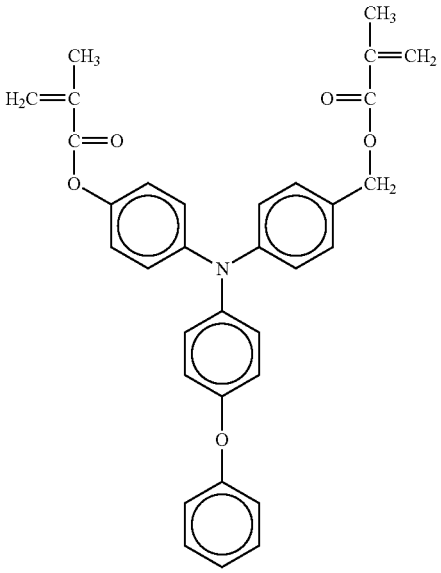
NO. 333
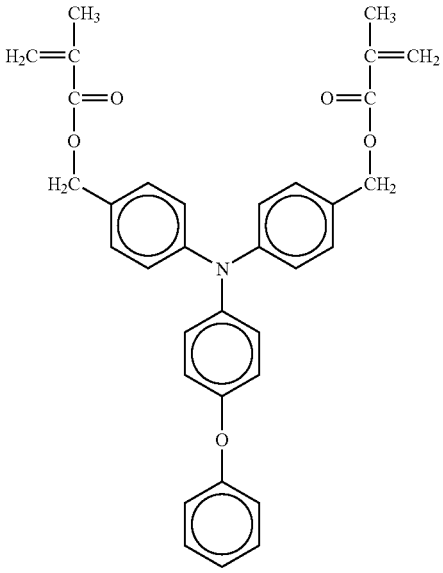
-continued
NO. 334
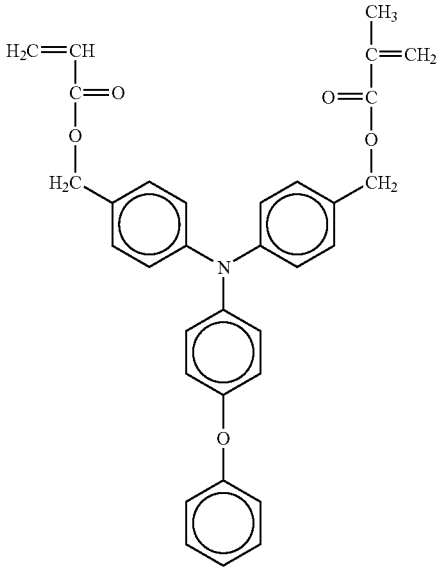
NO. 335
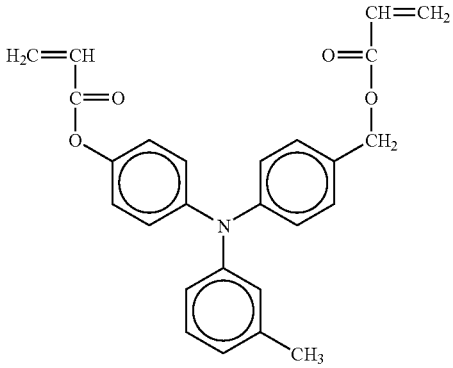
NO. 336
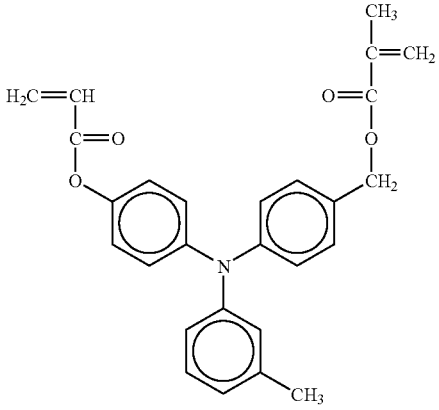

-continued
NO. 337
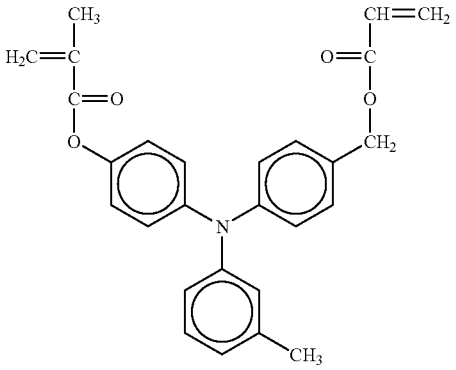
NO. 338
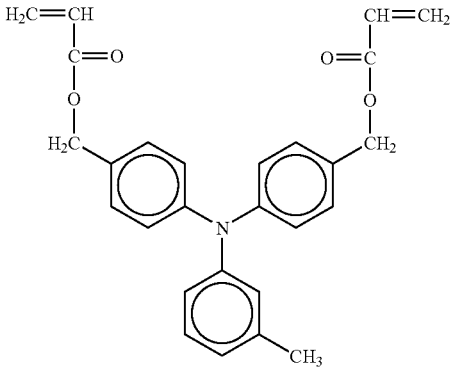
NO. 339
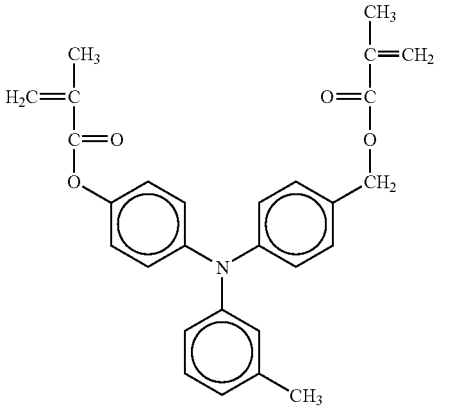
NO. 340
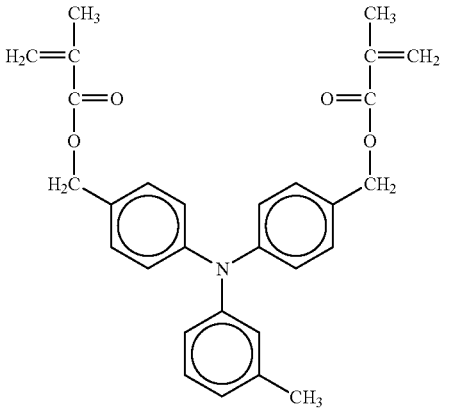
-continued
NO. 341
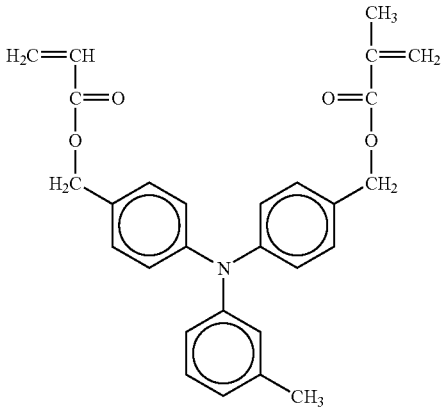
NO. 342
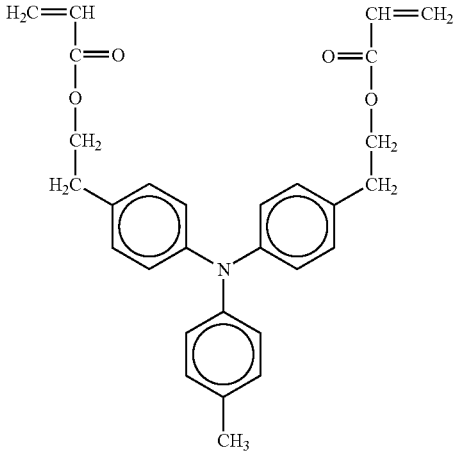
NO. 343
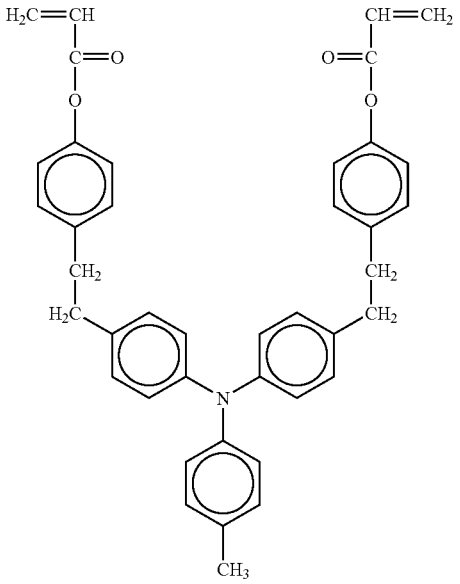

-continued
NO. 344
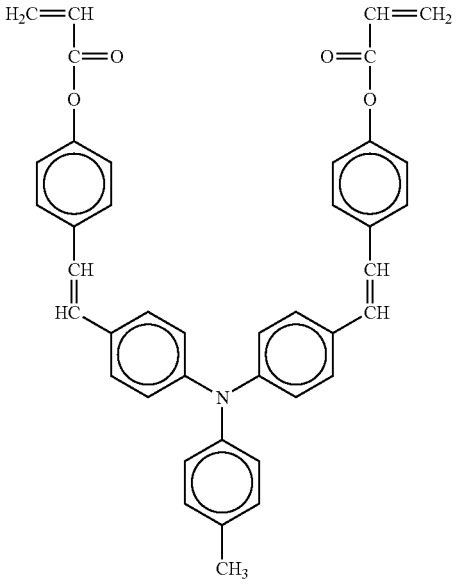
NO. 345
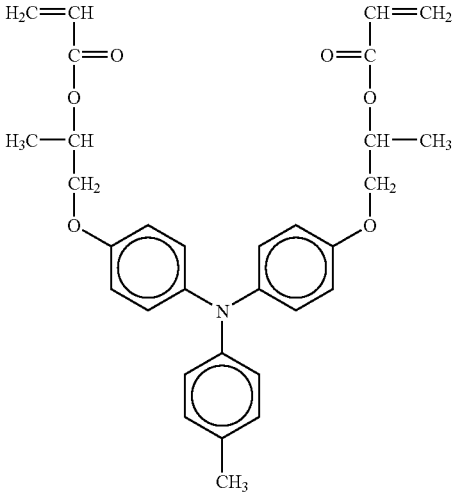
-continued
NO. 346
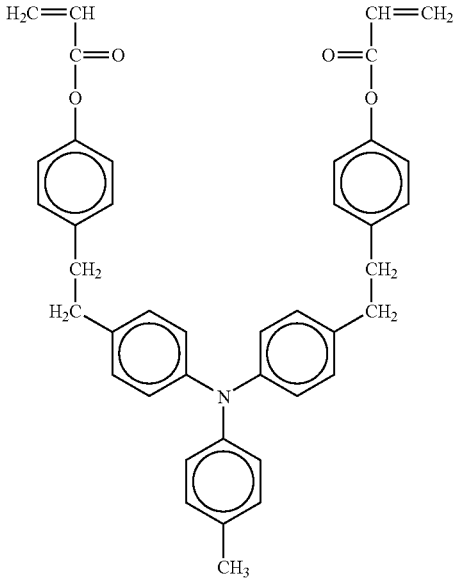
NO. 347
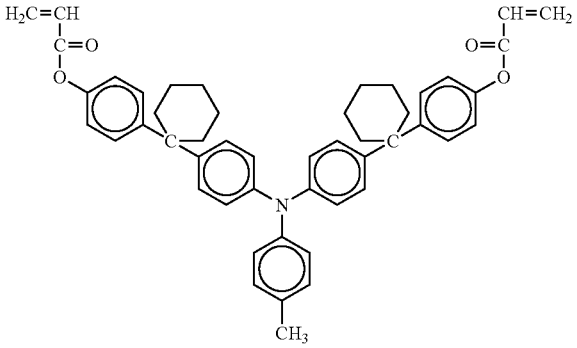
NO. 348
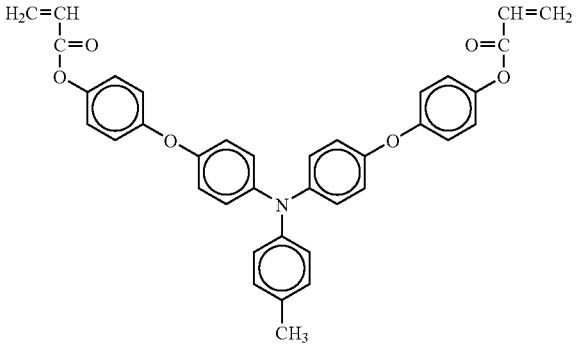

-continued
NO. 349
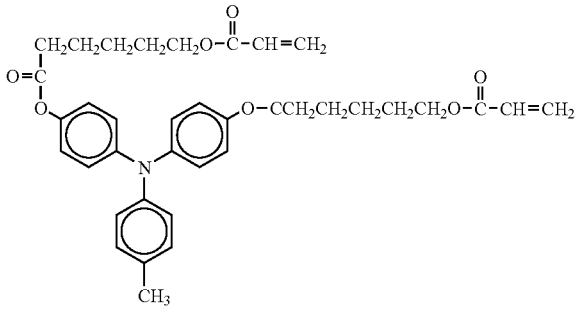
NO. 350
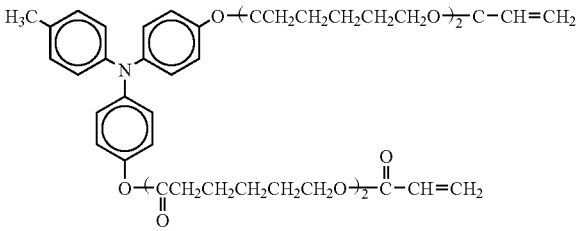
NO. 351
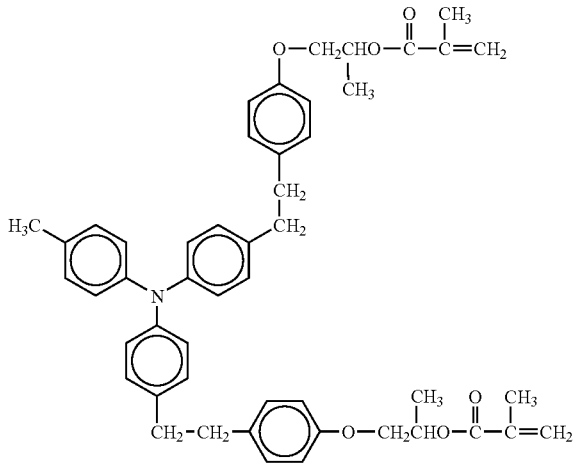
NO. 352
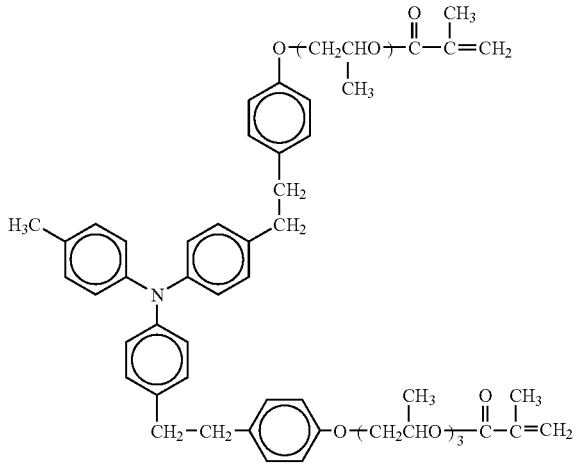
-continued
NO. 353
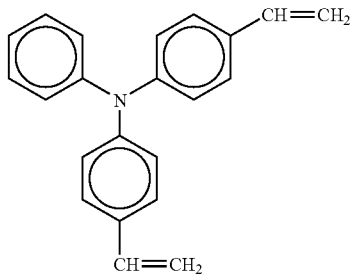
NO. 354
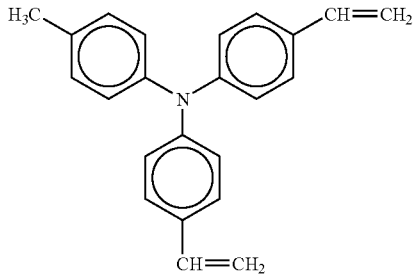
NO. 355
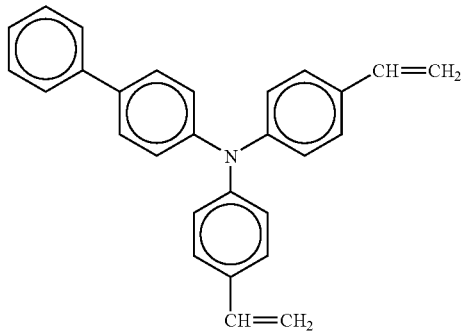
NO. 356
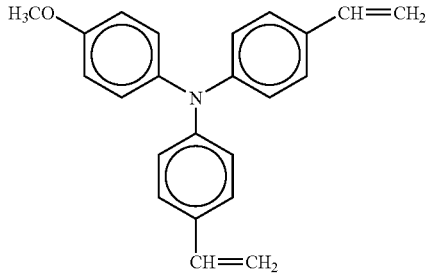
NO. 357
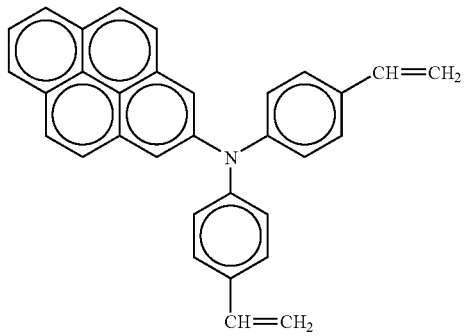

-continued
NO. 358
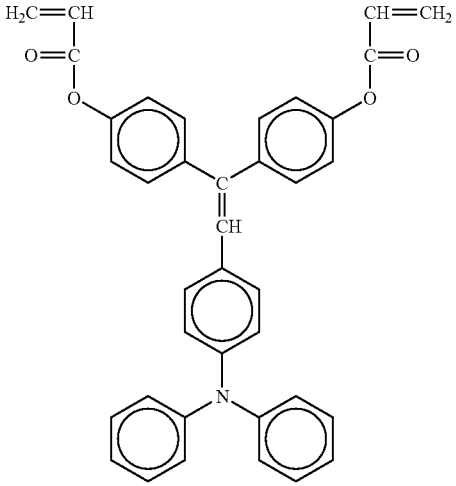
NO. 359
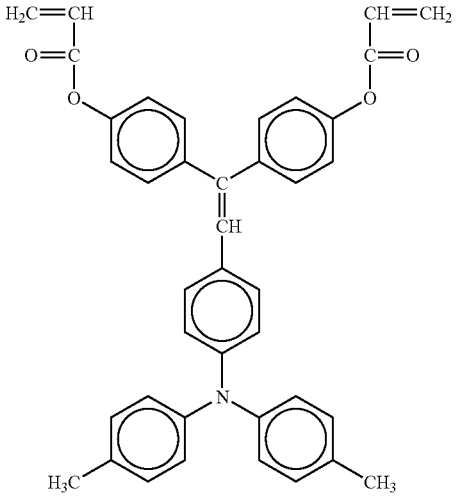
NO. 360
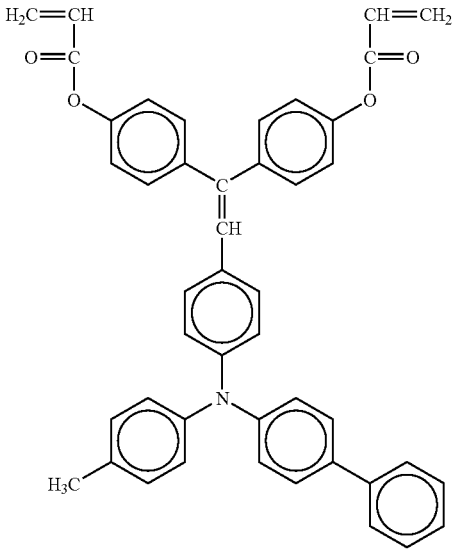
-continued
NO, 361
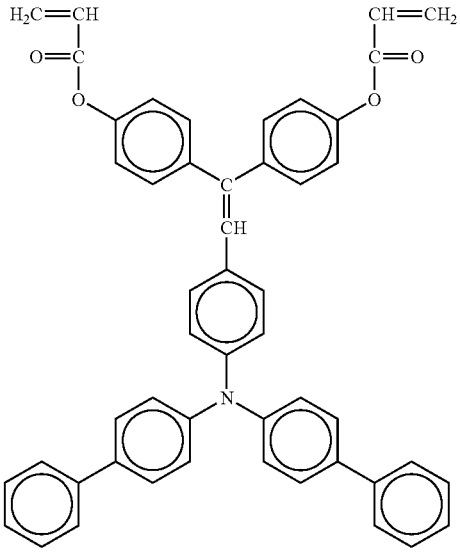
NO. 362
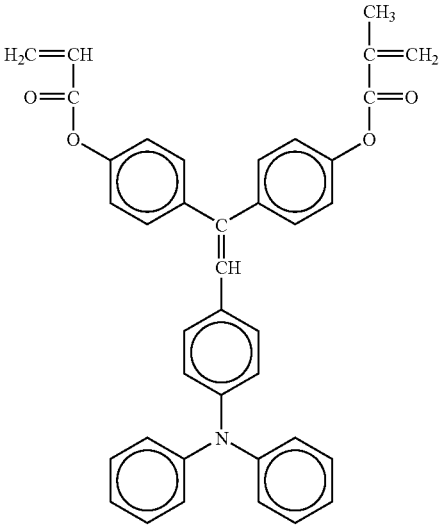
Specific examples of the radical-polymerizable compound having three functionalities and a charge transport units according to the present invention include the compounds represented by the following formulas No. 363 to No. 383, which should not be construed as limiting the scope of the present invention.

NO. 363
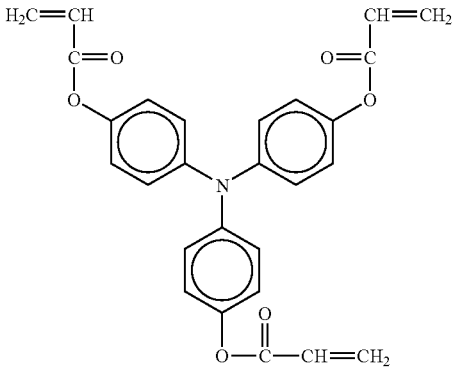
NO. 364
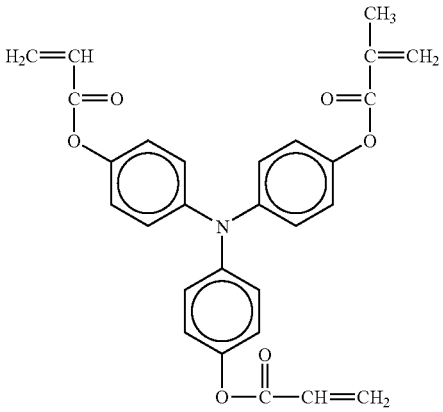
NO. 365
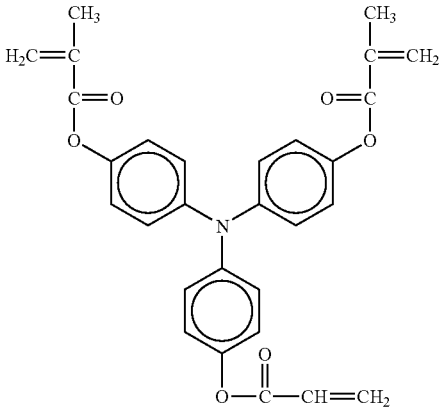
-continued
NO. 366
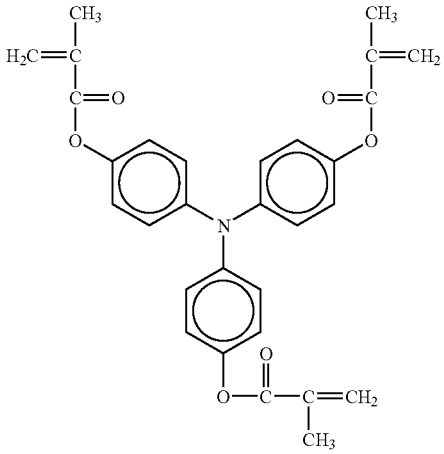
NO. 367
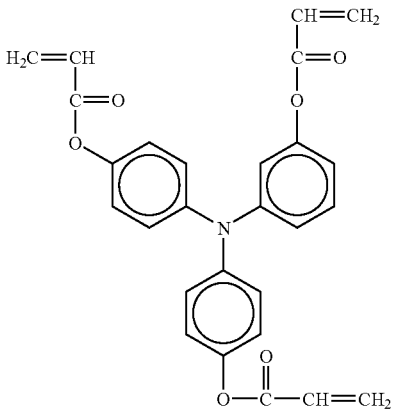
NO. 368
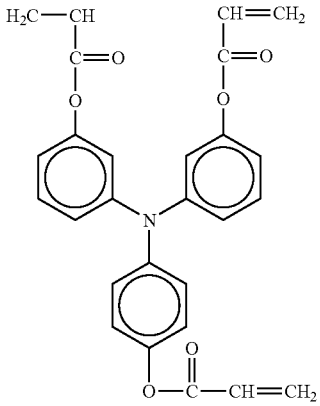

-continued
NO. 369
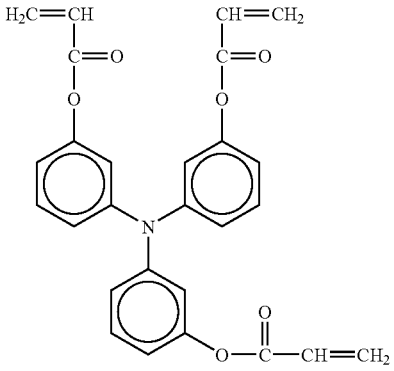
NO. 370
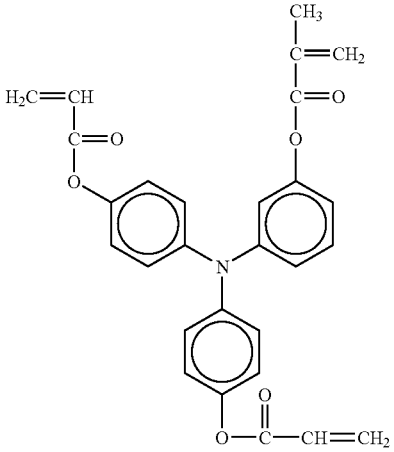
NO. 371
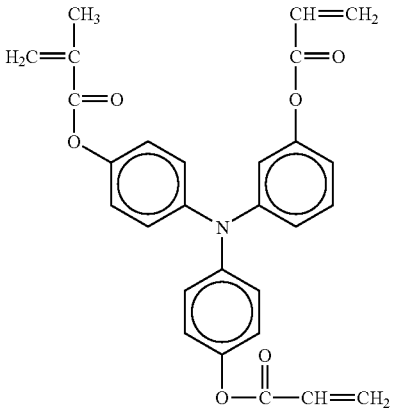
-continued
NO, 372
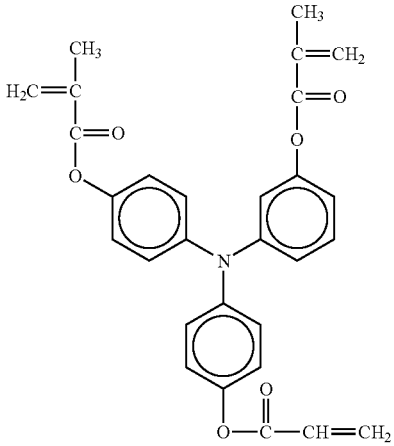
NO. 373
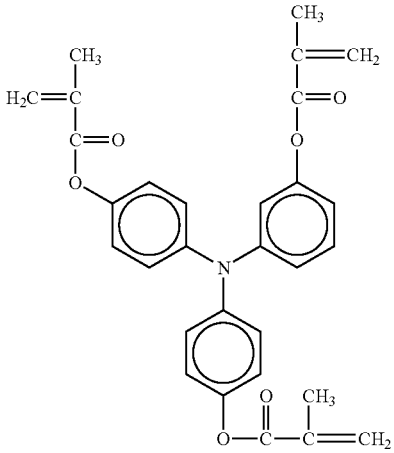
NO. 374
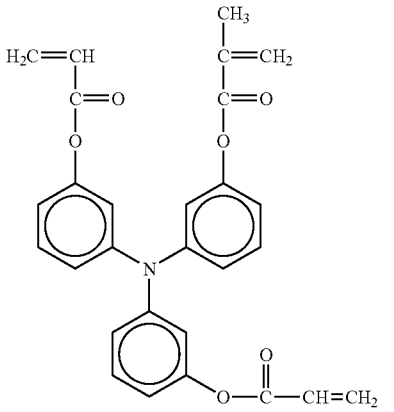

-continued
NO. 375
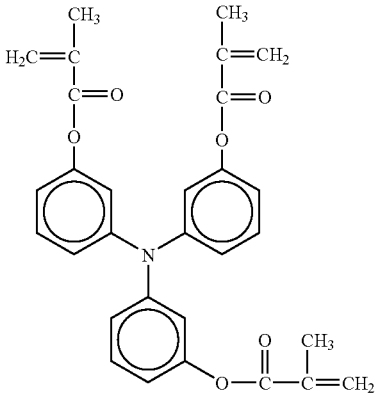
NO. 376
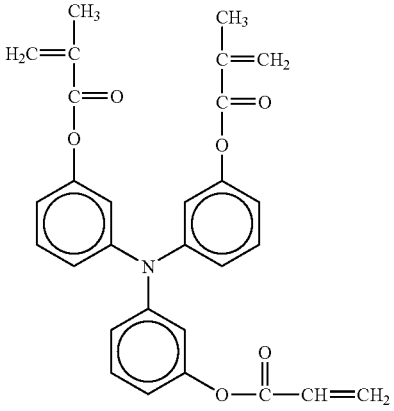
NO. 377
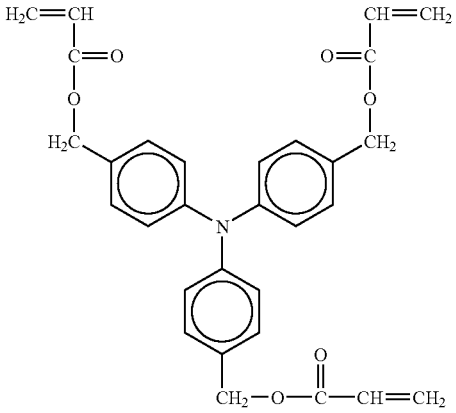
-continued
NO. 378
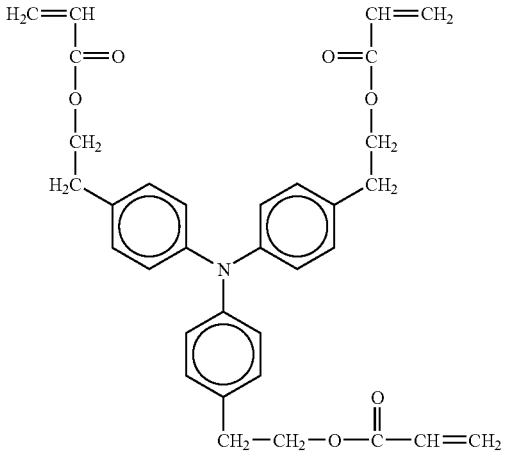
NO. 379
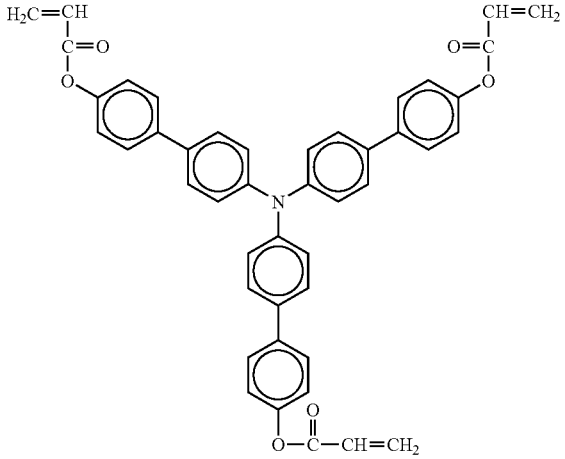
NO. 380
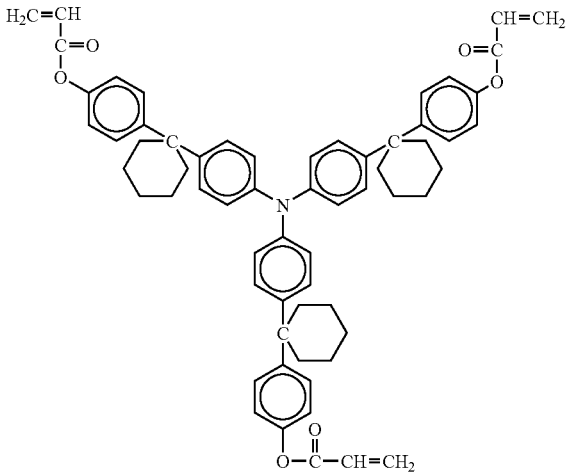

-continued

NO. 381

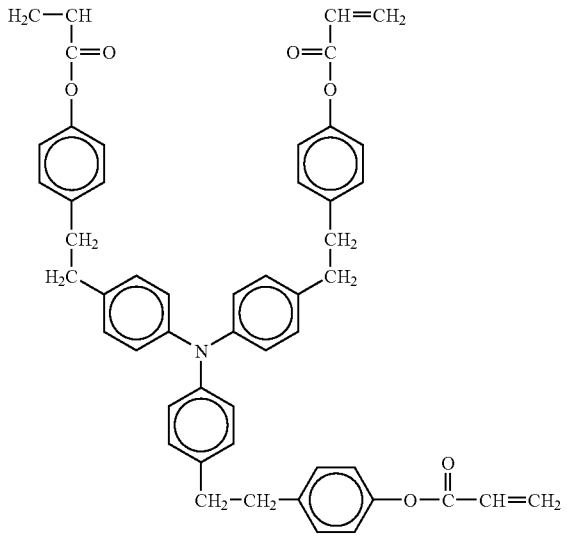

NO. 382

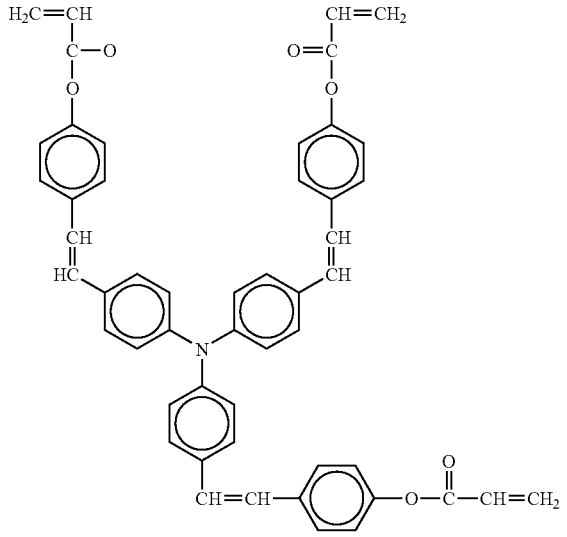

NO. 383

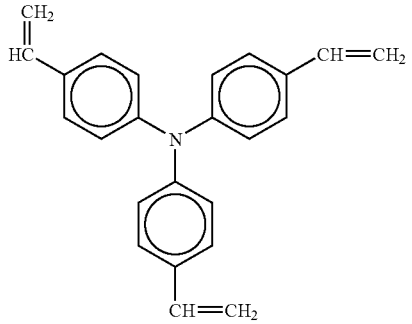

The radical-polymerizable compound having a charge transport units according to the present invention is important for imparting the charge transporting function to the crosslinked layer. The amount of the radical-polymerizable compound having a charge transport units is preferably 20% by mass to 80% by mass, more preferably 30% by mass to 70% by mass, based on the total mass of the crosslinked layer. When the amount is less than 20% by mass, the crosslinked layer cannot satisfactorily maintain the charge transporting function, so that in the repeated using of the photoconductor, the impairment of the electric properties of the photoconductor, such as the lowering of the sensitivity and the elevation of the residual potential is caused. On the other hand, when the amount is more than 80% by mass, the amount of the monomer having three functionalities and no charge transport units is lowered, so that the lowering of the crosslinkage density in the crosslinked layer is caused and the photoconductor cannot exhibit high wear resistance. Since the electrical properties and wear resistance required for the photoconductor vary depending on the process in which the photoconductor is used, it cannot be sweepingly mentioned that taking into consideration the balance between the above-noted two properties, the above-noted amount is most preferably 30% by mass to 70% by mass.

The crosslinked layer according to the present invention is disposed using a radical polymerizable monomer together with the above-noted acryl-modified polyorganosiloxane and preferably, a crosslinked layer produced by curing at least the radical-polymerizable monomer having three or more functionalities and no charge transport units and the radical-polymerizable compound having a charge transport units. However, besides these compounds, radical-polymerizable monomers having one or more functionalities and a radical-polymerizable oligomer can also be used in combination with the above-noted two monomers for imparting the functions, such as the controlling of the viscosity of the coating liquid for disposing the crosslinked layer, the relaxing of the stress of the crosslinked layer and the lowering of the surface energy and friction coefficient of the crosslinked layer to produce the crosslinked layer. Examples of these radical-polymerizable monomers and oligomers include conventional radical-polymerizable monomers and oligomers.

Further, with respect to the above-noted acryl-modified polyorganosiloxane, an acryl-modified polyorganosiloxane having a radical reactivity and an acryl-modified polyorganosiloxane having an amine structure may be used in combination, and in this case, the amount mass ratio between the two acryl-modified polyorganosiloxanes is preferably 1/9 to 9/1.

Specific examples of the radical-polymerizable monomer having one functionality include 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate and styrene monomer.

Specific examples of the radical-polymerizable monomer having two functionalities include 1,3-butanedioldiacrylate, 1,4-butanedioldiacrylate, 1,4-butanedioldimethacrylate, 1,6-hexanedioldiacrylate, 1,6-hexanedioldimethacrylate, diethyleneglycoldiacrylate, neopentylglycoldiacrylate, EO-modified bisphenol A diacrylate, EO-modified bisphenol F diacrylate and neopentylglycoldiacrylate.

Specific examples of the above-noted functional monomer include a (meth)acrylate substituted by a fluorine atom, such as octafluoropentylacrylate, 2-perfluorooctylethylacrylate, 2-perfluorooctylethylmethacrylate and 2-perfluoroisononylethylacrylate and a vinyl monomer, acrylate and methacrylate having a polysiloxane group, such as acryloyl (polydimethylsiloxane)ethyl, methacryloyl poly(dimethylsiloxane)ethyl, acryloyl poly(dimethylsiloxane)propyl, acryloyl poly(dimethylsiloxane)butyl and diacryloyl poly(dimethylsiloxane)

diethyl which have 20 to 70 recurring units of a siloxane linkage described in JP-B No. 05-60503 and JP-B No. 06-45770.

Examples of the radical-polymerizable oligomer include an epoxyacrylate oligomer, an urethaneacrylate oligomer and a polyesteracrylate oligomer. However, when the amount of the radical-polymerizable monomer having one functionality, radical-polymerizable monomer having two functionalities or a radical-polymerizable oligomer is large, the three-dimensional crosslinkage density of the crosslinked layer is substantially lowered, so that the wear resistance of the photoconductor is lowered. Therefore, for obtaining a desired property of the photoconductor, optionally the above-noted monomer or oligomer may be incorporated in the composition of the crosslinked layer. The amount of the above-noted monomer or oligomer is restricted to preferably 0.1 part by mass to 50 parts by mass, more preferably to 0.1 part by mass to 30 parts by mass, relative to 100 parts by mass of the mass of the radical-polymerizable monomer having three or more functionalities.

The crosslinked layer according to the present invention is preferably produced by curing at least the radical-polymerizable monomer having three or more functionalities and no charge transport units and the radical-polymerizable compound having a charge transport units. However, optionally for progressing effectively the crosslinking reaction, a polymerization initiator may be incorporated in the composition of the coating liquid for disposing the crosslinked layer.

Examples of the thermalpolymerization initiator include a peroxide initiator, such as 2,5-dimethylhexane-2,5-dihydroperoxide, dicumylperoxide, benzoylperoxide, t-butylcumylperoxide, 2,5-dimethyl-2,5-di(peroxybenzoyl) hexane-3, di-t-butylperoxide, t-butylhydroperoxide, cumenhydroperoxide and lauroylperoxide; and an azo initiator, such as azobisisobutylnitrile, azobiscyclohexanecarbonitrile, azobisisomethyl valerate, azobisisobutyl amidine hydrochloric acid salt and 4,4'-azobis-4-cyano valeric acid.

Examples of the photopolymerization initiator include an acetophenone or ketal photopolymerization initiator, such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl) ketone, 2-benzyl-2-dimethylamino-1-(4-morpholinophenyl) butanone, 1,2-hydroxy-2-methyl-1-phenylpropane-1-one, 2-methyl-2-morpholino(4-methylthiophenyl) propane-1-one and 1-phenyl-1,2-propanedione-2-(o-ethoxycarbonyl)oxime; a benzoin ether photopolymerization initiator, such as benzoin, benzoin methyl ether, benzoin ethyl ether, benzoin isobutyl ether and benzoin isopropyl ether; a benzophenone photopolymerization initiator, such as benzophenone, 4-hydroxybenzophenone, o-benzoylmethylbenzoate, 2-benzoylnaphthalene, 4-benzoylbiphenyl, 4-benzoyl phenyl ether, acrylated benzophenone and 1,4-benzoylbenzene; a thioxantone photopolymerization initiator, such as 2-isopropylthioxantone, 2-chlorothioxantone, 2,4-dimethylthioxantone, 2,4-diethylthioxantone and 2,4-dichlorothioxantone; and other photopolymerization initiators, such as ethylanthraquinone, 2,4,6-trimethylbenzoyldiphenylphosphine oxide, 2,4,6-trimethylbenzoylphenylethoxyphosphine oxide, bis(2,4,6-trimethylbenzoyl) phenylphosphine oxide, bis (2,4-dimethoxybenzoyl)-2,4,4-trimethylpentylphosphine oxide, methylphenylglyoxal ester, 9,10-phenanthrene, an acridine compound, a triazine compound and an imidazol compound. Further, a compound having a photopolymerization accelerating effect can be also used individually or in combination with the above-noted photopolymerization initiator, as the photopolymerization initiator. Examples of the compound having the photopolymerization accelerating effect include triethanolamine, methyldiethanolamine, 4-dimethylaminoethylbenzoate, 4-dimethylaminoisoamylbenzoate, (2-dimethylamino)ethylbenzoate and 4,4'-dimethylaminobenzophenone.

These polymerization initiators may be used individually or in combination. The amount of the polymerization initiator is preferably 0.5 part by mass to 40 parts by mass, more preferably 1 part by mass to 20 parts by mass, relative to 100 parts by mass of the total mass of the compounds having a radical-polymerizability.

The coating liquid used for disposing the crosslinked layer according to the present invention may optionally comprise various additives, such as a plasticizer (for relaxing the stress of the crosslinked layer or for improving the adhesion properties of the crosslinked layer), a leveling agent and a low molecular weight-charge transport material having no radical reactivity. As these additives, a conventional additive can be used and examples of the plasticizer include a plasticizer used for a general resin, such as dibutylphthalate and dioctylphthalate. The amount of the plasticizer is preferably 20% by mass or less, more preferably 10% by mass or less, based on the total mass of the solid in the coating liquid for disposing the crosslinked layer. Examples of the leveling agent include a silicone oil, such as a dimethyl silicone oil and a methylphenyl silicone oil; and a polymer and oligomer having a perfluoroalkyl group in the side chain. The amount of the leveling agent is preferably 3% by mass or less, based on the total mass of the solid in the coating liquid for disposing the crosslinked layer.

In disposing the crosslinked layer according to the present invention, first, the above-noted acryl-modified polyorganosiloxane and the above-noted radical polymerizable monomer are mixed with an organic solvent and optionally the resultant mixture is subjected to a dispersion treatment, thereby obtaining a dispersion used for disposing the crosslinked layer. Occasionally, a method in which the acryl-modified polyorganosiloxane is dispersed in the organic solvent and thereafter, into the resultant dispersion, the radical polymerizable monomer is incorporated, may be also employed. Further, in the dispersion, optionally a charge transport material or various additives may be incorporated. Examples of the dispersing method include all of conventional dispersing methods, such as a ball mill, an attritor, a sand mill, a beads mill, an ultrasonic wave and a liquid collision under high pressure.

It is advantageous that the larger the amount of the acryl-modified polyorganosiloxane in the crosslinked layer is, the higher the stability of the low surface energy of the crosslinked layer is. However, when the amount of the acryl-modified polyorganosiloxane is too large, the residual potential of the crosslinked layer is elevated and the hardness of the crosslinked layer is lowered, so that a side effect of a large amount of the acryl-modified polyorganosiloxane is caused sometimes. Therefore, the amount of the acryl-modified polyorganosiloxane in the crosslinked layer is generally 50% by mass or less, preferably 30% by mass or less, based on the total mass of the solid in the crosslinked layer.

The crosslinked layer according to the present invention is disposed on the charge transport layer with a coating liquid comprising the radical-polymerizable monomer having three or more functionalities and no charge transport units, the radical-polymerizable compound having a charge transport units and the acryl-modified polyorganosiloxane, and followed by curing the resultant coating. When the radical-polymerizable monomer is liquid, the coating liquid can be prepared by dissolving the other components into the radical-polymerizable monomer liquid, however, optionally, the coating liquid is diluted by a solvent before using the coating liquid. Example of the solvent for the coating liquid include an alcohol solvent, such as methanol, ethanol, propanol and butanol; a ketone solvent, such as acetone, methyl ethyl ketone, methyl isobutyl ketone and cyclohexanone; an ester solvent, such as ethyl acetate and butyl acetate; an ether solvent, such as tetrahydrofuran, dioxane and propyl ether; a halogenated solvent, such as dichloromethane, dichloroethane, trichloroethane and chlorobenzene; an aromatic solvent, such as benzene, toluene and xylene; and a cellosolve solvent, such as a methyl cellosolve, an ethyl cellosolve and a cellosolve acetate. These solvents may be used individually or in combination. The degree of the dilution by the solvent varies depending on the solubility of the composition of the crosslinked layer, the coating method and the desired thickness of the crosslinked layer, and is random. The coating can be performed by a dip coating, a spray coating, a beads coating or a ring coating.

According to the present invention, after the coating using the above-noted coating liquid for disposing the crosslinked layer, the resultant coating is cured by applying an external energy to the coating, so that the crosslinked layer is disposed. Examples of the source of the external energy include a heat, a light and a radiation. The applying of the thermal energy is performed by heating the surface of the coating as the crosslinked layer or the surface of the support using a gas, such as air and nitrogen gas, a vapor or various heating medium, an infrared light, or an electromagnetic wave. The heating temperature is preferably 100° C. to 170° C. When the heating temperature is less than 100° C., the rate of the curing reaction is low, so that the curing reaction cannot be completed. On the other hand, when the heating temperature is more than 170° C., the curing reaction is ununiformly progressed, so that in the crosslinked layer, a large strain is caused. For progressing the curing reaction uniformly, a method in which the heating is performed relatively at a low temperature, such as less than 100° C. and the heating temperature is elevated to 100° C. or more, thereby completing the curing reaction, is also effective.

Examples of the source of the light energy include an UV irradiating light source, such as a high-pressure mercury vapor lamp and metal halide lamp which have an emission wavelength in the ultraviolet region, and also a light source for a visible light of which wavelength corresponds to a wavelength of a light absorbed by the radical-polymerizable compound or photopolymerization initiator. The amount of an irradiated light is preferably 50 mW/cm$^2$ to 1,000 mW/cm$^2$. When the amount is less than 50 mW/cm$^2$, the curing reaction takes much time. On the other hand, when the amount is more than 1,000 mW/cm$^2$, the progression of the curing reaction becomes ununiform and the surface of the crosslinked layer becomes markedly rough. Examples of a radiation energy include an energy of an electron beam. Among these energies, from the viewpoint of the easiness for controlling the reaction rate and the simple ness of the irradiating apparatus, a heat energy and a light energy are useful.

The film thickness of the crosslinked layer according to the present invention varies depending on the layer composition of the photoconductor comprising the crosslinked layer, therefore, hereinbelow, the film thickness of the crosslinked layer is described with reference to the layer composition of the photoconductor.

The composition of the coating liquid for disposing the crosslinked layer may comprise a binder resin so long as the surface smoothness, electric properties and durability of the crosslinked layer are not impaired, however, when the coating liquid for disposing the crosslinked layer comprises a polymer material, such as a binder resin, due to the poor compatibility between the binder resin and a polymer produced according to the curing reaction of a radical-polymerizable composition (radical-polymerizable monomer or radical-polymerizable compound having a charge transport units), a phase separation is caused in the crosslinked layer, so that the surface of the crosslinked layer becomes extremely rough. Therefore, the binder resin is not used preferably.

With respect to the crosslinked layer according to the present invention, for maintaining the electrical properties of the crosslinked layer, a compound having a bulky charge transport units should be incorporated in the composition of the crosslinked layer and for enhancing the strength of the crosslinked layer, the crosslinkage density in the crosslinked layer should be enhanced. With respect to the curing after the coating for disposing the crosslinked layer, when the curing reaction is progressed rapidly by applying an extremely high external energy to the coating, the curing reaction is progressed ununiformly and the surface of the crosslinked layer becomes extremely rough. Therefore, since the rate of the curing reaction can be controlled by the heating condition by the intensity of the light irradiation or by the amount of the polymerization initiator, the heat energy or the light energy is preferably used as an external energy for the curing.

The photoconductor according to the present invention is produced according to a method comprising preparing a coating liquid for disposing the crosslinked layer, which comprises an acryl-modified polyorganosiloxane having an amine structure, an acrylate monomer having three acryloyloxy groups and a triarylamine monomer having one acryloyloxy group which are the materials for disposing the crosslinked layer according to the present invention, wherein the amount mass ratio between an acryl-modified polyorganosiloxane and two types of acrylate compound (an acryl-modified polyorganosiloxane:two types of acrylate compound) is 3:97 to 30:70 and the amount mass ratio between the two types of acrylate compound (an acrylate monomer:a triarylamine monomer) is 7:3 to 3:7, and which comprises besides the above-noted three types of monomer, a polymerization initiator in an amount of 3% by mass to 20% by mass, based on the total mass of these acrylate monomers, and a solvent; disposing the charge transport layer which is the under layer of the crosslinked layer, on the charge generating layer disposed on the undercoat layer disposed on the support, such as an aluminum cylinder, using a triarylamine doner as a charge transport material and a polycarbonate resin as a binder resin; disposing the crosslinked layer on the charge transport layer by a spray coating using the above-prepared coating liquid which is diluted at the using with a solvent, preferably such as tetrahydrofuran, 2-butanone or ethyl acetate, wherein the amount of the solvent is three times to ten times the total amount of the acrylate monomers in the coating liquid (wherein the cured and disposed crosslinked layer is preferably insoluble in an organic solvent and an unsatisfactorily cured film is soluble in an organic solvent and the crosslinkage density in such a film is low, so that the mechanical durability of the photoconductor is lowered.); drying the resultant coating as the crosslinked layer at a relative low temperature for a short period (at 25° C. to 80° C. for 1 minute to 10 minutes); curing the crosslinked layer by applying a light energy, such as a UV light energy, wherein for irradiating the UV light, a metal halide lamp is used and the irradiating of the UV light is performed under the condition where the illuminance of the UV light is preferably 50 mW/cm$^2$ to 1,000 mW/cm$^2$, for example the UV light having an illuminance of 700 mW/cm$^2$ is irradiated for 20 sec to 600 sec during the curing, while rotating the drum for irradiating the light to the whole surface of the drum uniformly, accompanied by controlling the temperature of the drum to 50° C. or lower (in the case of the thermal curing, the heating is performed at preferably 100° C. to 170° C. using a blower oven as a heating medium and when the heating temperature is fixed at 150° C., the heating is performed for 20 minutes to three hours.); and heating the crosslinked layer at 100° C. to 150° C. for distilling off the residual solvent, thereby producing the photoconductor according to the present invention.

Hereinafter, with respect to the photoconductor according to the present invention, explanations are given referring to the layer composition of the photoconductor.

<Layer Composition of Photoconductor>

With respect to the photoconductor according to the present invention, explanations are given referring to figures.

Figure 1B:
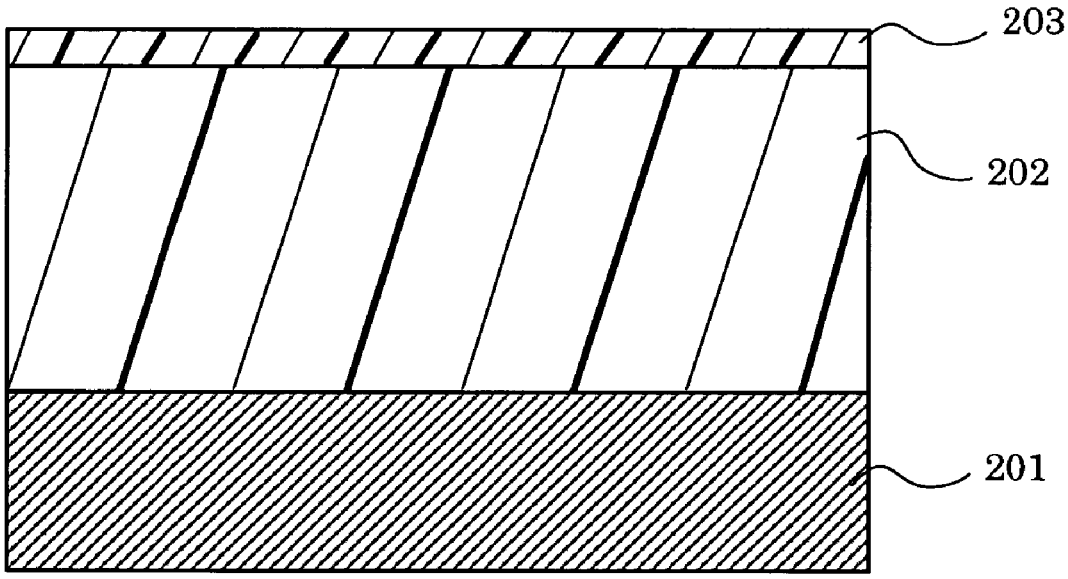
FIG. 1B is a sectional view schematically showing another example of the photoconductor according to the present invention, which comprises the crosslinked layer 203, the photosensitive layer 202 and the support 201.

FIGS. 1A and 1B are sectional views schematically showing an example of the photoconductor according to the present invention, which are the photoconductor in a single layer structure in which a photosensitive layer 202 having both a charge generating function and a charge transport function simultaneously is disposed on a support 201. FIG. 1 A shows an example of the photosensitive layer 202 comprising only a crosslinked layer 203 and FIG. 1 B shows an example of the photosensitive layer 202 comprising a crosslinked layer 203 and an underlayer in the photosensitive layer 202.

Figure 2A:
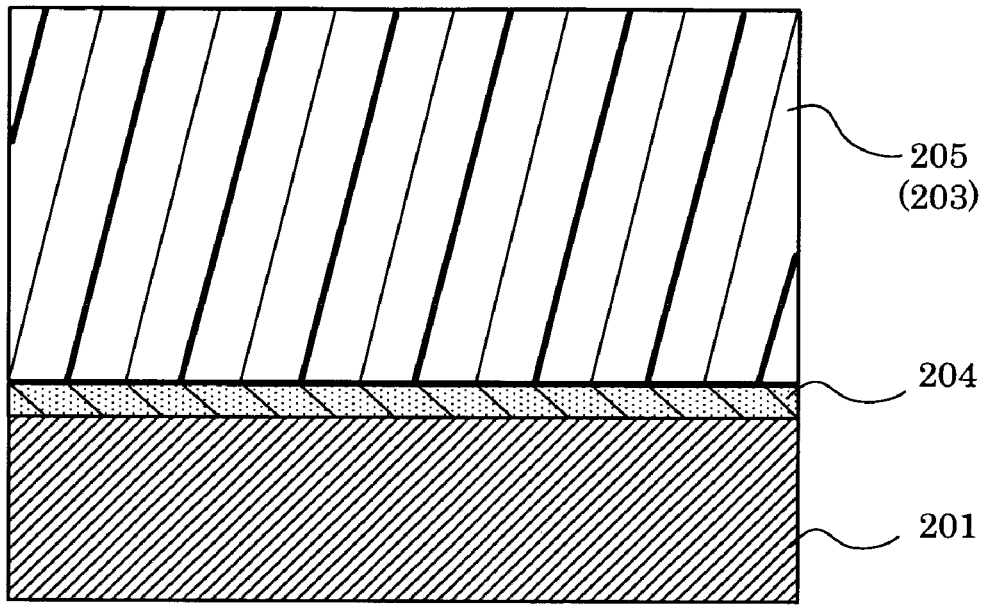
FIG. 2A is a sectional view schematically showing another example of the photoconductor according to the present invention, which comprises the charge transport layer 205, the charge generating layer 204 and the support 201.
Figure 2B:
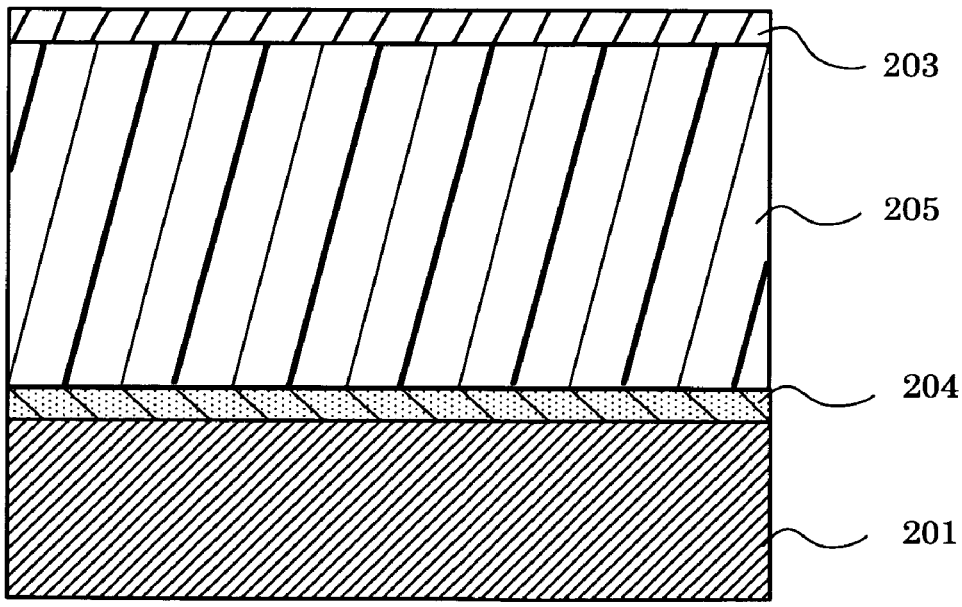
FIG. 2B is a sectional view schematically showing another example of the photoconductor according to the present invention, which comprises the crosslinked layer 203, the charge transport layer 205, the charge generating layer 204 and the support 201.

FIGS. 2A and 2B are sectional views schematically showing an example of the photoconductor according to the present invention, which are the photoconductor in a laminated-layer structure in which a charge generating layer 204 having a charge generating function and a charge transport layer 205 having a charge transport function are disposed on a support 201 in this order. FIG. 2 A shows an example of the charge transport layer 205 comprising only a crosslinked layer 203 and FIG. 2 B shows an example of the charge transport layer 205 comprising a crosslinked layer 203 and an underlayer in the charge transport layer 205.

<Support>

The support is not restricted so long as the support exhibits a conductivity of $10^{10}$ Ω·cm or less in terms of the volume resistance and may be selected depending on the application. Examples of the support include a plastic and paper in the form of a film or cylinder, wherein the plastic and paper are coated with a metal, such as aluminum, nickel, chromium, nichrome, copper, gold, silver, platinum, or with a metal oxide, such as tin oxide and indium oxide, by a metallizing or sputtering; and a plate and pipe of aluminum, an aluminum alloy, nickel or a stainless steel, wherein the pipe of a metal or metal alloy is produced by shaping the plate of a metal or metal alloy to a raw pipe according to an extrusion method or drawing method and by subjecting the raw pipe to the surface treatment, such as a cutting, a super-finishing and a polishing. An endless nickel belt and endless stainless steel belt disclosed in JP-A No. 52-36016 can be also used as the support.

As others, a substance produced by coating the above-noted support with a dispersion in which conductive particles are dispersed in a proper binder resin can be also used as the support according to the present invention.

Examples of the conductive particles include particles of a carbon black; an acetylene black; a metal, such as aluminum, nickel, iron, nichrome, copper, zinc and silver; and a metal oxide, such as conductive tin oxide and ITO. Examples of the binder resin which is used in combination with the conductive particles include a thermoplastic resin, a thermosetting resin or a light curing resin, such as a polystyrene resin, a styrene-acrylonitrile copolymer, a styrene-butadiene copolymer, a styrene-maleic anhydride copolymer, a polyester resin, a polyvinyl chloride resin, a vinyl chloride-vinyl acetate copolymer, a polyvinyl acetate resin, a polyvinylidene chloride resin, a polyacrylate resin, a phenoxy resin, a polycarbonate resin, a cellulose acetate resin, an ethyl cellulose resin, a polyvinylbutyral resin, a polyvinyl formal resin, a polyvinyl toluene resin, a poly-N-vinylcarbazole resin, an acrylic resin, a silicone resin, an epoxy resin, a melamine resin, an urethane resin, a phenolic resin and an alkyd resin. The conductive layer can be disposed on the support by coating the support with a dispersion in which conductive particles and a binder resin are dispersed in a proper solvent, such as tetrahydrofuran, dichloromethane, methyl ethyl ketone and toluene.

Further, a substance produced by disposing the conductive layer on the proper support having the form of a cylinder using a heat-shrinkable tubing produced by incorporating conductive particles in a material, such as a polyvinyl chloride resin, a polypropylene resin, a polyester resin, a polystyrene resin, a polyvinylidene chloride resin, a polyethylene resin, a chloride rubber and Teflon (registered trade mark), can be also preferably used as the support according to the present invention.

<Photosensitive Layer>

Next, with respect to the photosensitive layer, explanations are given. The photosensitive layer may be in a laminated-layer structure or in a single layer structure.

The photosensitive layer in a laminated-layer structure comprises the charge generating layer having a charge generating function and the charge transport layer having a charge transporting function. The photosensitive layer in a single layer structure has both the charge generating function and the charge transport function simultaneously.

Hereinbelow, with respect to the photosensitive layer in a laminated layers structure and the photosensitive layer in a single layer structure respectively, explanations are given.

<Photosensitive Layer in Laminated Layers Structure>

(Charge Generating Layer)

The charge generating layer is a layer comprising mainly a charge generating material having charge generating property and may be used in combination with a binder resin as needed. The charge generating materials may be classified into inorganic materials and organic materials.

Examples of inorganic materials include crystalline selenium, amorphous selenium, selenium-tellurium, selenium-tellurium-halogen, selenium-arsenic compound, and amorphous silicon. The amorphous silicon may have dangling bonds terminated with a hydrogen atom or halogen atom, or it may be doped with boron or phosphorus.

Examples of the organic material include a conventional material, such as a phthalocyanine pigment (e.g., a metal phthalocyanine and a phthalocyanine containing no metal), an azulenium salt pigment, a methine squarate pigment, an azo pigment having a carbazole skeleton, an azo pigment having a triphenylamine skeleton, an azo pigment having a diphenylamine skeleton, an azo pigment having a dibenzothiophene skeleton, an azo pigment having a fluorenone skeleton, an azo pigment having an oxadiazole skeleton, an azo pigment having a bis-stilbene skeleton, an azo pigment having a distyryloxadiazole skeleton, an azo pigment having a distyrylcarbazole skeleton, a perylene pigment, anthraquinone and multicyclic quinone pigments, a quinoneimine pigment, diphenylmethane and triphenylmethane pigments, benzoquinone and naphthoquinone pigments, cyanine and azomethine pigments, an indigoido pigment and a bisbenzimidazole pigment. These charge generating substances may be used individually or in combination.

Examples of the binder resin used for disposing the charge generating layer include a polyamide resin, a polyurethane resin, an epoxy resin, a polyketone resin, a polycarbonate resin, a silicone resin, an acrylic resin, a polyvinylbutyral resin, a polyvinylformal resin, a polyvinyl ketone resin, a polystyrene resin, a poly-N-vinylcarbazol resin and a polyacrylamide resin. These binder resins may be used individually or in combination. Examples of the binder resin besides the above-noted binder resins include a charge transport polymer having a charge transporting function, such as a polycarbonate resin, polyester resin, polyurethane resin, polyether resin, polysiloxane resin and acrylic resin which have an aryl amine skeleton, benzidine skeleton, hydrazone skeleton, carbazol skeleton, stilbene skeleton or pyrazoline skeleton; and a charge transport polymer having a polysilane skeleton.

Specific examples of the above-exemplified former binder resins include charge transport polymer materials described in patent documents, such as JP-A Nos. 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-239049, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085 and 09-328539.

Specific examples of the above-exemplified latter binder resins include polysilylene polymers described in patent documents, such as JP-A Nos. 63-285552, 05-19497, 05-70595 and 10-73944.

The charge generating layer may comprise a charge transport material having a low molecular weight. Preferred examples of the charge transport material having a low molecular weight which can be used for disposing the charge generating layer in combination with a charge generating substance include an electron-hole transport substance and an electron transport substance.

Preferred examples of the electron transport substance include an electron acceptor substance, such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide and a diphenoquinone derivative. These electron transport substances may be used individually or in combination.

Preferred examples of the electron-hole transport substance include an electron donor substance, such as an oxazole derivative, an oxadiazole derivative, an imidazole derivative, a monoaryl amine derivative, a diaryl amine derivative, a triaryl amine derivative, a stilbene derivative, an α-phenylstilbene derivative, a benzidine derivative, a diarylmethane derivative, a triarylmethane derivative, a 9-styrylanthracene derivative, a pyrazoline derivative, a divinylbenzene derivative, a hydrazone derivative, an indene derivative, a butadiene derivative, a pyrene derivative, a bis-stilbene derivative, an enamine derivative, and other conventional substances. These electron-hole transport substances may be used individually or in combination.

In general, the charge generating layer may be formed by way of film forming processes under a vacuum atmosphere or casting processes by use of a solution or dispersion.

The former processes include the vacuum deposition, glow discharge electrolysis, ion plating, sputtering, reactive-sputtering, and CVD processes, which may form satisfactory inorganic materials or organic materials.

The method for disposing the charge generating layer on the support by the casting method comprises, for example, dispersing the organic or inorganic charge generating substance and optionally together with a binder resin in a solvent using an apparatus, such as a ball mill, an attritor, a sand mill and a beads mill, thereby obtaining a dispersion, and coating the support with a coating liquid prepared by diluting properly the above-obtained dispersion. Examples of the above-noted solvent include tetrahydrofuran, dioxane, dioxolane, toluene, dichloromethane, monochlorobenzene, dichloroethane, cyclohexanone, cyclopentanone, anisole, xylene, methyl ethyl ketone, acetone, ethyl acetate and butyl acetate. The above-note dispersion may optionally comprise a leveling agent, such as a dimethyl silicone oil and a methylphenyl silicone oil. Examples of the method for the above-noted coating include a dip coating method, a spray coating method, a beads coating method and a ring coating method.

The charge generating layer has a thickness of preferably 0.01 μm to 5 μm, more preferably 0.05 μm to 2 μm.

(Charge Transport Layer)

The charge transport layer exhibits charge transport property, and the crosslinked layer having a charge transport units in the present invention may be effectively utilized as the charge transport layer. When the crosslinked layer is the entire charge transport layer, a coating liquid containing the radical-polymerizable monomer having no charge transport units and the radical-polymerizable monomer having a charge transport units (hereinafter, referring to as "radical polymerizable composition" in the present invention) and the acryl-modified polyorganosiloxane in the present invention is applied on the charge generating layer, followed by drying as required, and cured by use of external energy thereby to form the crosslinked layer. Preferably, the thickness of the crosslinked layer is 10 μm to 30 μm, more preferably is 10 μm to 25 μm. When the thickness is thinner than 10 μm, the charging potential may not be maintained, and when the thickness is above 30 μm, the crosslinked layer may separate from the underlayer owing to volume contraction upon curing.

When the charge transport layer has a laminated structure comprising the crosslinked layer formed on the charge transport layer, the undercoat layer of the charge transport layer may be formed by way of dissolving or dispersing a charge transport material and a binder resin in a proper solvent and applying the resulting liquid on the charge generating layer, followed by drying, then the coating liquid containing the radical polymerizable composition and the acryl-modified polyorganosiloxane in the present invention is applied and crosslinked by use of the external energy as described above.

Examples of the charge transport material include an electron transport substance, an electron-hole transport substance and a charge transport polymer which are described in the above section of the charge generating layer. As noted above, by using the charge transport polymer, the solubility of the charge transport layer during disposing the crosslinked layer by the coating, can be lowered, therefore, the using of the charge transport polymer is particularly preferred.

Examples of the binder resin include a thermoplastic or thermosetting resin, such as a polystyrene resin, a styrene-acrylonitrile copolymer, a styrene-butadiene copolymer, a styrene-maleic anhydride copolymer, a polyester resin, a polyvinyl chloride resin, a vinyl chloride-vinyl acetate copolymer, a polyvinyl acetate resin, a polyvinylidene chloride resin, a polyarylate resin, a phenoxy resin, a polycarbonate resin, a cellulose acetate resin, an ethyl cellulose resin, a polyvinylbutyral resin, a polyvinylformal resin, a polyvinyltoluene resin, a poly-N-vinylcarbazole resin, an acrylic resin, a silicone resin, an epoxy resin, a melamine resin, an urethane resin, a phenolic resin and an alkyd resin. The amount of the charge transport material is preferably 20 parts by mass to 300 parts by mass, more preferably 40 parts by mass to 150 parts by mass, relative to 100 parts by mass of the mass of the binder resin, with proviso that when a charge transport polymer is used as the charge transport material, the charge transport polymer may be used individually or in combination with the binder resin.

The solvents used for disposing the underlayer in the charge transport layer by coating may be the same as those in terms of the charge generating layer described above. Preferably, the solvents can dissolve both of the charge transport material and the binder resin. These solvents may be used individually or in combination. The underlayer in the charge transport layer may be coated in the similar way as the charge generating layer.

The underlayer in the charge transport layer may include additives such as plasticizers and leveling agents depending on requirements. Specific examples of the plasticizers include known ones, which are used for plasticizing resins, such as dibutyl phthalate, dioctyl phthalate and the like. The additive amount of the plasticizer is 0 to 30 parts by mass, relative to 100 parts by mass of the binder resin. Specific examples of the leveling agents include silicone oils such as dimethyl silicone oil, and methyl phenyl silicone oil; polymers or oligomers including a perfluoroalkyl group in their side chain, and the like. The additive amount of the leveling agents is 0 to 1 part by mass based on 100 parts by mass of the binder resin.

The underlayer in the charge transport layer has a thickness of preferably 5 μm to 40 μm, more preferably 10 μm to 30 μm.

When the crosslinked layer is disposed in the surface of the charge transport layer, as noted above in the section of the disposing method of the crosslinked layer, the crosslinked layer is disposed according to a method comprising coating the underlayer in the charge generating layer with a coating liquid comprising a radical polymerizable composition in the present invention, drying optionally the resultant coating as the crosslinked layer, and curing the coating by applying a light energy to the coating, thereby disposing the crosslinked layer. At this time, the crosslinked layer has a thickness of preferably 1 μm to 20 μm, more preferably 2 μm to 10 μm. When the thickness of the crosslinked layer is less than 1 μm, the durability of the photoconductor is scattered due to the irregularity of the film thickness of the crosslinked layer. On the other hand, when the thickness of the crosslinked layer is more than 20 μm, the thickness of the whole charge transport layer becomes too large and accordingly due to the diffusion of the charge, the reproducibility of the image is lowered.

<Photosensitive Layer in Single Layer Structure>

The photosensitive layer in a single layer structure is a layer having the charge generating function and charge transporting function simultaneously. The crosslinked layer having a charge transport units according to the present invention can be preferably used as a photosensitive layer in a single layer structure by incorporating a charge generating substance having a charge generating function in the composition used for disposing the crosslinked layer. As noted above in the disposing method of the charge generating layer by the casting method using a dispersion, the crosslinked layer is disposed according to a method comprising preparing a coating liquid for disposing the crosslinked layer by dispersing a charge generating substance together with a coating liquid comprising a radical polymerizable composition in a solvent, coating charge generating layer with the prepared coating liquid, drying optionally the resultant coating as the crosslinked layer, and curing the coating by applying an external energy to the coating, thereby disposing the crosslinked layer. As another method for preparing the above-noted coating liquid for disposing the crosslinked layer, the charge generating substance may be dispersed in a solvent beforehand and the resultant dispersion of the charge generating substance may be mixed with a coating liquid comprising a radical polymerizable composition for preparing the coating liquid for disposing the crosslinked layer according to the present invention. At this time, the crosslinked layer has a thickness of preferably 10 μm to 30 μm, more preferably 10 μm to 25 μm. When the thickness of the crosslinked layer is less than 10 μm, a satisfactory charging potential of the photoconductor cannot be maintained. On the other hand, when the thickness of the crosslinked layer is more than 30 μm, the peeling of the crosslinked layer from the support or the undercoat layer is easily caused due to the volume contraction of the crosslinked layer during the curing.

Also, when the crosslinked layer is a surface part having a single-layered structure of the photosensitive layer, the undercoat layer of the photosensitive layer is formed by dissolving or dispersing a charge generating substance, a charge transport material, and a binder resin in a proper solvent and applying it, followed by drying. Also, a plasticizer, a leveling agent and the like may be added as needed. The dispersion process of the charge generating substance, the charge generating substance, the charge transport material, the plasticizer, and the leveling agent may be the same as described in terms of the charge generating layer and the charge transport layer. As for the binder resin, in addition to the binder resins described for the charge transport layer, the binder resins described for the charge generating layer may be employed in combination. Also, the charge transport polymer may be used, which is favorable in reducing the inclusion of the photosensitive composition of the lower layer into the crosslinked layer. Preferably, the undercoat layer of the photosensitive layer has a thickness of properly 5 μm to 30 μm, preferably 10 to 25 μm.

When the crosslinked layer is disposed in the surface of the photosensitive layer in a single layer structure, on the underlayer in the photosensitive layer, the crosslinked layer is disposed according to a method comprising coating the underlayer in the photosensitive layer with a coating liquid comprising the radical polymerizable composition and charge generating substance according to the present invention, drying optionally the resultant coating, and curing the resultant coating by applying external energy, such as a light energy and a heat energy, thereby disposing the crosslinked layer. The crosslinked layer has a film thickness of preferably 1 μm to 20 μm, more preferably 2 μm to 10 μm. When the film thickness is less than 1 μm, due to the irregularity of the film thickness, the durability of the photoconductor is scattered.

In the photosensitive layer in a single layer structure, the amount of the charge generating substance, binder resin and charge transport material respectively is preferably 1% by mass to 30% by mass, 20% by mass to 80% by mass and 10% by mass to 70% by mass respectively, based on the total mass of the photosensitive layer.

<Intermediate Layer>

In the photoconductor according to the present invention, when the crosslinked layer is disposed in the surface of the photosensitive layer, for suppressing the invading of a component of the underlayer in the photosensitive layer into the crosslinked layer or improving the adhesion of the crosslinked layer to the underlayer in the photosensitive layer, an intermediate layer can be disposed. The intermediate layer prevents the hindrance of the curing reaction and unevenness of the surface of the crosslinked layer due to the invading of a component of the underlayer in the photosensitive layer into the crosslinked layer comprising a radical polymerizable composition. By disposing the intermediate layer, the adhesion between the underlayer in the photosensitive layer and the crosslinked layer can be improved.

Generally, the intermediate layer comprises mainly a binder resin. Examples of the binder resin include a polyamide resin, an alcohol-soluble nylon resin, a water-soluble polyvinylbutyral resin, a polyvinylbutyral resin and a polyvinylalcohol resin. Examples of the disposing method of the intermediate layer include a general coating method. The intermediate layer has a thickness of preferably 0.05 μm to 2 μm.

<Undercoat Layer>

In the photoconductor of the present invention, an undercoat layer may be provided between conductive support and the photosensitive layer. The undercoat layer is typically formed of resins. The resins are preferably solvent-resistant against common solvents since the photosensitive layer containing an organic solvent is usually coated on the undercoat layer. Examples of the resin include water-soluble resins such as polyvinyl alcohol, casein, sodium polyacrylate, alcohol-soluble resins such as copolymer nylon and methoxymethylated nylon, and curing resins which form a three-dimensional network such as polyurethane, melamine resins, phenol resins, alkyd-melamine resins, and epoxy resins. Also, metal oxide fine powder pigments such as titanium oxide, silica, alumina, zirconium oxide, tin oxide or indium oxide may be added to the undercoat layer to prevent Moire patterns, and to reduce residual potential.

These undercoat layer may be formed using a suitable solvent and by way of a coating method as described in terms of the charge transport layer. A silane coupling agent, titanium coupling agent or chromium coupling agent, etc. can be used as the undercoat layer of the present invention. Also, $Al_2O_3$ prepared by anodic oxidation, organic materials such as polyparaxylylene (parylene) and inorganic materials such as $SiO_2$, $SnO_2$, $TiO_2$, ITO, $CeO_2$ prepared by the vacuum thin film-forming process, can be used for the undercoat layer. Other known methods are used for forming the undercoat layer. The thickness of the undercoat layer is preferably 0 μm to 5 μm.

<Anti-Oxidant>

In the present invention, anti-oxidants may be incorporated into the respective layers of crosslinked layer, charge generating layer, charge transport layer, undercoat layer, intermediate layer etc. in order to improve the environmental resistance, in particular to prevent the sensitivity decrease and the residual potential increase.

The anti-oxidant available for the respective layers may be exemplified as follows, but not limited to.

(Phenol Compounds)

2,6-di-t-butyl-p-cresol, butylhydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t)-butylphenol, 4,4'-butylydenebis-(3-methyl-6-t-butylphenol), 1,1,3-tris-(2-methyl-4-hydroxy 5-t-butylphenyl)butane, 1,3,5-trimethyl-2,4,6-tris-(3,5-di-t-butyl-4-hydroxybenzyl)benzene, tetrakis-[methylene 3-(3',5'-di-t-butyl-4'-hydroxyphenyl)propionate]methane, bis-[3,3'-bis-(4'-hydroxy-3'-t-butylphenyl)butylic acid]glycolester, tocopherols, etc.

(p-Phenylenediamine Compound)

N-phenyl-N'-isopropyl-p-phenylene diamine, N,N'-di-sec-butyl-p-phenylene diamine, N-phenyl-N-sec-butyl-p-phenylene diamine, N,N'-di-isopropyl-p-phenylene diamine, N,N'-dimethyl-N,N'-di-t-butyl-p-phenylene diamine, etc.

(Hydroquinone Compound)

2,5-di-t-octyl hydroquinone, 2,6-di-dodecyl hydroquinone, 2-dodecyl hydroquinone, 2-dodecyl 5-chlorohydroquinone, 2-t-octyl 5-methyl hydroquinone, 2-(2-octadecenyl)-5-methyl hydroquinone, etc.

(Organosulfur Compound)

dilauril-3,3'-thiodipropionate, distearil-3,3'-thiodipropionate, tetradecyl-3,3'-thiodipropionate.

(Organophosphorus Compound)

triphenyl phosphine, tri(nonylphenyl)phosphine, tri(dinonyl phenyl) phosphine, tri-cresil phosphine, tri(2,4-dibutyl phenoxy)phosphine, etc.

These compounds are known as the anti-oxidants of rubber, plastic, fatty and oil, and are commercially available. The content of the anti-oxidant is preferably 0.01% by mass to 10% by mass based on the total mass of the layer to be incorporated.

<Image Forming Process and Image Forming Apparatus>

The image forming processes and apparatuses according to the present invention will be explained with reference to figures. In the image forming processes and apparatuses, the photoconductor comprising the crosslinked layer is employed, and charging, exposing, and developing are carried out using the photoconductor, followed by transferring, fixing, and cleaning.

An image forming process in which an electrostatic latent image is directly transferred to a transferring medium do not always comprise the above-noted steps.

Figure 3:
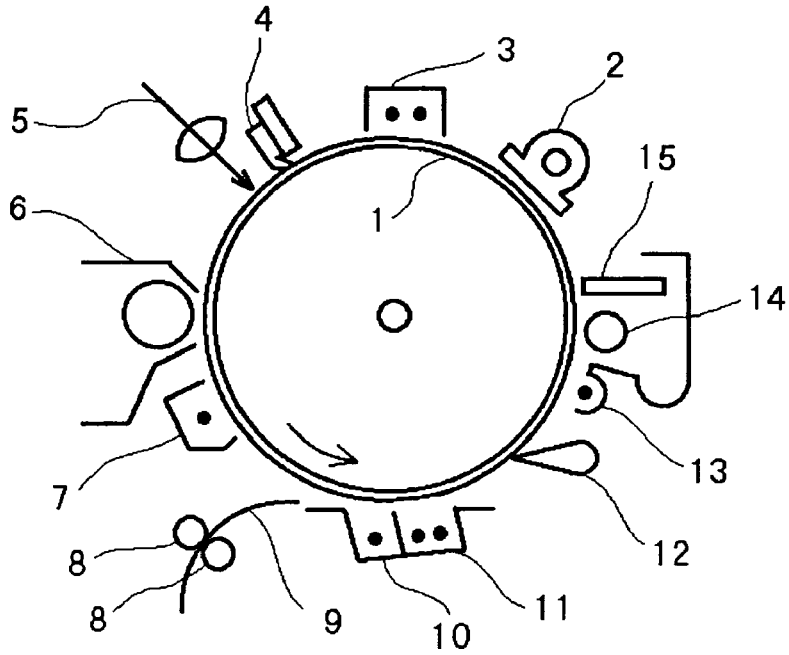
FIG. 3 is an explanatory view schematically showing an example of the image forming apparatus according to the present invention.

FIG. 3 is a schematic view illustrating an exemplary image forming apparatus. A charger 3 is used as a charging unit for evenly charging a photoconductor. Examples of the charging unit include a corotron device, scorotron device, solid discharging device, pin electrode device, roller charging device, conductive brush device and the like.

The image forming unit 5 is employed for forming an electrostatic latent image on photoconductor 1 charged evenly. As for the light source, light emitters such as a fluorescent lamp, tungsten lamp, halogen lamp, mercury lamp, sodium lamp, light emitting diode (LED), semiconductor laser (LD), and electro luminescence may be employed. For providing light only at a desired spectral region, filters such as a sharply cutting filter, bandpass filter, near-infrared cutting filter, dichroic filter, interference filter, and conversion filter for color temperature may be employed.

The developing unit 6 is employed for visualizing the latent electrostatic image formed on the photoconductor 1. The developing may be of one-component developing, two-component developing using a dry toner, or wet developing using a wet toner. When a positive (negative) charge is applied to the photoconductor and image exposure is performed, a positive (negative) electrostatic latent image will be formed on the photoconductor surface. If the latent image is developed with a toner (charge detecting particles) of negative (positive) polarity, a positive image will be obtained, and a negative image will be obtained if the image is developed with a toner of positive (negative) polarity.

Further, transferring charger 10 is employed to transfer the visualized toner image from the photoconductor to transferring body 9. In order conduct the transferring properly, pre-transferring charger 7 may be utilized. In order to carry out the transferring, such processes or ways may be employed as electrostatic transferring using a transfer charger and a bias roller, mechanical transferring process such as adhesion transfer, pressure transfer and the like, and the magnetic transferring process. The charging unit may be employed for carrying out the electrostatic transferring process.

In order to separate transferring body 9 from the photoconductor 1, separation charger 11 or separation claw 12 may be utilized. Additionally, other separation means may be employed such as electrostatic adsorption-induction, stripping using a side belt, stripping by tip grip transportation, self stripping and the like. The separation charger 11 can be employed for the charging unit.

Fur brush 14 and/or cleaning blade 15 may be employed in order to remove the toner remaining on the photoconductor after the transferring. Further, in order to carry out the cleaning more effectively, pre-cleaning charger 13 may be employed. Other cleaning means include the wave process, magnet brush process and the like, which may be used alone or in combination.

A discharging unit may be employed in order to remove the latent image on the photoconductor, depending on the requirement. The discharging means may be discharging lamp 2 and a discharging charger, which may utilize the light source for light exposure and the charging unit, respectively.

In addition, processes for script reading, paper supplying, fixing, and paper releasing may be carried out conventionally.

In FIG. 3, 4 represents an eraser and 8 represents a resist roller.

Figure 4:
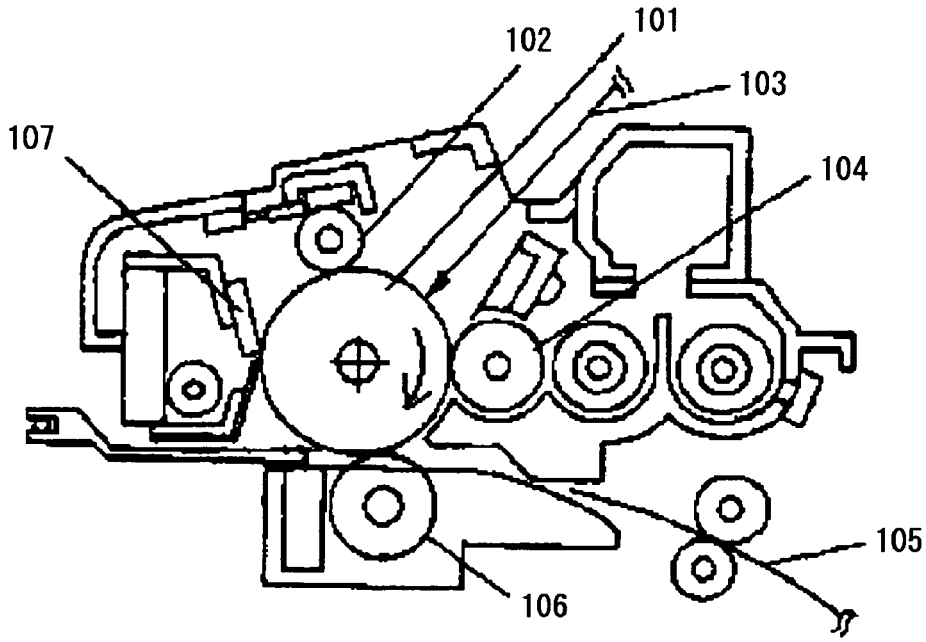
FIG. 4 is an explanatory view schematically showing an example of a process cartridge for the image forming apparatus according to the present invention.

The photoconductors according to the present invention may be advantageously mounted to image forming apparatuses such as copiers, facsimiles, laser printers, and composite apparatuses. In an aspect, the photoconductors are attached to process cartridges and the process cartridges are mounted detachably to the image forming apparatuses, thereby providing users with conveniences of repeated and prolonged usages of photoconductors. FIG. 4 shows an exemplary process cartridge.

The process cartridge for image forming apparatuses comprises photoconductor 101, and at least one of charging unit 102, development unit 104, transferring unit 106, cleaning unit 107, and charging eliminating unit (not shown), and is detachably mounted to a main body of the image forming apparatuses.

With respect to the image forming process by use of the apparatus shown in FIG. 4, an electrostatic latent image is formed on photoconductor 101 through charging by means of charging unit 102 and exposing by means of light exposing unit 103, the electrostatic latent image is developed by means of developing unit 104 using a toner, the developed image is transferred and printed by means of transferring unit 106 on transfer material 105, while photoconductor 101 being rotated in clockwise direction.

Then, the surface of the photoconductor 101 is cleaned by cleaning unit 107 and also is charge-eliminated by means of charge-eliminating unit (not illustrated in FIG. 4). These procedures are repeated and printings are provided repeatedly.

The present invention provides a process cartridge, which comprises a photoconductor comprising the specific crosslinked layer according to the present invention and a charging unit, a developing unit, a transferring unit, a cleaning unit and a destaticizing unit, wherein the photoconductor and at least one of other units are integrated.

As clearly seen from the above description, the photoconductors according to the present invention can be widely employed in copiers and also in various electrophotography fields such as laser beam printers, CRT printers, LED printers, liquid crystal printers, and laser engravings.

<Example of Synthesizing Compound Having Charge Transport Units>

The compounds having a charge transport units adapted to the present invention may be synthesized, for example, by the process described in Japanese Patent No. 3164426. An example is as follows:

(1) Synthesis of Hydroxy Group-Substituted Triarylamine Compound of Formula B

To 240 ml of sulfolane, 113.85 grams (0.3 mol) of methoxy group-substituted triarylamine compound of Formula A and 138 grams (0.92 mol) of sodium iodide are added and heated to 60° C. while flowing nitrogen gas. In the solution, 99 grams (0.91 mol) of trimethylchlorosilane is dropwisely added for 1 hour and stirred at about 60° C. for 4.5 hours, and the reaction was completed. About 1,500 ml of toluene was added to the reactant, then the reaction product was cooled to room temperature and repeatedly rinsed with water and an aqueous sodium carbonate solution.

Then, the solvent was removed from the solution and the residue was purified by means of a column chromatography (adsorption medium: silica gel, developing solvent: toluene/ethyl acetate=20/1). The resulting light yellow oil was crystallized with adding cyclohexane. Consequently, 88.1 grams of white crystal expressed by Formula B having a melting point of 64.0 to 66.0° C. was obtained in the yield of 80.4%. The element content of the compound was measured and calculated and the result is shown in Table 1.

TABLE 1

| Element Analysis | C | H | N |
|---|---|---|---|
| Measured Value | 85.06% | 6.41% | 3.73% |
| Calculated Value | 85.44% | 6.34% | 3.83% |

Formula A

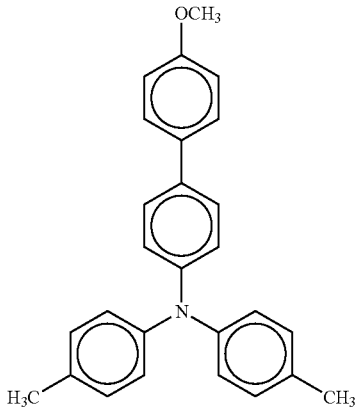

Formula B

TABLE 1-continued

| Element Analysis | C | H | N |
|---|---|---|---|

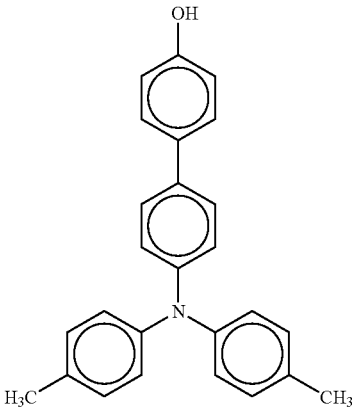

(2) Triarylamino Group-Substituted Acrylate Compound (Compound No. 54 Among 160 Above-Exemplified Monofunctional Radical Polymerizable Compounds)

82.9 g (0.227 mol) of a hydroxyl group-substituted triarylamine compound (represented by Formula B) obtained in the above section (1) was dissolved in 400 ml of tetrahydrofuran and to the resultant solution, an aqueous solution of sodium hydroxide (prepared by dissolving 12.4 g of sodium hydroxide in 100 ml of water) was dropped in a nitrogen gas stream. The resultant solution was cooled at 5° C. and to the solution, 25.2 g (0.272 mol) of acrylic acid chloride was dropped for 40 minutes, followed by stirring the solution at 5° C. for three hours, thereby completing the reaction. The reaction product solution was mixed with water and the resultant mixture was extracted with toluene. The extract was washed repeatedly with an aqueous solution of sodium bicarbonate and water. Thereafter, from the toluene solution, the solvent was distilled off and the resultant residue was purified by a column chromatography (adsorption medium: silica gel, developing solvent: toluene), thereby obtaining an oily substance. The obtained colorless oily substance was mixed with n-hexane and a crystal was separated out, thereby obtaining 80.73 g (yield=84.8%) of a white crystal of the compound No. 54. The compound has a melting point of 117.5° C. to 119.0° C. The element content of the compound was measured and calculated and the result is shown in Table 2.

TABLE 2

| Element Analysis | C | H | N |
|---|---|---|---|
| Measured Value | 83.13% | 6.01% | 3.16% |
| Calculated Value | 83.02% | 6.00% | 3.33% |

Production Example 1-1

With respect to Production Example of the acryl-modified polyorganosiloxane having an amine structure, explanations are given in detail and the following Production Examples should not be construed as limiting the scope of the present invention. In Production Examples, "part" and "%" mean "parts by mass" and "% by mass".

<Preparing of Organopolysiloxane>

1,500 parts of octamethylcyclotetrasiloxane, 8.8 parts of vinyldimethoxymethylsilane and 1,500 parts of an ion-exchanged water were mixed and the resultant mixture was mixed with 15 parts of sodium lauryl sulfate and 10 parts of dodecylbenzenesulfonic acid, followed by stirring the resultant mixture using a homomixer, thereby obtaining an emulsion. The obtained emulsion was subjected to a homogenizer having a pressure of 3,000 bar two times, thereby obtaining a stable emulsion. Next, the obtained emulsion was charged in a flask, heated at 70° C. for 12 hours and cooled down to 25° C., followed by aging the emulsion for 24 hours. pH of the resultant emulsion was adjusted to 7 using sodium carbonate and a nitrogen gas was introduced to the emulsion for 4 hours and the emulsion was subjected to a steam distillation, thereby distilling off volatile siloxane from the emulsion. Next, the resultant emulsion was mixed with an ion-exchanged water for controlling the content of a none-volatile component in the emulsion to 45%, thereby obtaining an emulsion of polysiloxane.

<Preparing of Copolymer Emulsion>

In a 2 L three-necked flask equipped with a stirrer, a condenser, a thermometer and an introducing inlet for a nitrogen gas, 778 parts of the above-obtained emulsion (content of siloxane: 350 parts) and 322 parts of an ion-exchanged water were charged and the temperature of the content in the flask was adjusted to 30° C. in a stream of the nitrogen gas, thereby obtaining a mixture. The obtained mixture was mixed with 1.0 part of t-butylhydroperoxide, 0.5 part of L-ascorbic acid and 0.002 part of ferrous sulfate heptahydrate in the flask and while maintaining the temperature of the content in the flask to 30° C., 112.4 parts of methylmethacrylate, 7.5 parts of tris(2-acryloyloxyethyl) isocyanurate and 30 parts of acryloyloxyethylhexahydrophthalimide were dropped into the flask during five hours. After the completion of the dropping, further the content in the flask was stirred for three hours, thereby completing the reaction in the flask. The solid content of the obtained copolymer emulsion was measured and found to be 39.6%.

Next, 1,000 parts of the obtained emulsion was charged into a flask equipped with a stirrer and was heated at 80° C., followed by charging a solution in which 70 parts of sodium sulfate was dissolved in 280 parts of an ion-exchanged water into the flask, thereby separating out and obtaining a modified polyorganosiloxane in the flask. The obtained modified polyorganosiloxane was subjected to a filtration and washing with water at 80° C. repeatedly, thereby obtaining an acryl-modified polyorganosiloxane polymer (Polymer 1-1).

Production Example 1-2

The acryl-modified polyorganosiloxane polymer (Polymer 1-2) was produced in substantially the same manner as in (Production Example 1-1), except that acryloyloxyethylhexahydrophthalimide was changed to N-(1,1-dimethyl-3-oxyobutyl)acrylamide.

Production Example 1-3

The acryl-modified polyorganosiloxane polymer (Polymer 1-3) was produced in substantially the same manner as in (Production Example 1-1), except that acryloyloxyethylhexahydrophthalimide was changed to acrylamide.

Production Example 2

With respect to Production Example of the acryl-modified polyorganosiloxane having a radical activity, explanations are given in detail and the following Production Examples should not be construed as limiting the scope of the present invention. In Production Examples, "part" and "%" mean "parts by mass" and "% by mass".

The acryl-modified polyorganosiloxane polymer (Polymer 2) was produced in substantially the same manner as in (Production Example 1-1), except that in <Preparing of Copolymer Emulsion>, the set of (112.4 parts of methylmethacrylate, 7.5 parts of tris(2-acryloyloxyethyl) isocyanurate and 30 parts of acryloyloxyethylhexahydrophthalimide) was changed to the set of (78 parts of methylmethacrylate, 13.5 parts of ethylacrylate, 13.5 parts of butylacrylate, 15 parts of 1,3,5,7-tetramethyl-3,5,7-trivinylcyclotetrasiloxy-porpylmethacrylate and 30 parts of acryloyloxyethylhexahydrophthalimide).

EXAMPLES

Next, with respect to the present invention, explanations are given further in detail referring to Examples, which should not be construed as limiting the scope of the present invention. In Examples, "parts" means "parts by mass".

Example 1

An undercoat layer was disposed on a support made of aluminum (having an outer diameter of 30 mm) by coating the support with the following coating liquid according to a dip coating so that the undercoat layer had a thickness of 3.5 μm after drying the coating.

| <Coating Liquid for Disposing Undercoat layer> Composition of Coating Liquid | |
|---|---|
| Alkyd resin (manufactured and sold by Dainippon Ink & Chemicals Inc.; trade name: Beckozole 1307-60-EL) | 6 parts |
| Melamine resin (manufactured and sold by Dainippon Ink & Chemicals Inc.; trade name: Super Beckamine G-821-60) | 4 parts |
| Titanium oxide (manufactured and sold by Ishihara Sangyo Kaisha Ltd.; trade name: CR-EL) | 40 parts |
| Methyl ethyl ketone | 50 parts |

A charge generating layer was disposed on the above-disposed undercoat layer by coating the undercoat layer with a coating liquid for disposing the charge generating layer, which comprised a bisazo pigment represented by the following formula according to a dip coating, and the resultant coating was dried by the heating so that the charge generating layer had a thickness of 0.2 μm.

| <Coating Liquid for Disposing Charge Generating Layer> | |
|---|---|
| Composition of Coating Liquid | |
| Bisazo pigment represented by the following formula | 2.5 parts |

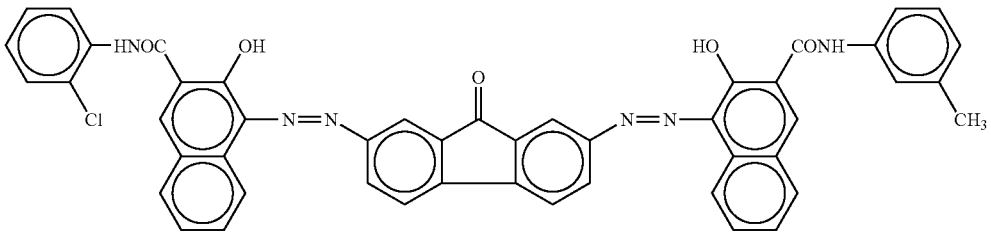

| | |
|---|---|
| Polyvinylbutyral (manufactured and sold by UCC; trade name: XYHL) | 0.5 part |
| Cyclohexanone | 200 parts |
| Methyl ethyl ketone | 80 parts |

A charge transport layer was disposed on the above-disposed charge generating layer by coating the charge generating layer with a coating liquid for disposing the charge transport layer, which had the following composition according to a dip coating, and the resultant coating was dried by the heating so that the charge generating layer had a thickness of 22 μm.

| <Coating Liquid for Disposing Charge transport layer> | |
|---|---|
| Composition of Coating Liquid | |
| Bisphenol Z polycarbonate | 10 parts |
| Charge transport material having a low molecular weight represented by the following formula | 10 parts |

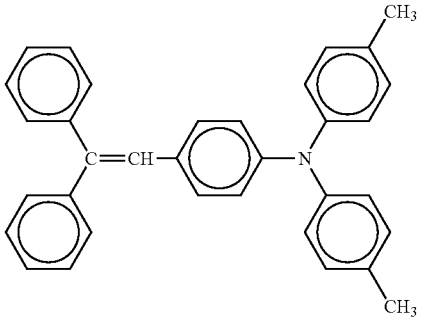

| | |
|---|---|
| Tetrahydrofuran | 80 parts |
| 1% tetrahydrofuran solution of silicone oil (manufactured and sold by Shin-Etsu Chemical Co., Ltd.; trade name: KF 50-100CS) | 0.2 part |

On the above-disposed charge transport layer, a crosslinked layer having a thickness of 4.0 μm was disposed according to a method comprising spray-coating the charge transport layer with a coating liquid for disposing the crosslinked layer, which has the following composition; irradiating a light to the resultant coating using a metal halide lamp under the condition where the illuminance was 500 mW/cm$^2$ and the irradiating time was 200 sec; and drying the coating at 130° C. for 30 minutes, thereby obtaining the photoconductor according to the present invention.

| <Coating Liquid for Disposing Crosslinked Layer> Composition of Coating Liquid | |
|---|---|
| Trimethylolpropanetriacrylate*1 (manufactured and sold by Nippon Kayaku Co., Ltd.; trade name: KAYARAD TMPTA; having a molecular weight of 382, a functionality of 3 and a ratio (molecular mass/functionality) of 99) | 9 parts |
| Radical polymerizable compound having one functionality and a charge transport units (Compound No. 54) | 9 parts |
| 1-hydroxy-cyclohexyl-phenyl-ketone*2 (manufactured and sold by Ciba Specialty Chemicals Corporation; trade name: Irgacure 184) | 1.8 parts |
| Acryl-modified polyorganosiloxane (Polymer 1-1) | 1.8 parts |
| Tetrahydrofuran | 100 parts |

wherein "Trimethylolpropanetriacrylate*1" is a radical polymerizable monomer having three or more functionalities and no charge transport units; and "1-hydroxy-cyclohexyl-phenyl-ketone*2" is a photopolymerization initiator.

Example 2

The photoconductor of Example 2 was produced in substantially the same manner as in Example 1, except that as an acryl-modified polyorganosiloxane in the coating liquid used for disposing the crosslinked layer, (Polymer 1-1) was changed to (Polymer 1-2), so that the crosslinked layer has a thickness of 4.0 μm.

Example 3

The photoconductor of Example 3 was produced in substantially the same manner as in Example 1, except that as an acryl-modified polyorganosiloxane in the coating liquid used for disposing the crosslinked layer, (Polymer 1-1) was changed to (Polymer 1-3), so that the crosslinked layer has a thickness of 4.0 μm.

Example 4

The photoconductor of Example 4 was produced in substantially the same manner as in Example 1, except that as an acryl-modified polyorganosiloxane in the coating liquid used for disposing the crosslinked layer, (Polymer 1-1) was changed to (Polymer 2), so that the crosslinked layer has a thickness of 4.0 μm.

Example 5

The photoconductor of Example 5 was produced in substantially the same manner as in Example 1, except that a radical polymerizable monomer having a charge transport units was eliminated from the composition of the coating liquid used for disposing the crosslinked layer, so that the crosslinked layer has a thickness of 1.0 μm.

Example 6

The photoconductor of Example 6 was produced in substantially the same manner as in Example 4, except that a radical polymerizable monomer having a charge transport units was eliminated from the composition of the coating liquid used for disposing the crosslinked layer, so that the crosslinked layer has a thickness of 1.0 μm.

Example 7

The photoconductor of Example 7 was produced in substantially the same manner as in Example 1, except that a radical polymerizable monomer having a charge transport units in the composition of the coating liquid used for disposing the crosslinked layer was changed to Compound No. 182, so that the crosslinked layer has a thickness of 4.0 μm.

Example 8

The photoconductor of Example 8 was produced in substantially the same manner as in Example 1, except that a radical polymerizable monomer having a charge transport units in the composition of the coating liquid used for disposing the crosslinked layer was changed to Compound No. 363, so that the crosslinked layer has a thickness of 4.0 μm.

Example 9

The photoconductor of Example 9 was produced in substantially the same manner as in Example 1, except that a radical polymerizable monomer having a charge transport units in the composition of the coating liquid used for disposing the crosslinked layer was changed to Compound No. 1, so that the crosslinked layer has a thickness of 4.0 μm.

Example 10

The photoconductor of Example 10 was produced in substantially the same manner as in Example 1, except that a radical polymerizable monomer having a charge transport units in the composition of the coating liquid used for disposing the crosslinked layer was changed to Compound No. 53, so that the crosslinked layer has a thickness of 4.0 μm.

Example 11

The photoconductor of Example 11 was produced in substantially the same manner as in Example 1, except that a radical polymerizable monomer having a charge transport units in the composition of the coating liquid used for disposing the crosslinked layer was changed to Compound No. 161, so that the crosslinked layer has a thickness of 4.0 μm.

Example 12

The photoconductor of Example 12 was produced in substantially the same manner as in Example 1, except that a radical polymerizable monomer having three or more functionalities and no charge transport units in the composition of the coating liquid used for disposing the crosslinked layer was changed to the below-noted monomer, so that the crosslinked layer has a thickness of 4.0 μm.

(Radical Polymerizable Monomer Having Three or More Functionalities and No Charge Transport Units)

Caprolactone-modified dipentaerythritol hexaacrylate (manufactured and sold by Nippon Kayaku Co., Ltd.; trade name: KAYARAD DPCA-60; having a molecular weight of 1263, a number of functional groups of 6 and a ratio (molecular mass/functionality) of 211)

Example 13

With respect to each of the photoconductors obtained in Examples 1 to 10, a piece of the crosslinked layer was dyed using a vapor of ruthenic acid and a morphology of a dyed pieces of the crosslinked layer was observed using a transmission electron microscope (H-9000NAR). As a result of the observation, it was found that a so-called micro phase separation structure in which a dispersion phase of an acryl-modified polyorganosiloxane having an average diameter of 0.2 μm to 0.4 μm is uniformly distributed in the matrix phase of the crosslinked layer, which is shown with respect to each of the photoconductors obtained in Examples 1 to 10.

Comparative Example 1

The photoconductor of Comparative Example 1 was produced in substantially the same manner as in Example 1, except that an acryl-modified polyorganosiloxane was eliminated from the composition of the coating liquid used for disposing the crosslinked layer.

Comparative Example 2

The photoconductor of Comparative Example 2 was produced in substantially the same manner as in Example 1, except that an acryl-modified polyorganosiloxane in the composition of the coating liquid used for disposing the crosslinked layer was changed to a commercial product (manufactured and sold by Nissin Chemical Industry Co., Ltd.; trade name: Chaline R-170) of an acryl-modified polyorganosiloxane having no radical reactivity and no amine structure in which the main chain is a polyorganosiloxane moiety and the side chain is an acrylic moiety (mass ratio between the acrylic moiety and the polyorganosiloxane moiety is 3/7).

Comparative Example 3

The photoconductor of Comparative Example 3 was produced in substantially the same manner as in Example 1, except that an acryl-modified polyorganosiloxane in the composition of the coating liquid used for disposing the crosslinked layer was changed to fine particles of a polysiloxane (manufactured and sold by Toray Silicone Co., Ltd.; trade name: Torayfil R-902 A).

Comparative Example 4

The photoconductor of Comparative Example 4 was produced in substantially the same manner as in Example 1, except that the acryl-modified polyorganosiloxane was changed to particles of a tetrafluoroethylene resin (manufactured and sold by Daikin Industries, Ltd.; trade name: Rublon L-2).

Comparative Example 5

The photoconductor of Comparative Example 5 was produced in substantially the same manner as in Example 1, except that the acryl-modified polyorganosiloxane was changed to a liquid reactive silicone (Bi-terminal silaplane; manufactured and sold by Chisso Corporation; trade name: FM-7721; having a specific gravity of 0.98 and a molecular mass of 5,000) represented by the following formula:

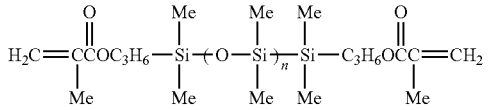

(Printing Test)

With respect to each of the photoconductors produced in Example 1 to Comparative Example 5, the printing test was performed in an amount of 150,000 sheets of an A4-size printing paper (manufactured and sold by NBC Ricoh Co., Ltd.; trade name: My Paper, having an initial charged potential of −700) using a printing machine which is converted from a printer (manufactured and sold by Ricoh Company, Ltd.; trade name: imagio MF2200, which is equipped with a semiconductive laser having a wavelength of 655 nm as an image exposing light source), thereby evaluating wear properties and the image of the photoconductor and a potential in the image forming apparatus. The result of the evaluation of wear degree and image properties of the photoconductor and a potential in the apparatus is shown in Tables 3, 4 and 5.

TABLE 3

| | Wear Degree (μm) | | | |
|---|---|---|---|---|
| | 50,000 Sheets | 100,000 Sheets | 150,000 Sheets | Remarks |
| Ex. 1 | 0.32 | 0.61 | 1.08 | |
| Ex. 2 | 0.31 | 0.60 | 1.02 | |
| Ex. 3 | 0.34 | 0.61 | 1.00 | |
| Ex. 4 | 0.37 | 0.68 | 1.40 | |
| Ex. 5 | 0.30 | 0.55 | 0.98 | |
| Ex. 6 | 0.28 | 0.51 | 0.92 | |
| Ex. 7 | 0.42 | 0.71 | 1.68 | |
| Ex. 8 | 0.30 | 0.62 | 1.22 | |
| Ex. 9 | 0.42 | 1.10 | 2.32 | |
| Ex. 10 | 0.45 | 1.01 | 2.01 | |
| Ex. 11 | 0.85 | 1.91 | 2.80 | |
| Ex. 12 | 0.23 | 0.50 | 1.39 | |
| Comp. Ex. 1 | 1.32 | — | — | Due to a cleaning failure, the test was suspended. |
| Comp. Ex. 2 | 2.76 | — | — | Due to the lost of the crosslinked layer, the test was suspended. |
| Comp. Ex. 3 | — | — | — | Due to a cleaning failure, the test was suspended. |
| Comp. Ex. 4 | — | — | — | Due to a large potential of the exposing portion, the test was suspended. |
| Comp. Ex. 5 | — | — | — | Due to a cleaning failure, the test was suspended. |

TABLE 4

| | Potential in Apparatus (−voltage) | | | | | | | |
|---|---|---|---|---|---|---|---|---|
| | Initial | | After Printing of 50,000 sheets | | After Printing of 100,000 sheets | | After Printing of 150,000 sheets | |
| | Dark Part | Bright Part | Dark Part | Bright Part | Dark Part | Bright Part | Dark Part | Bright Part |
| Ex. 1 | 700 | 100 | 705 | 105 | 700 | 105 | 695 | 120 |
| Ex. 2 | 700 | 105 | 700 | 110 | 695 | 115 | 690 | 110 |

TABLE 4-continued

| | Potential in Apparatus (−voltage) | | | | | | | |
|---|---|---|---|---|---|---|---|---|
| | Initial | | After Printing of 50,000 sheets | | After Printing of 100,000 sheets | | After Printing of 150,000 sheets | |
| | Dark Part | Bright Part | Dark Part | Bright Part | Dark Part | Bright Part | Dark Part | Bright Part |
| Ex. 3 | 700 | 100 | 705 | 100 | 700 | 110 | 695 | 110 |
| Ex. 4 | 700 | 90 | 700 | 110 | 695 | 120 | 690 | 130 |
| Ex. 5 | 700 | 95 | 700 | 100 | 695 | 105 | 700 | 105 |
| Ex. 6 | 700 | 90 | 705 | 95 | 700 | 100 | 710 | 110 |
| Ex. 7 | 700 | 110 | 700 | 115 | 705 | 120 | 705 | 125 |
| Ex. 8 | 700 | 95 | 695 | 95 | 700 | 105 | 695 | 115 |
| Ex. 9 | 700 | 100 | 700 | 105 | 705 | 110 | 700 | 125 |
| Ex. 10 | 700 | 115 | 705 | 115 | 705 | 120 | 705 | 125 |
| Ex. 11 | 700 | 110 | 690 | 115 | 700 | 120 | 700 | 130 |
| Ex. 12 | 700 | 120 | 715 | 125 | 710 | 125 | 710 | 135 |
| Comp. Ex. 1 | 700 | 85 | 695 | 90 | — | — | — | — |
| Comp. Ex. 2 | 700 | 100 | 700 | 120 | — | — | — | — |
| Comp. Ex. 3 | 700 | 100 | — | — | — | — | — | — |
| Comp. Ex. 4 | 700 | 300 | — | — | — | — | — | — |
| Comp. Ex. 5 | 700 | 90 | — | — | — | — | — | — |

TABLE 5

| | Image Density | | | | Image Failure in Stripe Form | | | |
|---|---|---|---|---|---|---|---|---|
| | Initial | After 50,000 sheets | After 100,000 sheets | After 150,000 sheets | Initial | After 50,000 sheets | After 100,000 sheets | After 150,000 sheets |
| Ex. 1 | A | A | A | A | A | A | A | A |
| Ex. 2 | A | A | A | A | A | A | A | A |
| Ex. 3 | A | A | A | A | A | A | A | A |
| Ex. 4 | A | A | A | A | A | A | A | A |
| Ex. 5 | A | A | A | B | A | A | A | A |
| Ex. 6 | A | A | A | A | A | A | A | A |
| Ex. 7 | A | A | A | B | A | A | A | A |
| Ex. 8 | A | A | A | A | A | A | A | A |
| Ex. 9 | A | A | A | A | A | A | A | A |
| Ex. 10 | A | A | A | A | A | A | A | A |
| Ex. 11 | A | A | A | A | A | A | A | A |
| Ex. 12 | A | A | A | B | A | A | A | A |
| Comp. Ex. 1 | A | C | — | — | A | C | — | — |
| Comp. Ex. 2 | A | A | — | — | A | A | — | — |
| Comp. Ex. 3 | A | — | — | — | A | — | — | — |
| Comp. Ex. 4 | B | — | — | — | A | — | — | — |
| Comp. Ex. 5 | A | — | — | — | A | — | — | — |

Image failure in the form of stripe
A: good
B: caused locally
C: caused in the whole image
Image Density
A: good
B: image density was slightly lowered
C: image density was lowered In Comparative Example 1, since the composition of the crosslinked layer comprises no acryl-modified polyorganosiloxane according to the present invention, not only a cleaning failure was caused in the photoconductor, but also after printing of 50,000 sheets, an image failure in the form of stripe was caused in the whole image and the image density was lowered.

In Comparative Example 2, since the composition of the crosslinked layer comprises an acryl-modified polyorganosiloxane having no radical reactivity and no amine structure, the crosslinking degree of the obtained crosslinked film (layer) was low, thus the wear degree of the produced photoconductor was large.

In Comparative Example 3, fine particles of polysiloxane which was frequently used as a lubricant were incorporated in the composition of the crosslinked layer, however, since the compatibility between the fine particles and the resins in the composition of the crosslinked layer was poor, not only a cleaning failure was caused in the photoconductor, but also after printing of 50,000 sheets, an image failure in the form of stripe was caused in the whole image and the image density was lowered.

In Comparative Example 4, since the potential in the exposing part was large from the initial, the image density was lowered.

In Comparative Example 5, while a photoconductor having a smooth surface was obtained, since a reactive silicone had no compatible structure with a binder resin, the reactive silicone was transferred to the most outer surface of the photoconductor at drying the disposed crosslinked layer during the production of the photoconductor, so that the persisting cleaning properties of the photoconductor was unsatisfactory.

Accordingly, it was found that by disposing a crosslinked layer produced by curing a dispersion in which an acryl-modified polyorganosiloxane having a radical reactivity and/or an amine structure is dispersed in a radical polymerizable monomer, preferably by curing at least a radical polymerizable monomer having three or more functionalities and no charge transportable structure and a radical polymerizable compound having a charge transportable structure, at least in the surface of the photosensitive layer of the photoconductor according to the present invention, a photoconductor having a long life and a high performance in which an advantageous image can be maintained for a long term, can be provided. In addition, it was also found that an image forming process, an image forming apparatus and process cartridge using the photoconductor according to the present invention have high performance and high reliability.

What is claimed is:

1. A photoconductor comprising:

an electrically conductive support, and a photosensitive layer disposed on the support, wherein the photosensitive layer comprises a crosslinked layer and the crosslinked layer is produced by curing a dispersion in which an acryl-modified polyorganosiloxane having an imide structure or an amide structure or an acryl-modified polyorganosiloxane having both a radical reactivity and an imide structure or an amide structure is dispersed in a radical polymerizable monomer; and each of the acryl-modified polyorganosiloxane having an imide structure or an amide structure and the acryl-modified polyorganosiloxane having both a radical reactivity and an imide structure or an amide structure is an emulsion graft copolymer of a polyorganosiloxane represented by the following formula (1), a (meth)acrylate ester represented by the following formula (2), and a copolymerizable monomer having an imide or an amide group:

Formula (1)

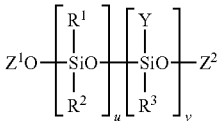

wherein each of $R^1$, $R^2$ and $R^3$ represent a $C_1$ to $C_{20}$ hydrocarbon group or halogenated hydrocarbon group; Y represents an organic group having a radical reactive group, a SH group, or both a radical reactive group and a SH group; u is a positive integer of 10,000 or less and v is an integer of 1 or more; and $Z^1$ and $Z^2$ represent a hydrogen atom, a lower alkyl group or a triorganosilyl group represented by the following formula:

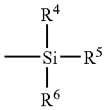

wherein $R^4$ and $R^5$ represent a $C_1$ to $C_{20}$ hydrocarbon group or a halogenated hydrocarbon group; and $R^6$ represents a $C_1$ to $C_{20}$ hydrocarbon group, a halogenated hydrocarbon group or an organic group having a radical reactive group, a SH group, or both a radical reactive group and a SH group, Formula (2)

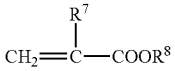

wherein $R^7$ represents a hydrogen atom or a methyl group; and $R^8$ represents an alkyl group, an alkyl group substituted by an alkoxy group, a cycloalkyl group or an aryl group, said imide structure is derived from a monomer having a hexahydrophthalimide structure represented by formula (A)

(A)

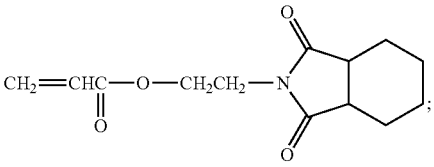

and said amide structure is derived from a monomer having a N-(1,1-dimethyl-3-oxobutyl)acrylamide structure represented by formula (B)

(B)

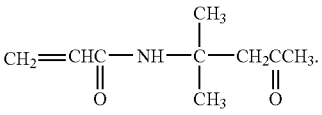

2. The photoconductor according to claim 1, wherein the crosslinked layer is the whole photosensitive layer, or is disposed on the surface of the photosensitive layer opposite to the support.

3. The photoconductor according to claim 1, wherein the crosslinked layer is produced by curing a dispersion in which the acryl-modified polyorganosiloxane having both an imide structure or an amide structure and a radical reactivity is dispersed in a radical polymerizable monomer.

4. The photoconductor according to claim 1, wherein all of or a part of the radical polymerizable monomers are at least a monomer having three or more functionalities and no charge transport units.

5. The photoconductor according to claim 4, wherein the ratio of the molecular mass to the number of the functional group (molecular mass/number of functional group) is 250 or less in the radical polymerizable monomer having three or more functionalities and no charge transport units.

6. The photoconductor according to claim 4, wherein a radical polymerizable monomer having a charge transport unit is used, in addition to the radical polymerizable monomer having three or more functionalities and no charge transport units.

7. The photoconductor according to claim 6, wherein the radical polymerizable monomer having a charge transport unit has one functionality.

8. The photoconductor according to claim 6, wherein the radical polymerizable group in the radical polymerizable monomer having a charge transport unit is one selected from the group consisting of an acryloyloxy group, a methacryloyloxy group, a vinyl group and a mixture thereof.

9. The photoconductor according to claim 6, wherein the charge transport unit in the radical polymerizable monomer having a charge transport unit is a triarylamine structure.

10. The photoconductor according to claim 6, wherein the radical polymerizable monomer having a charge transport unit is at least one selected from the group consisting of the monomers represented by the following formulas (5) and (6):

Formula (5)

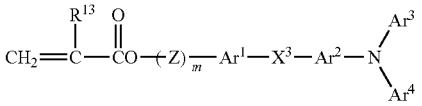

Formula (6)

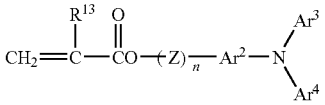

wherein $R^{13}$ represents a hydrogen atom, halogen atom, alkyl group which may be substituted, aralkyl group which may be substituted, aryl group which may be substituted, cyano group, nitro group, alkoxy group, —$COOR^{14}$ ($R^{14}$ represents a hydrogen atom, alkyl group which may be substituted, aralkyl group which may be substituted, or aryl group which may be substituted), halogenated carbonyl group, or $CONR^{15}R^{16}$ ($R^{15}$ and $R^{16}$ each represents a hydrogen atom, halogen atom, alkyl group which may be substituted, aralkyl group which may be substituted, or aryl group which may be substituted, $R^{15}$ and $R^{16}$ may be identical or different); $Ar^1$ and $Ar^2$ each represents a substituted or unsubstituted arylene group which may be identical or different; $Ar^3$ and $Ar^4$ each represents a substituted or unsubstituted aryl group which may be identical or different; $X^3$ represents a single bond, alkylene group, cycloalkylene group, alkylene ether group, oxygen atom, sulfur atom, or vinylene group; Z represents an alkylene group, alkylene ether group, aralkylene group, or alkyleneoxycarbonyl group; "m" and "n" each represents an integer of 0 to 3.

11. The photoconductor according to claim 10, wherein the radical polymerizable monomer having a charge transport unit is at least one selected from the group consisting of the monomers represented by the following formula (7):

Formula (7)

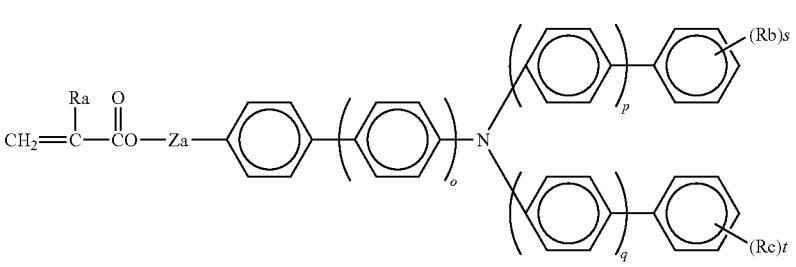

where "o", "p", and "q" each represents an integer of 0 or 1, Ra represents a hydrogen atom or methyl group, Rb and Rc each represents a $C_1$ to $C_6$ alkyl group and may be different when they are two or more, "s" and "t" each represents an integer of 0 to 3 and Za represents a single bond, methylene group, ethylene group, or group expressed by the following formulas:

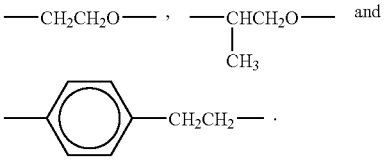

12. The photoconductor according to claim 1, wherein a radical polymerizable group in the radical polymerizable monomer is one selected from the group consisting of an acryloyloxy group, a methacryloyloxy group, a vinyl group and a mixture thereof.

13. The photoconductor according to claim 1, wherein the acryl-modified polyorganosiloxane having both a radical reactivity and an imide structure or an amide structure and the acryl-modified polyorganosiloxane having an imide structure or an amide structure are dispersed in the form of particles.

14. The photoconductor according to claim 1, wherein the curing of the crosslinked layer is performed by a heating method or a light energy irradiating method.

15. The photoconductor according to claim 1, wherein the photosensitive layer has a laminated layer structure in which a charge generating layer, a charge transport layer and the crosslinked layer are disposed on the support in this order.

16. An image forming process comprising:

charging a photoconductor, exposing the photoconductor charged by the charging for forming an electrostatic latent image, developing the electrostatic latent image using a toner for visualizing the electrostatic latent image and forming a toner image, and transferring the toner image formed by the developing to a transferring medium, wherein the photoconductor comprises:

a photosensitive layer disposed on an electrically conductive support, wherein the photosensitive layer comprises a crosslinked layer and the crosslinked layer is produced by curing a dispersion in which an acryl-modified polyorganosiloxane having an imide structure or an amide structure or an acryl-modified polyorganosiloxane having both a radical reactivity and an imide structure or an amide structure is dispersed in a radical polymerizable monomer; and each of the acryl-modified polyorganosiloxane having an imide structure or an amide structure and the acryl-modified polyorganosiloxane having both a radical reactivity and an imide structure or an amide structure is an emulsion graft copolymer of a polyorganosiloxane represented by the following formula (1), a (meth)acrylate ester represented by the following formula (2), and a copolymerizable monomer having an imide or an amide group:

Formula (1)

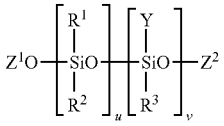

wherein each of $R^1$, $R^2$ and $R^3$ represent a $C_1$ to $C_{20}$ hydrocarbon group or halogenated hydrocarbon group; Y represents an organic group having a radical reactive group, a SH group, or both a radical reactive group and a SH group; u is a positive integer of 10,000 or less and v is an integer of 1 or more; and $Z^1$ and $Z^2$ represent a hydrogen atom, a lower alkyl group or a triorganosilyl group represented by the following formula:

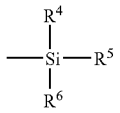

wherein $R^4$ and $R^5$ represent a $C_1$ to $C_{20}$ hydrocarbon group or a halogenated hydrocarbon group; and $R^6$ represents a $C_1$ to $C_{20}$ hydrocarbon group, a halogenated hydrocarbon group or an organic group having a radical reactive group, a SH group, or both a radical reactive group and a SH group, Formula (2)

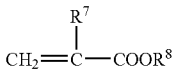

wherein $R^7$ represents a hydrogen atom or a methyl group; and $R^8$ represents an alkyl group, an alkyl group substituted by an alkoxy group, a cycloalkyl group or an aryl group, said imide structure is derived from a monomer having a hexahydrophthalimide structure represented by formula (A)

(A)

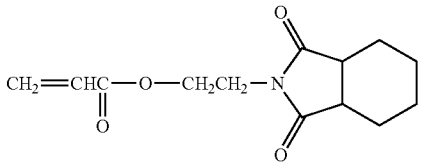

and said amide structure is derived from a monomer having a N-(1,1-dimethyl-3-oxobutyl)acrylamide structure represented by formula (B)

(B)

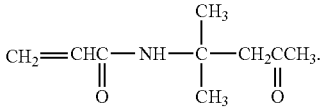

17. An image forming apparatus comprising:

a photoconductor, a charging unit configured to charge the photoconductor, an exposing unit configured to expose the photoconductor charged by the charging unit for forming an electrostatic latent image, a developing unit configured to develop the electrostatic latent image using a toner for visualizing the electrostatic latent image and forming a toner image, and a transferring unit configured to transfer the toner image formed by the developing unit to a transferring medium, wherein the photoconductor comprises:

a photosensitive layer disposed on an electrically conductive support, wherein the photosensitive layer comprises a crosslinked layer and the crosslinked layer is produced by curing a dispersion in which an acryl-modified polyorganosiloxane having an imide structure or an amide structure or an acryl-modified polyorganosiloxane having both a radical reactivity and an imide structure or an amide structure is dispersed in a radical polymerizable monomer; and each of the acryl-modified polyorganosiloxane having an imide structure or an amide structure and the acryl-modified polyorganosiloxane having both a radical reactivity and an imide structure or an amide structure is an emulsion graft copolymer of a polyorganosiloxane represented by the following formula (1), a (meth)acrylate ester represented by the following formula (2), and a copolymerizable monomer having an imide or an amide group:

Formula (1)

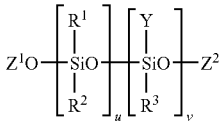

wherein each of $R^1$, $R^2$ and $R^3$ represent a $C_1$ to $C_{20}$ hydrocarbon group or halogenated hydrocarbon group; Y represents an organic group having a radical reactive group, a SH group, or both a radical reactive group and a SH group; u is a positive integer of 10,000 or less and v is an integer of 1 or more; and $Z^1$ and $Z^2$ represent a hydrogen atom, a lower alkyl group or a triorganosilyl group represented by the following formula:

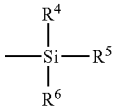

wherein $R^4$ and $R^5$ represent a $C_1$ to $C_{20}$ hydrocarbon group or a halogenated hydrocarbon group; and $R^6$ represents a $C_1$ to $C_{20}$ hydrocarbon group, a halogenated hydrocarbon group or an organic group having a radical reactive group, a SH group, or both a radical reactive group and a SH group, Formula (2)

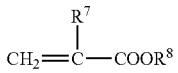

wherein $R^7$ represents a hydrogen atom or a methyl group; and $R^8$ represents an alkyl group, an alkyl group substituted by an alkoxy group, a cycloalkyl group or an aryl group, said imide structure is derived from a monomer having a hexahydrophthalimide structure represented by formula (A)

(A)

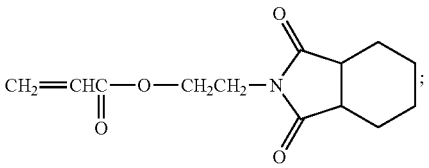

and said amide structure is derived from a monomer having a N-(1,1-dimethyl-3-oxobutyl)acrylamide structure represented by formula (B)

(B)

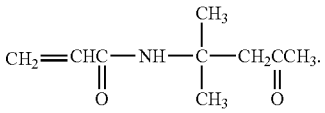

18. A process cartridge comprising:

a photoconductor, and at least one selected from the group consisting of:

a charging unit configured to charge the photoconductor, a developing unit configured to develop an electrostatic latent image using a toner for visualizing the electrostatic latent image and forming a toner image, a transferring unit configured to transfer the toner image formed by the developing unit to a transferring medium, a cleaning unit configured to clean the toner remained on the photoconductor after transferring the toner image by the transferring unit, and a destaticizing unit configured to remove the electrostatic latent image on the photoconductor after transferring the toner image by the transferring unit, wherein the process cartridge is an integrated unit of the photoconductor and at least one selected from the group consisting of the charging unit, the developing unit, the transferring unit, the cleaning unit and the destaticizing unit and is attached to an image forming apparatus in an attachable and detachable manner, the photoconductor comprises: a photosensitive layer disposed on an electrically conductive support, wherein the photosensitive layer comprises a crosslinked layer and the crosslinked layer is produced by curing a dispersion in which an acryl-modified polyorganosiloxane having an imide structure or an amide structure or an acryl-modified polyorganosiloxane having both a radical reactivity and an imide structure or an amide structure is dispersed in a radical polymerizable monomer; and each of the acryl-modified polyorganosiloxane having an imide structure or an amide structure and the acryl-modified polyorganosiloxane having both a radical reactivity and an imide structure or an amide structure is an emulsion graft copolymer of a polyorganosiloxane represented by the following formula (1), a (meth)acrylate ester represented by the following formula (2), and a copolymerizable monomer having an imide or an amide group:

Formula (1)

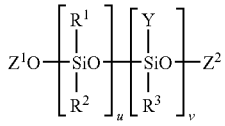

wherein each of $R^1$, $R^2$ and $R^3$ represent a $C_1$ to $C_{20}$ hydrocarbon group or halogenated hydrocarbon group; Y represents an organic group having a radical reactive group, a SH group, or both a radical reactive group and a SH group; u is a positive integer of 10,000 or less and v is an integer of 1 or more; and $Z^1$ and $Z^2$ represent a hydrogen atom, a lower alkyl group or a triorganosilyl group represented by the following formula:

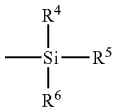

wherein $R^4$ and $R^5$ represent a $C_1$ to $C_{20}$ hydrocarbon group or a halogenated hydrocarbon group; and $R^6$ represents a $C_1$ to $C_{20}$ hydrocarbon group, a halogenated hydrocarbon group or an organic group having a radical reactive group, a SH group, or both a radical reactive group and a SH group, Formula (2)

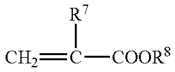

wherein $R^7$ represents a hydrogen atom or a methyl group; and $R^8$ represents an alkyl group, an alkyl group substituted by an alkoxy group, a cycloalkyl group or an aryl group, said imide structure is derived from a monomer having a hexahydrophthalimide structure represented by formula (A)

(A)

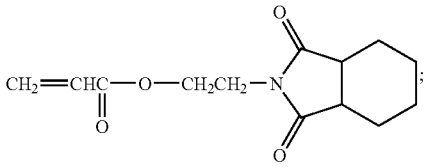

and said amide structure is derived from a monomer having a N-(1,1-dimethyl-3-oxobutyl)acrylamide structure represented by formula (B)

(B)

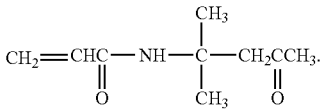

* * * * *